US006777148B2

(12) United States Patent
Kodera et al.

(10) Patent No.: US 6,777,148 B2
(45) Date of Patent: Aug. 17, 2004

(54) ORGANIC PHOTOCONDUCTIVE MATERIAL AND ELECTROPHOTOGRAPHIC PHOTORECEPTOR USING THE MATERIAL

(75) Inventors: Tatsuya Kodera, Tokyo (JP); Koichi Torizuka, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 10/274,148

(22) Filed: Oct. 21, 2002

(65) Prior Publication Data

US 2003/0148201 A1 Aug. 7, 2003

(30) Foreign Application Priority Data

Oct. 25, 2001 (JP) ..... 2001-327173
Dec. 26, 2001 (JP) ..... 2001-394698

(51) Int. Cl.[7] ..... G03G 5/06
(52) U.S. Cl. ..... 430/58.65; 430/73; 430/76; 430/96
(58) Field of Search ..... 430/58.65, 73, 430/74, 75, 76, 78, 96

(56) References Cited

U.S. PATENT DOCUMENTS 5,013,623 A 5/1991 Itoh et al.
5,246,808 A * 9/1993 Hanatani et al. ..... 430/58.15
5,567,560 A * 10/1996 Hagiwara et al. ..... 430/58.85
6,183,921 B1 * 2/2001 Yu et al. ..... 430/58.7

FOREIGN PATENT DOCUMENTS

| | | |
|---|---|---|
| JP | 2659561 | 2/1990 |
| JP | 2812618 | 12/1993 |
| JP | 325508 | 12/1997 |
| JP | 112157 | 4/2000 |
| JP | 242007 | 8/2000 |

* cited by examiner

*Primary Examiner*—John L Goodrow
(74) *Attorney, Agent, or Firm*—Nixon & Vanderhye P.C.

(57) ABSTRACT

Disclosed are a novel organic photoconductive material suitable as a charge-transporting material in a photosensitive layer of an electrophotographic photoreceptor or usable in various display devices, and an electrophotographic photoreceptor which uses the above organic photoconductive material in a photosensitive layer and which exhibits a high charge potential and high sensitivity and also exhibits little or almost no change in various properties in repeated use and can exhibit stabilized performances.

The present invention provides an organic photoconductive material comprising a compound having a specific structure and an electrophotographic photoreceptor having a photosensitive layer containing the above photoconductive material.

20 Claims, No Drawings

ORGANIC PHOTOCONDUCTIVE MATERIAL AND ELECTROPHOTOGRAPHIC PHOTORECEPTOR USING THE MATERIAL

TECHNICAL BACKGROUND

1. Field of the Invention

The present invention relates to an organic photoconductive material and an electrophotographic photoreceptor to which the organic photoconductive material is applied. More specifically, the present invention relates to a novel organic photoconductive material suitable as a charge-transporting material in a photosensitive layer of an electrophotographic photoreceptor or usable in various display devices, and an electrophotographic photoreceptor which uses the above organic photoconductive material in a photosensitive layer, which exhibits a high charge potential and high sensitivity, and which exhibits little or almost no change in various properties in repeated use and can exhibit stabilized performances.

2. Explanation of Related Art

In recent years, the use of electrophotography is not limited to the field of a copying machine, and is widely applied to conventionally photography-applied fields of a printing plate material, a slide film, a microfilm, and the like. Further, studies are being made for the application thereof to a high-speed printer using a laser, LED or CRT as a light source. Further, studies are being made for applications of photoconductive materials to uses other than an electrophotographic photoreceptor, for example, various display devices such as a sensor material, an electrostatic recording device, an EL device, an optical switching element and an electronic paper. Accordingly, there are increasing sophisticated broad demands for a photoconductive material and an electrophotographic photoreceptor using such a photoconductive material. As a conventional electrophotographic photoreceptor, inorganic photoconductive materials such as selenium, cadmium sulfide, zinc oxide, silicon, etc., are known, and these materials have been widely studied and practically used. The above inorganic materials have advantages and have various disadvantages at the same time. For example, selenium has drawbacks that it has difficulties in production conditions and is liable to undergo crystallization under heat or mechanical impact. Cadmium sulfide and zinc oxide have difficulties with respect of humidity resistance and durability. It is pointed out that silicon is insufficient in chargeability and causes difficulties in production. Further, selenium and cadmium sulfide also have a toxicity problem.

In contrast, organic photoconductive materials have advantages that they have good film formability, excellent flexibility, a light weight and good transparency, and that they permit easy designing of an electrophotographic photoreceptor to a broad wavelength region on the basis of a proper sensitizing method. For this reason, it is gradually attracting attention to put them into practical use.

Meanwhile, a photoreceptor for use in electrophotography is generally required to have the following properties as basic properties. That is, (1) it is to have high chargeability to corona discharge in a dark place, (2) the leakage of an obtained charge in a dark place (dark decay) is to be small, (3) the neutralization of the charge under irradiation with light (light decay) is to be rapid, and (4) the residual charge after the irradiation with light is to be small.

As organic photoconductive materials, photoconductive polymers including polyvinyl carbazole have been so far studied in various ways. However, these polymers are not necessarily sufficient in film formability, flexibility and adhesion, and it cannot be said that they fully have the above basic properties for a photoreceptor.

Concerning organic low-molecular-weight photoconductive compounds, it is possible to obtain a photoreceptor excellent in film formability, adhesion and mechanical strength such as flexibility when a binder and other materials are selected for forming a photoreceptor. However, it is difficult to find a compound suitable for maintaining a high-sensitivity characteristic.

For overcoming the above problems, there has been developed an organic photoreceptor imparted with the property of higher sensitivity by attaining the charge-generating function and the charge-transporting function separately with different substances. The characteristic feature of the above photoreceptor called a separated-function type is that materials suitable for the different functions can be selected from a broad range of materials, and since photoreceptors having performances as required can be easily produced, many materials have been studied.

Of these materials, a variety of substances such as phthalocyanine, a squarinium dyestuff, an azo pigment, a perylene pigment, etc., have been studied. Above all, an azo pigment has been studied and increasingly put to practical use since it can have a variety of molecular structures and can be expected to attain high charge generation efficiency. In the azo pigment, however, the relationship between its molecular structure and charge generation efficiency has not been clarified. The fact is that sutides on chemical synthesis have been and are being extensively made to search for optimum structures.

In recent years, a laser beam printer that uses laser beam in place of white light as a light source and is advantageous in high speed, high image qualities and non-impact has come to be popular together with the advance of information processing systems, and it is desired to develop materials that can comply with requirements therefor. In recent years, particularly, a semiconductor laser whose application to a compact disk, an optical disk, etc., has increased and whose technical progress is notable has been applied aggressively to the field of printers as a compact and highly reliable light source material. Since the above light source emits a beam having a wavelength of approximately 780 nm, a photoreceptor having the property of high-sensitivity to long-wavelength light around 780 nm is suitable, so that it is strongly desired to develop such photoreceptors. Under the circumstances, attempts are being actively made to develop photoreceptors using phthalocyanine having light absorption in a near infrared region, while no fully satisfactory photoreceptors have been developed.

Meanwhile, substances that work to transport charges include a hole-transporting substance and an electron-transporting substance. Various substances such as hydrazone compounds, stilbene compounds, etc., as a hole-transporting substance and 2,4,7-trinitro-9-fluorenone, diphenoxy derivatives, etc., as an electron-transporting substance are studied and practically used. With respect to these substances, however, the fact is that studies on chemical synthesis have been and are being increasingly made to search for optimum structures. In fact, many improvements have been made, but there have been obtained no substances that can fully satisfy the above basic properties or requirements such as high durability, etc., of a photoreceptor.

For practical use of an electrophotographic photoreceptor, the stability thereof in repeated use is also an unavoidable requirement. When a photoreceptor is repeatedly used, there come to appear various phenomena that cause image defects (ground fogging, black dots, white dots of images, etc.), such as a decrease in chargeabiity, a decrease in sensitivity and an increase in residual charge. For suppressing the above phenomena, various substances to be added to a photosensitive layer have been studied. However, the effect thereof varies depending upon kinds and combinations of a charge-generating substance and a charge-transporting substance, and under the circumstances, it is difficult to find a constitution sufficient for practical use.

Further, it is known that many properties required of a function-separation type photoreceptor, such as electric properties including chargeability, sensitivity, residual potential, pre-exposure property and repetitiveness and mechanical properties including mechanical strength such as scratch resistance and abrasion resistance are greatly influenced by types of binders used for dispersing or compatibilizing components such as a charge-generating substance and a charge-transporting substance. For constituting a photoreceptor to satisfy required properties, a number of combinations of components and binders have been proposed, while no sufficient combination has been obtained.

As described above, various improvements have been attempted for producing an electrophotographic photoreceptor. However, the fact is that there has been obtained no electrophotographic photoreceptor that fully satisfies the above basic properties required of an electrophotographic photoreceptor and the above requirements of high durability, and the like.

SUMMARY OF THE INVENTION

Under the circumstances, it is a first object of the present invention to provide an organic photoconductive material that gives an electrophotographic photoreceptor having high sensitivity and capability of exhibiting stabilized performances in repeated use when used in a photosensitive layer of an electrophotographic photoreceptor, and which can be also used in a sensor material, an electrostatic recording device, an optical switching element and various display devices such as an EL device and an electronic paper.

It is a second object of the present invention to provide an electrophotographic photoreceptor which exhibits a high charge potential and has high sensitivity and further which shows little or almost no change in various properties in repeated use and can exhibit stable performances.

The present inventors have made diligent studies for achieving the above objects. As a result, it has been found that the first object can be achieved by using an organic photoconductive material comprising a compound having a specific structure and that the second object can be achieved by an electrophotographic photoreceptor having a photosensitive layer containing the above organic photoconductive material. The present invention has been completed on the basis of the above findings.

That is, the present invention provides:

(1) an organic photoconductive material of, the general formula (1), (1)

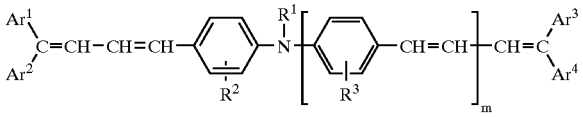

wherein $R^1$ is alkyl, aryl or a heterocyclic group, each of $R^2$ and $R^3$ is a hydrogen atom, a halogen atom or alkyl, each of $Ar^1$ to $Ar^4$ is aryl or a heterocyclic group and m is 1 when $R^1$ is alkyl or 0 when $R^1$ is aryl or a heterocyclic group, and (2) an electrophotographic photoreceptor comprising a photosensitive layer containing a photoconductive material of the above general formula (1) on an electrically conductive substrate.

PREFERRED EMBODIMENTS OF THE INVENTION

First, the organic photoconductive material of the present invention will be explained.

The organic photoconductive material of the present invention has a structure of the general formula (1).

(1)

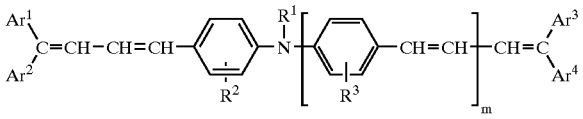

In the above general formula (1), $R^1$ is alkyl, aryl or a heterocyclic group. Examples of the alkyl include linear alkyls such as methyl, ethyl, propyl, butyl, pentyl, hexyl, heptyl, octyl, nonyl and decyl; branched alkyl groups such as isopropyl, sec-butyl, tert-butyl, isobutyl, isopentyl, neopentyl, tert-pentyl, 1-methylbutyl, 1-ethylpropyl, 2-methylbutyl, 1,2-dimethylpropyl, isohexyl, 1-methylpentyl, 1-ethylbutyl, 1,3-dimethylbutyl, 1-ethyl-2-methylpropyl, 1,1-dimethylbutyl, 2-methylpentyl, 3-methylpentyl, 1,2-dimethylbutyl, 1-ethyl-1-methylpropyl, 2,2-dimethylbutyl, 1,2,2-trimethylpropyl, 3,3-dimethylbutyl, 2,3-dimethylbutyl and 1,1,2-trimethylpropyl; cycloalkyls such as cyclobutyl, cyclopentyl, cyclohexyl, cycloheptyl and cyclooctyl; and alkyls formed of the above linear alkyl, branched alkyl and cycloalkyl which are bonded to each other.

Examples of the aryl include phenyl and naphthyl, and examples of the heterocyclic group include pyridyl, thienyl and furyl.

Further, $R^1$ may have a substituent. Specific examples of the substituent include the above alkyls, halogen atoms such as a fluorine atom, a chlorine atom, a bromine atom and iodine atom, and alkoxyl groups such as methoxy, ethoxy and propoxy.

Each of $R^2$ and $R^3$ is a hydrogen atom, a halogen atom or alkyl. The halogen atom includes a fluorine atom, a chlorine atom, a bromine atom and an iodine atom. The alkyl includes the above alkyl groups.

Each of $Ar^1$ to $Ar^4$ is aryl or a heterocyclic group, and specific examples thereof include the above aryls and the above heterocyclic groups. $Ar^1$ to $Ar^4$ may have a substituent, and specific examples of the substituent include the above alkyls, the above halogen atoms and the above alkoxyls.

When $R^1$ is alkyl, m is 1. When $R^1$ is aryl or a heterocyclic group, m is 0.

Specific examples of the organic photoconductive material of the general formula 1, provided by the present invention, include the following compounds, although the organic photoconductive material shall not be limited thereto.

(9)

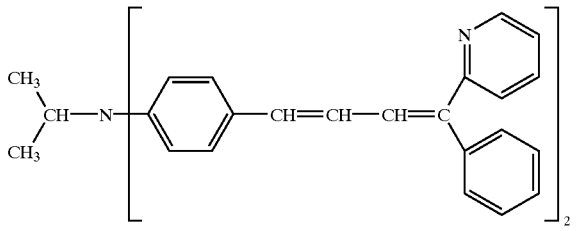

(10)

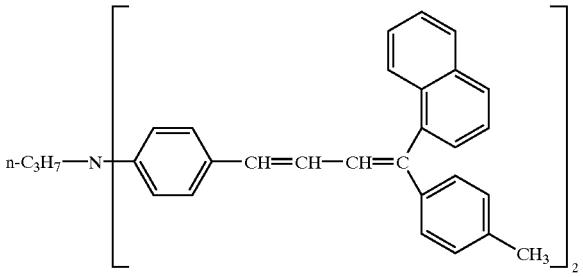

(11)

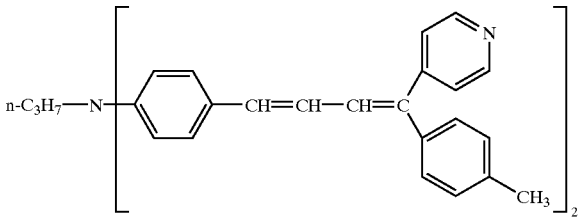

(12)

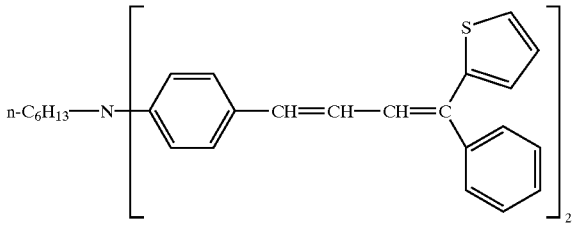

-continued (13)

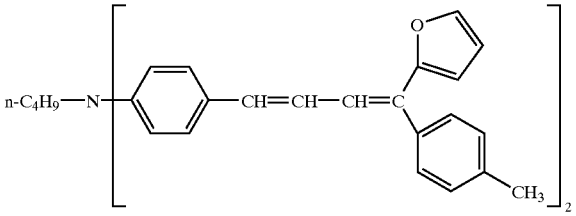

(14)

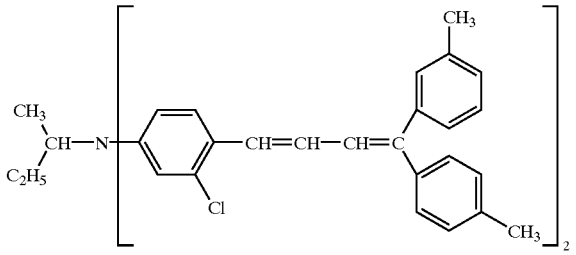

(15)

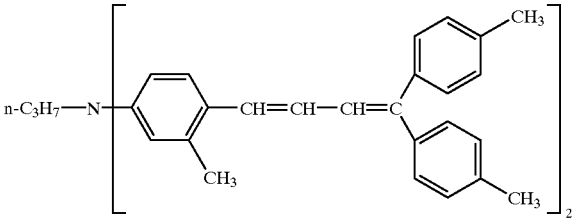

(16)

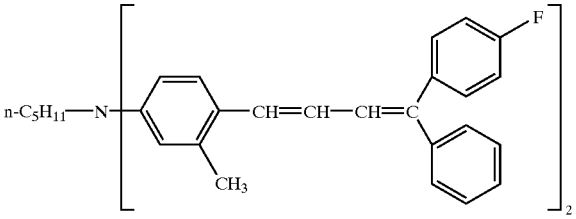

(17)

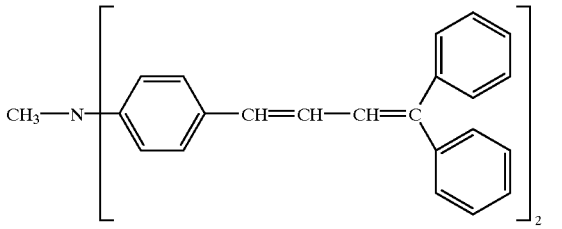

(18)

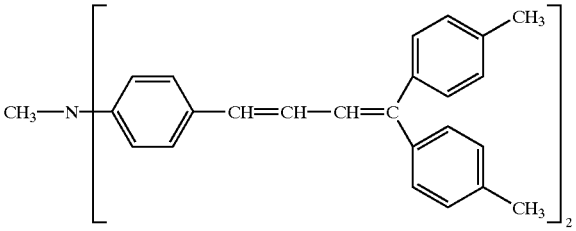

-continued
(19)
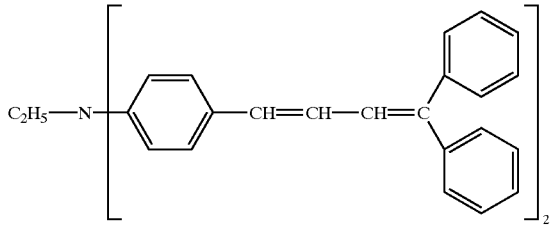
(20)
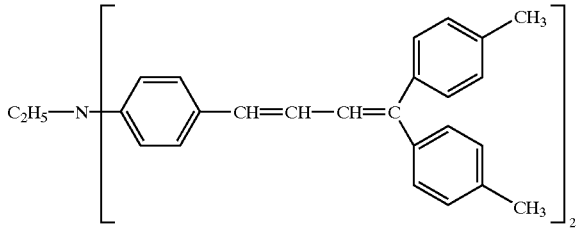
(21)
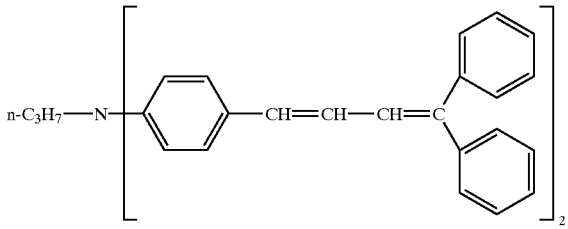
(22)
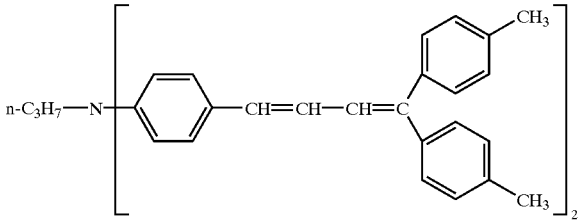
(23)
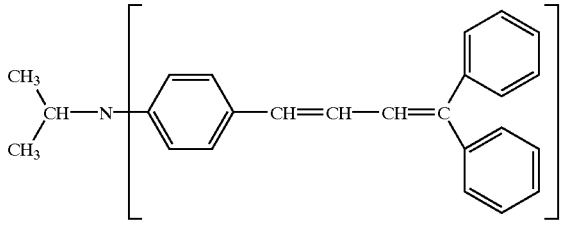
(24)
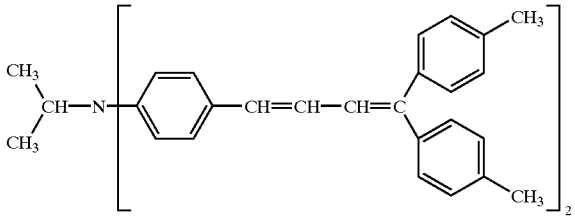
-continued
(25)
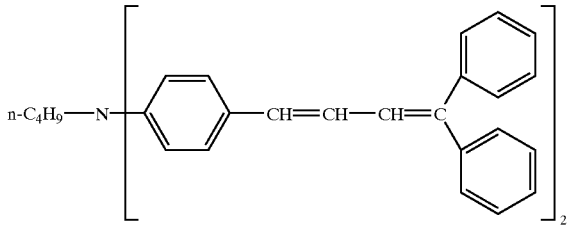
(26)
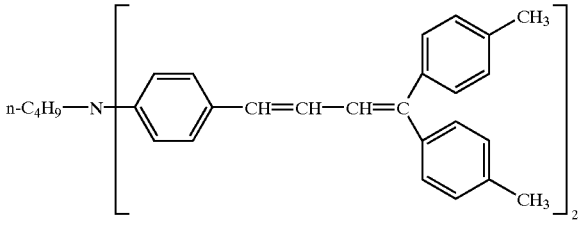
(27)
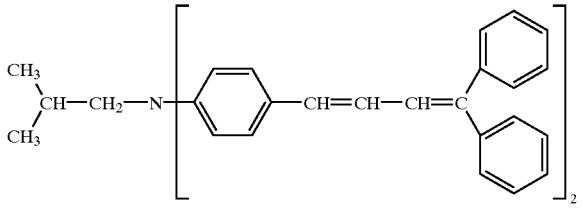
(28)
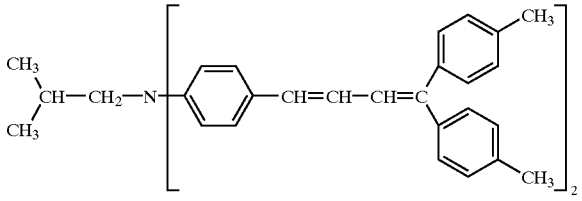
(29)
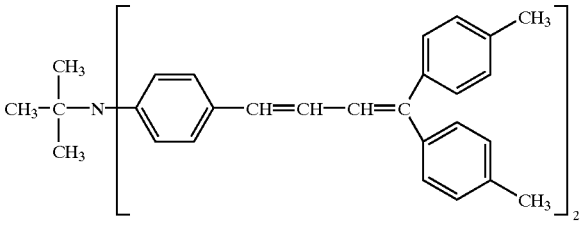
(30)
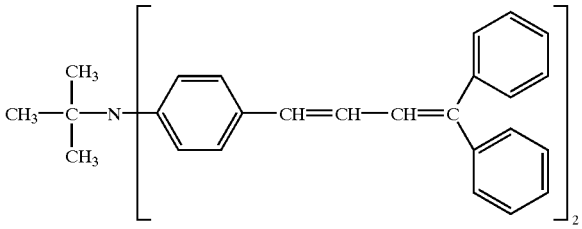

-continued
(31)
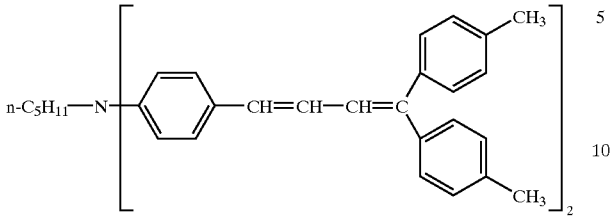
(32)
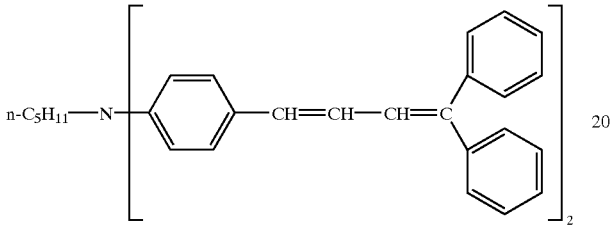
(33)
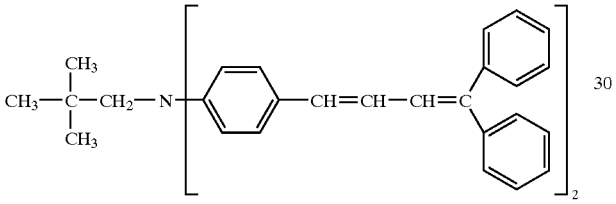
(34)
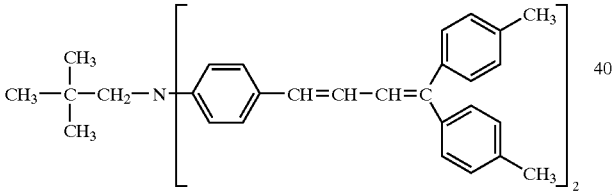
(35)
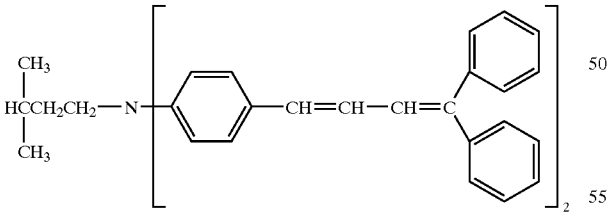
(36)
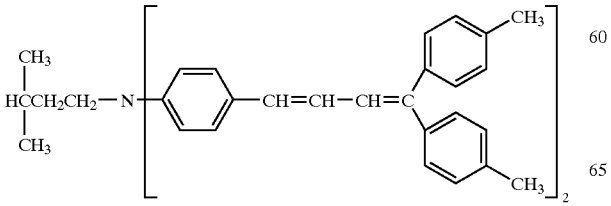
-continued
(37)
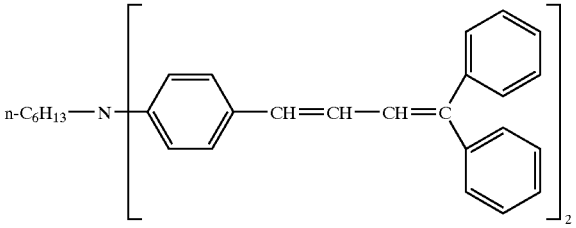
(38)
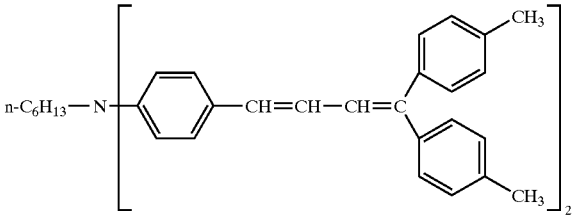
(39)
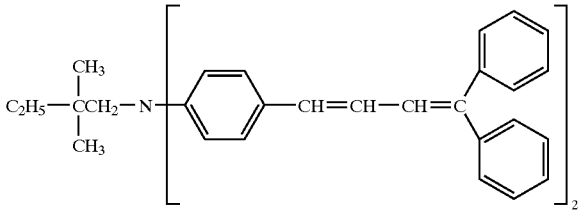
(40)
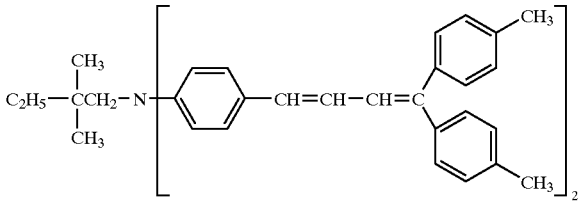
(41)
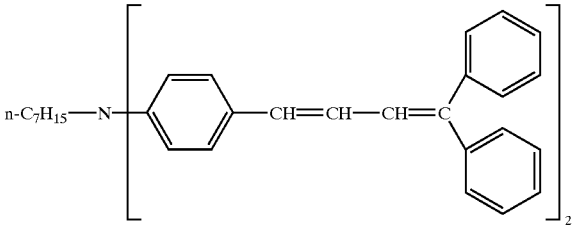
(42)
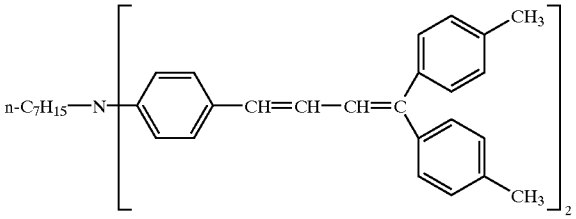

-continued
(43)
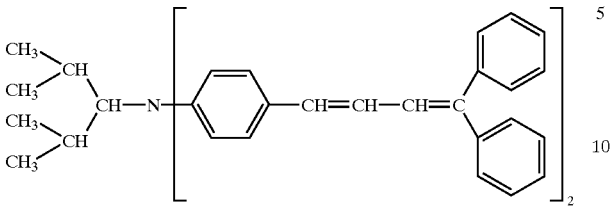
(44)
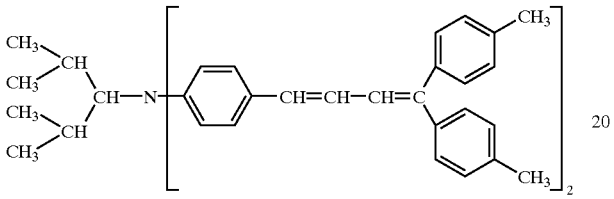
(45)
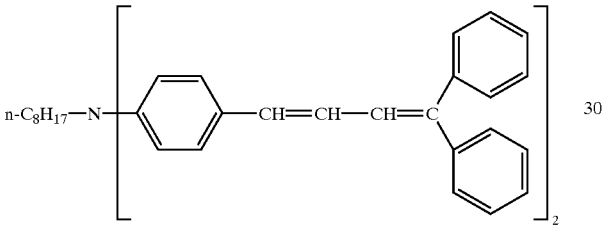
(46)
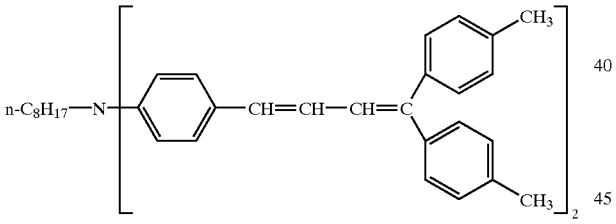
(47)
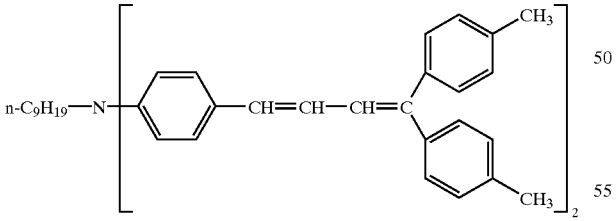
(48)
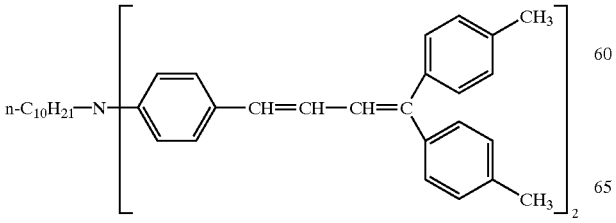
-continued
(49)
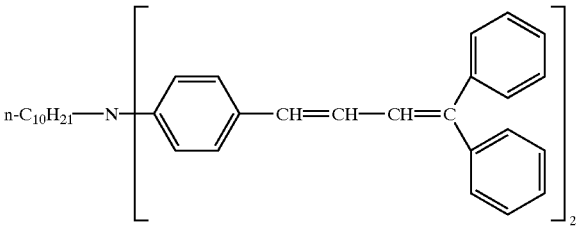
(50)
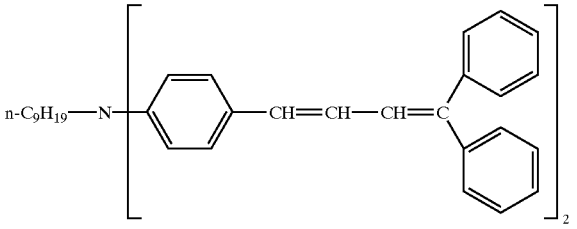
(51)
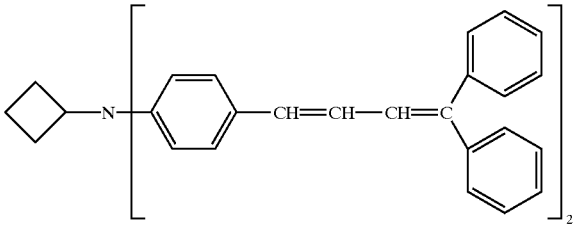
(52)
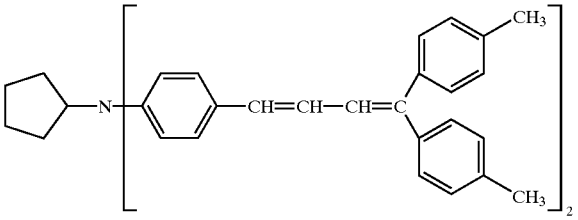
(53)
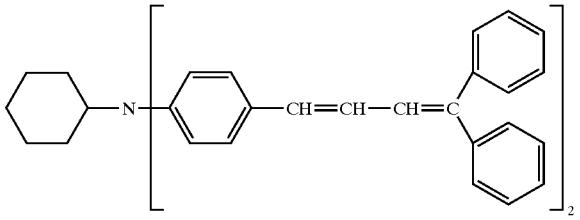
(54)
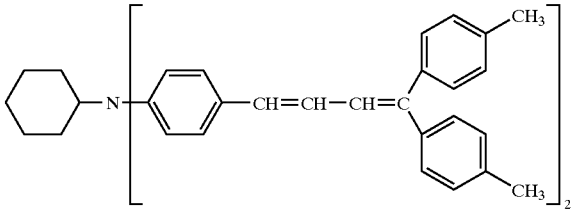

-continued
(55)
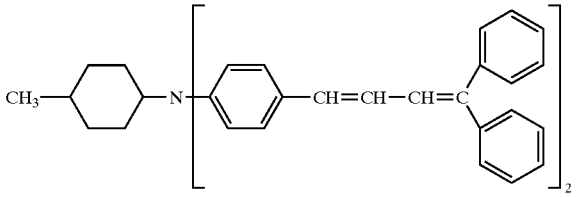
(56)
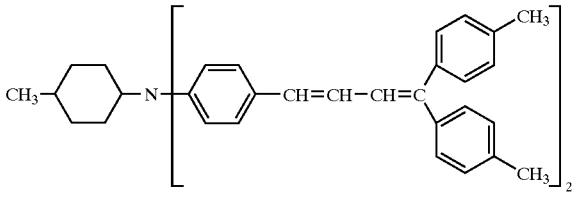
(57)
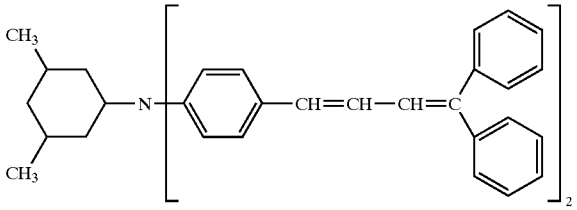
(58)
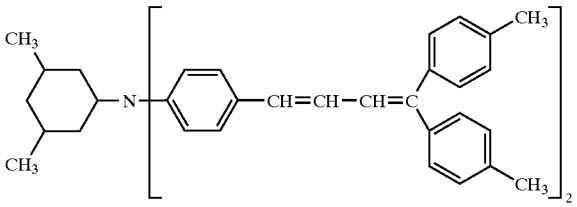
(59)
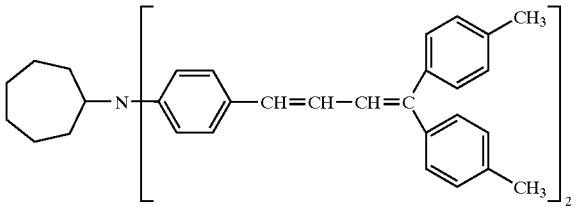
(60)
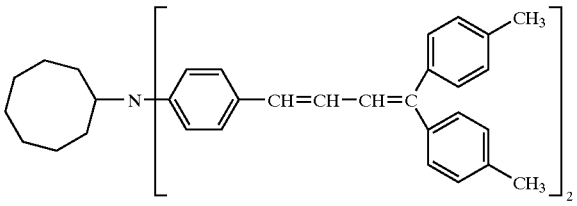
-continued
(61)
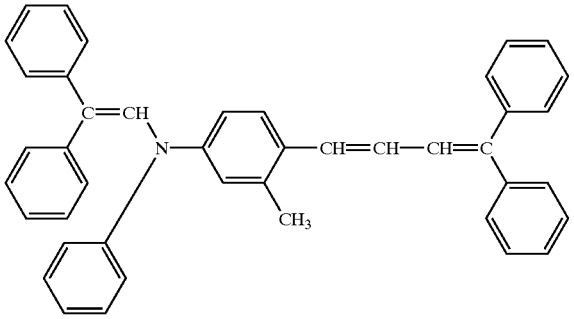
(62)
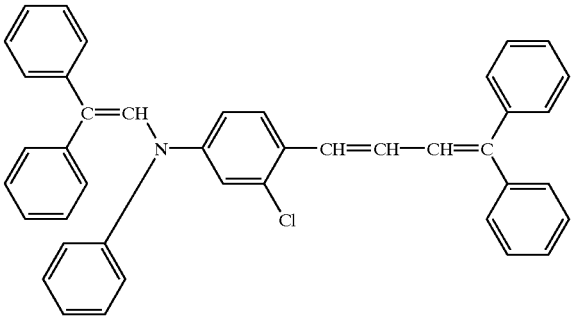
(63)
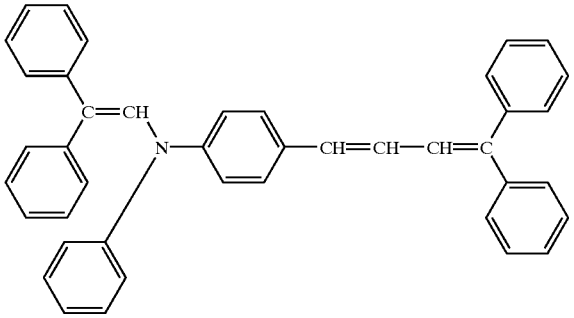
(64)
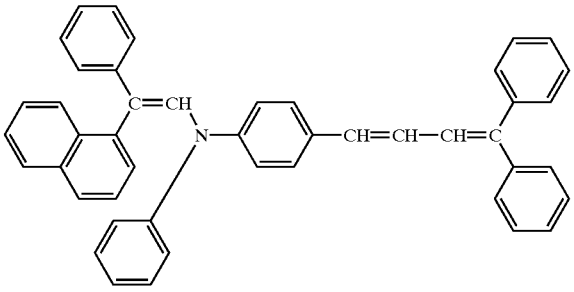

-continued
(65)
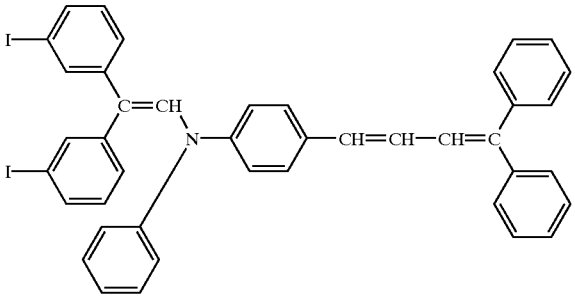
(66)
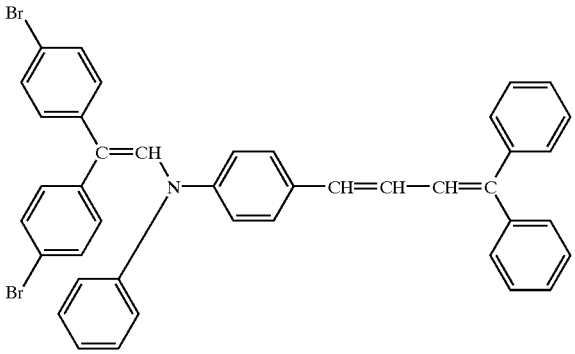
(67)
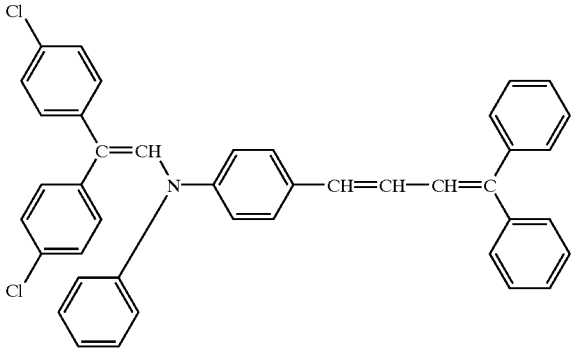
(68)
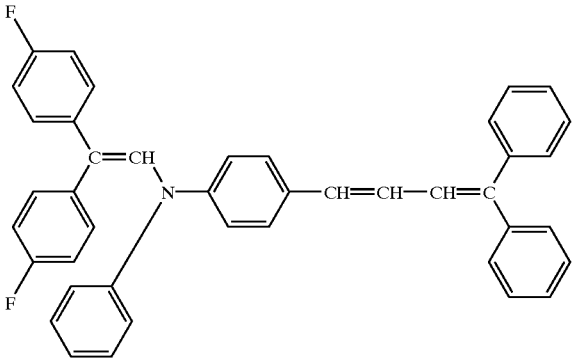
-continued
(69)
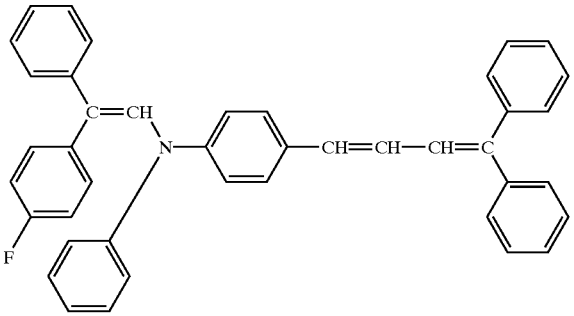
(70)
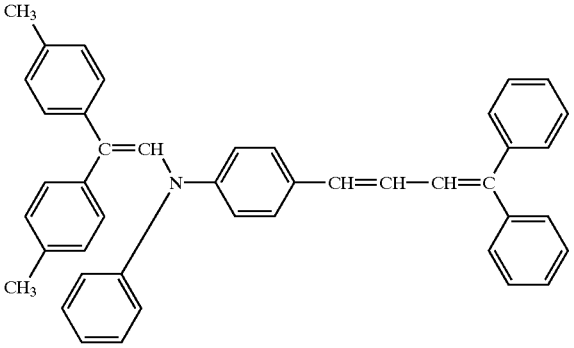
(71)
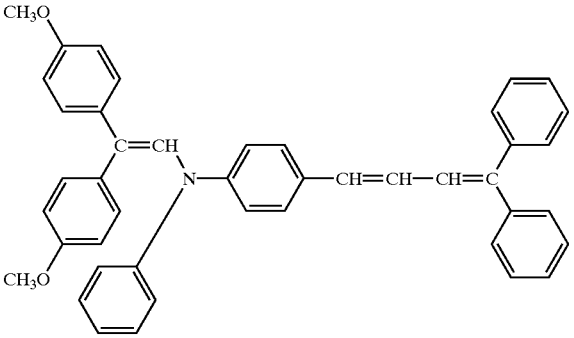
(72)
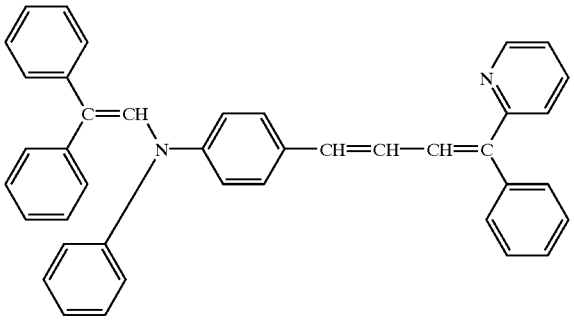

-continued
(73)
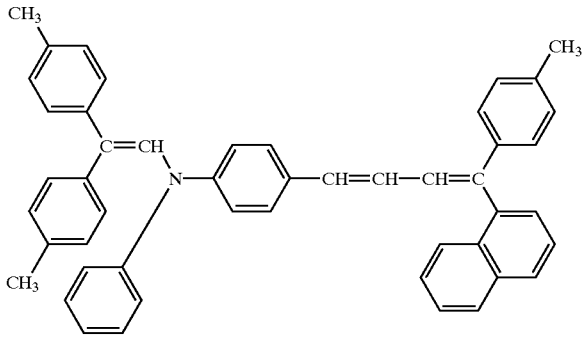
(74)
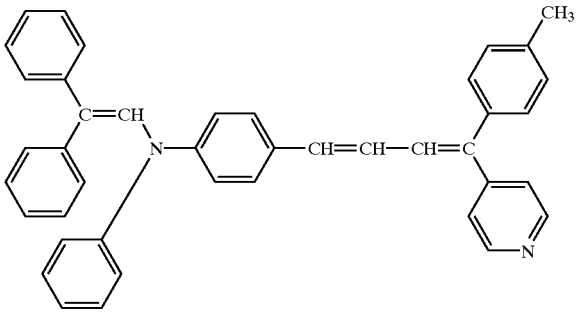
(75)
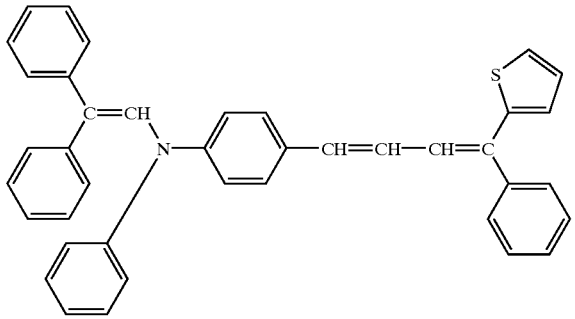
(76)
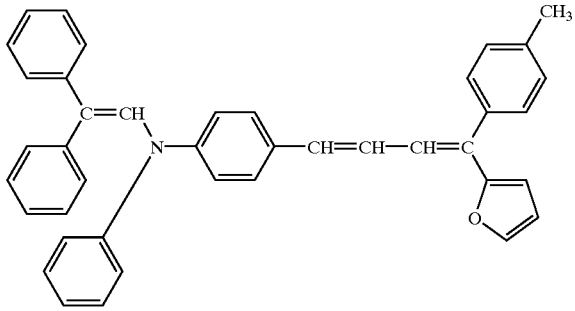
-continued
(77)
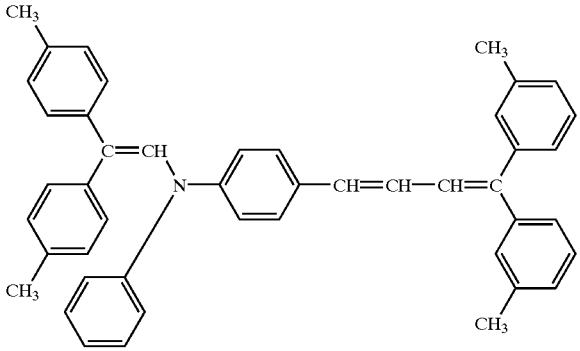
(78)
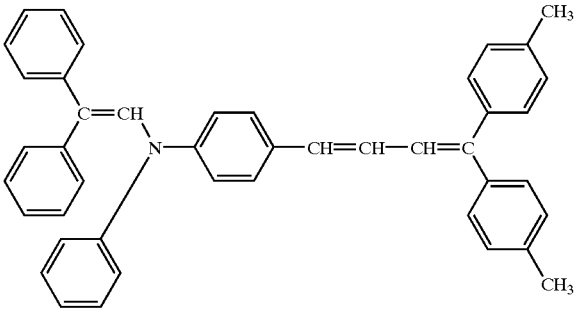
(79)
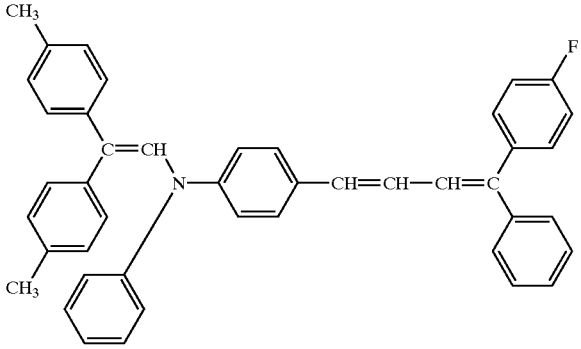
(80)
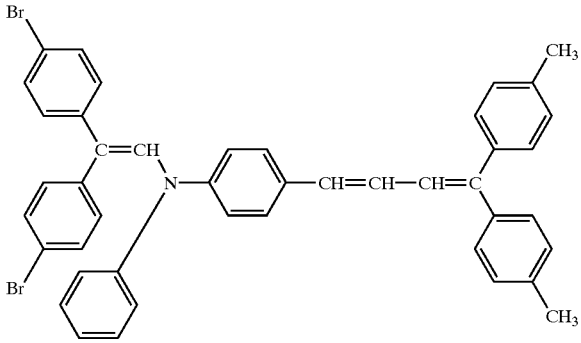

-continued
(81)
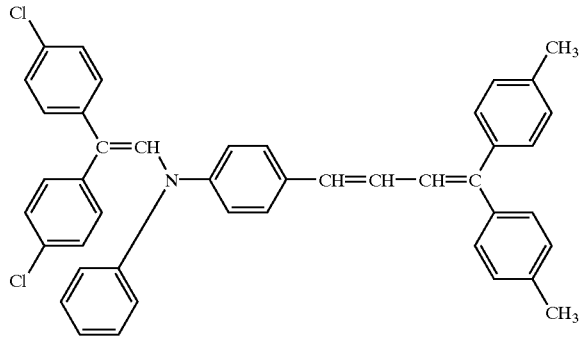
(82)
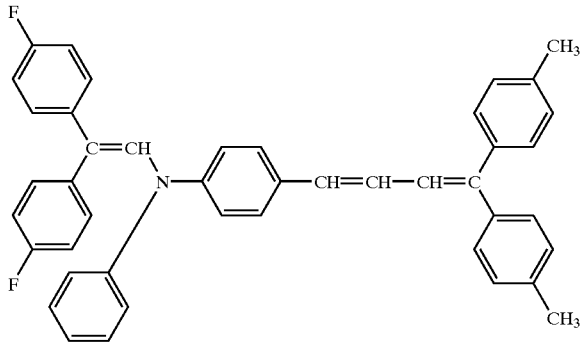
(83)
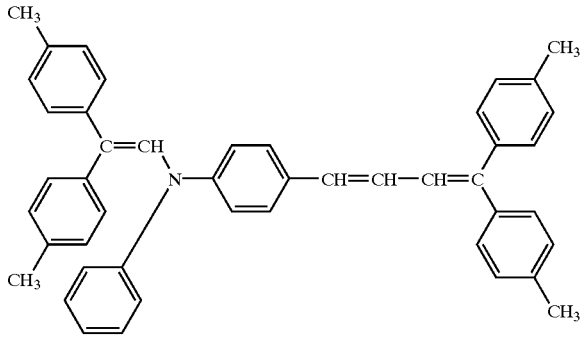
(84)
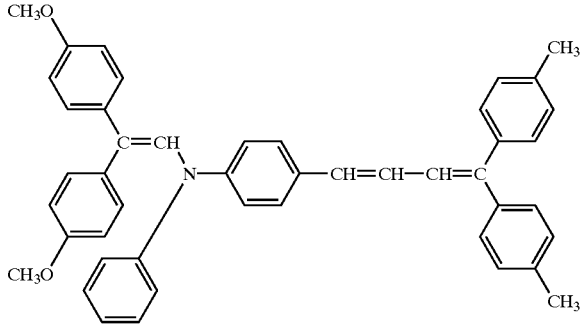
-continued
(85)
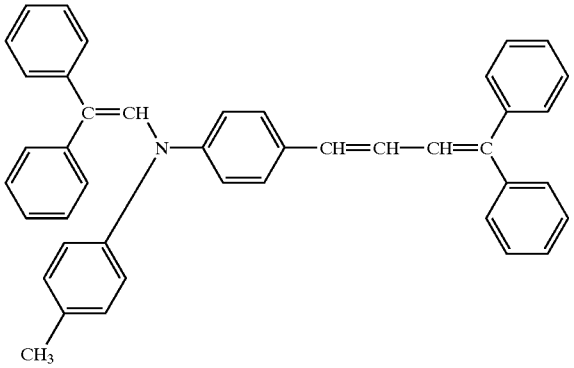
(86)
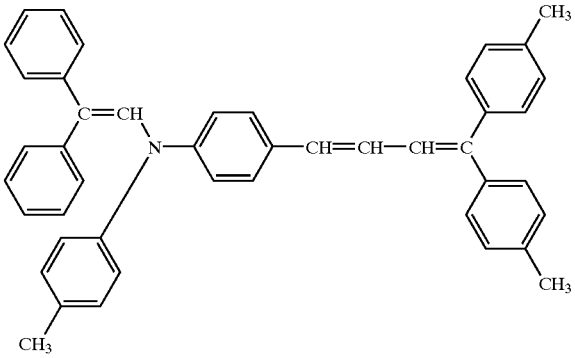
(87)
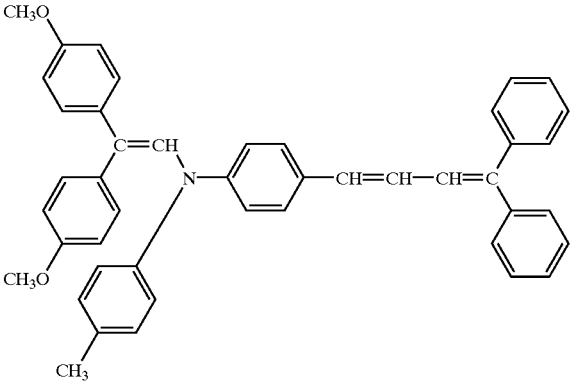
(88)
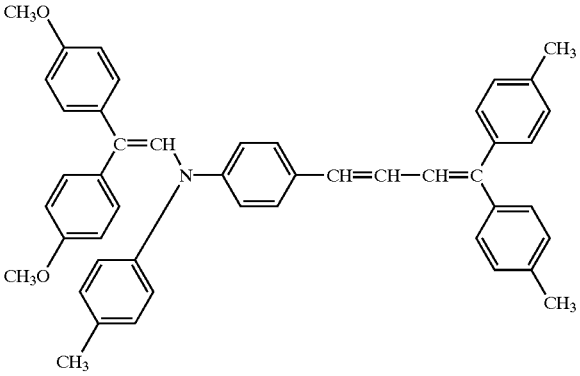

-continued
(89)
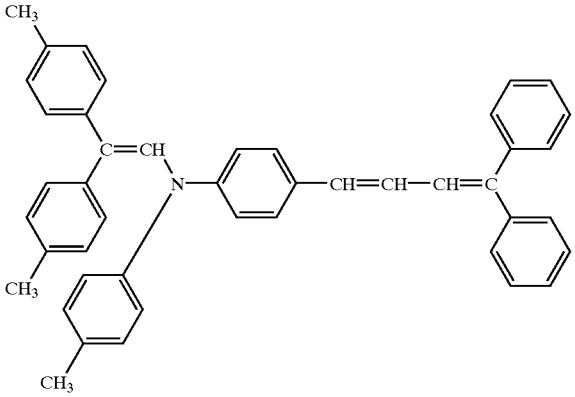
(90)
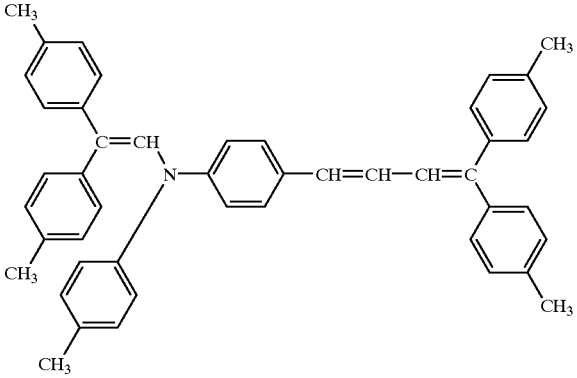
(91)
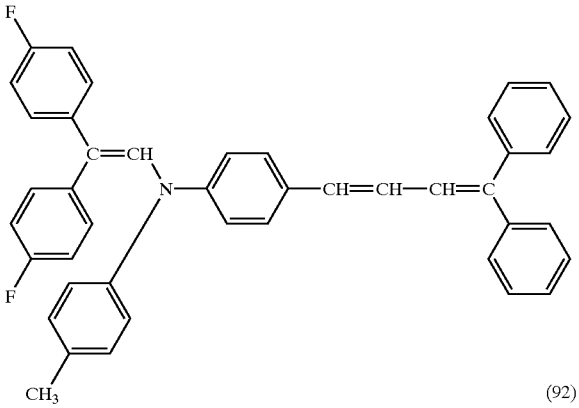
(92)
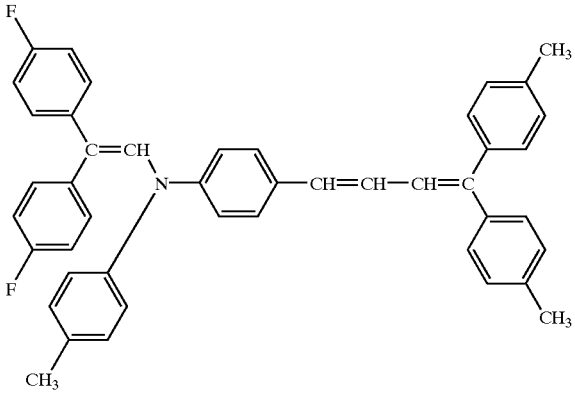
-continued
(93)
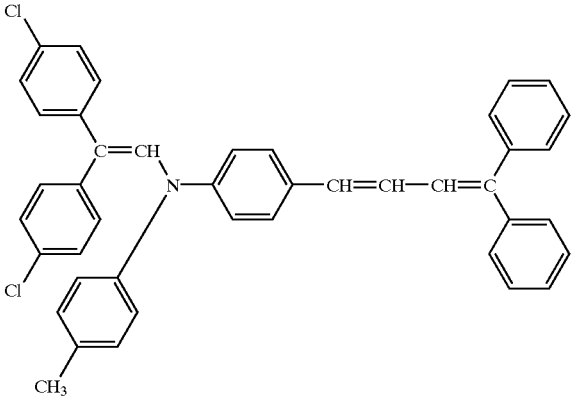
(94)
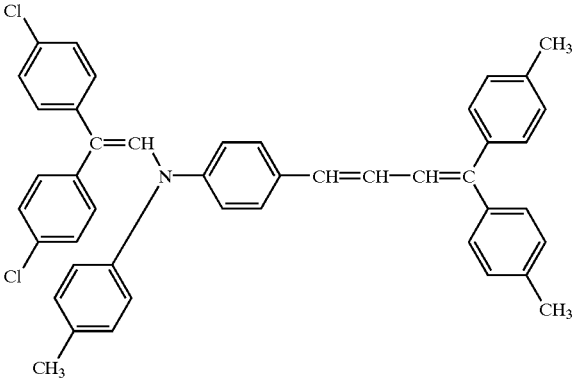
(95)
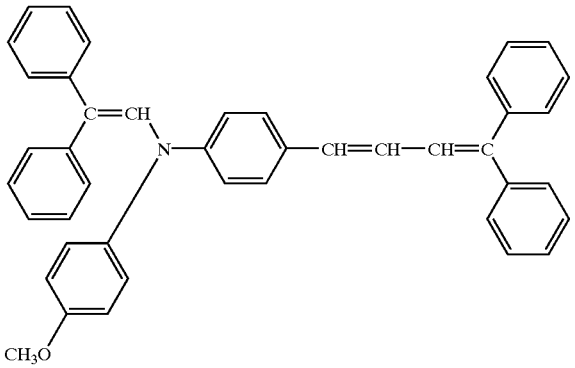
(96)
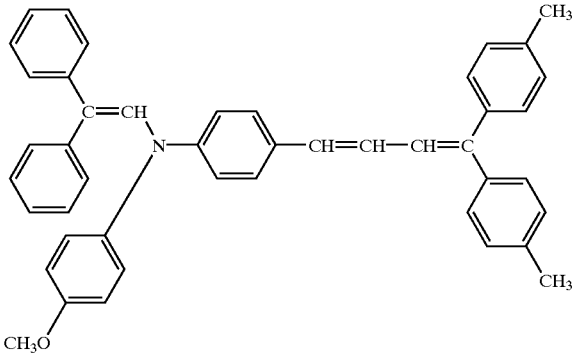

-continued
(97)
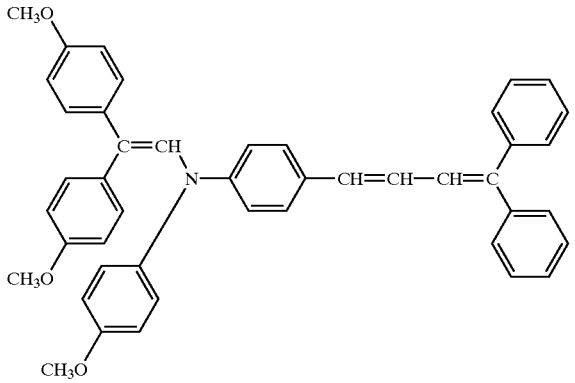
(98)
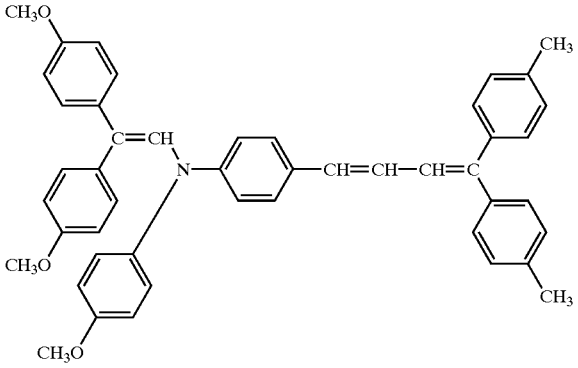
(99)
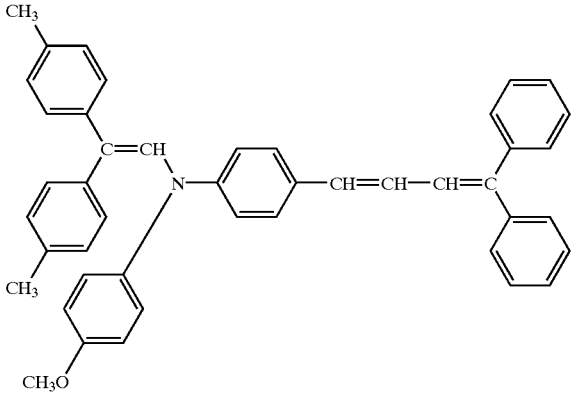
(100)
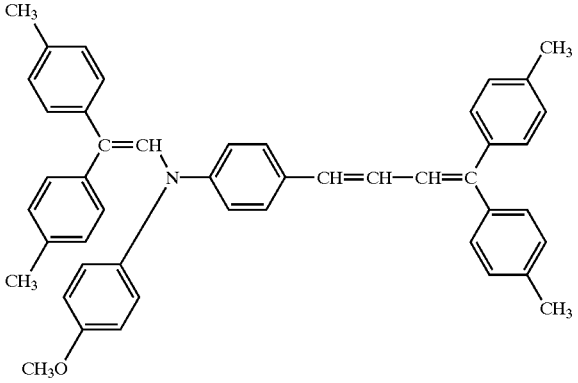
-continued
(101)
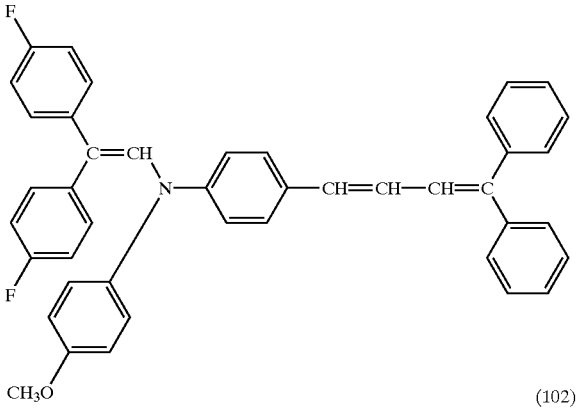
(102)
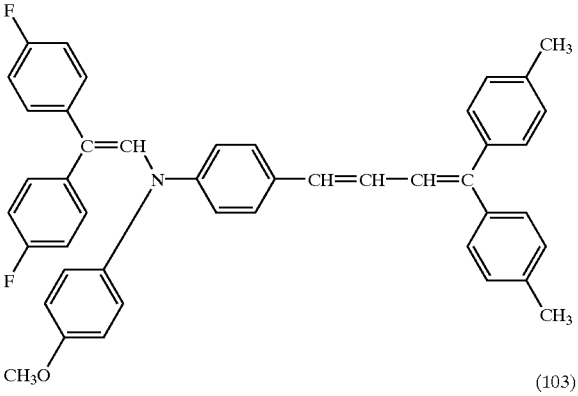
(103)
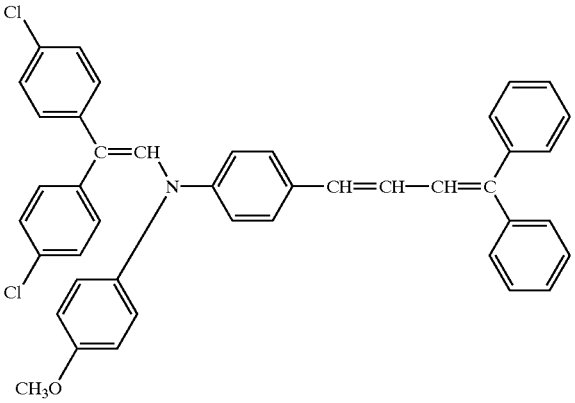
(104)
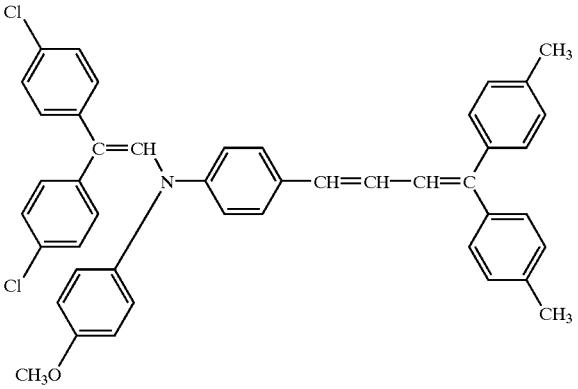

-continued
(105)
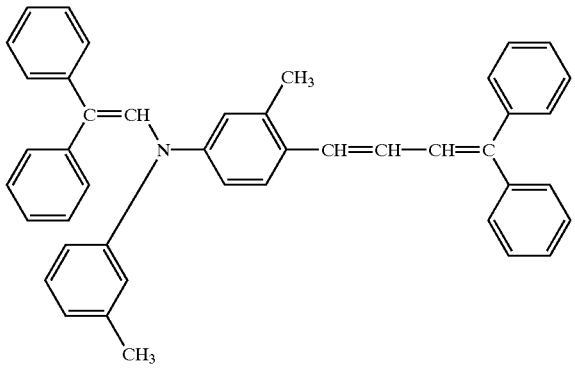
(106)
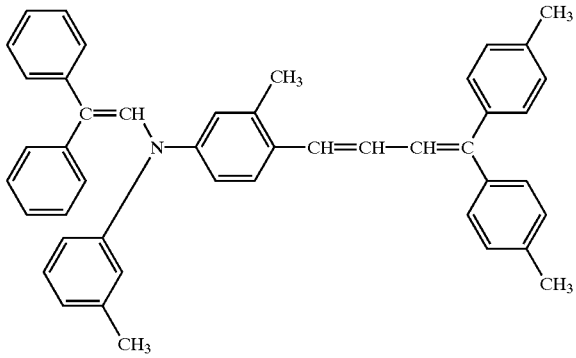
(107)
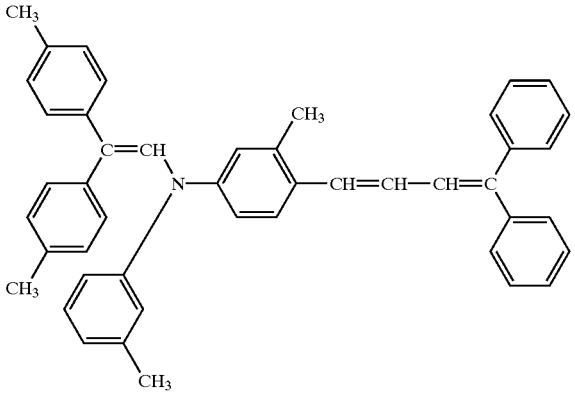
(108)
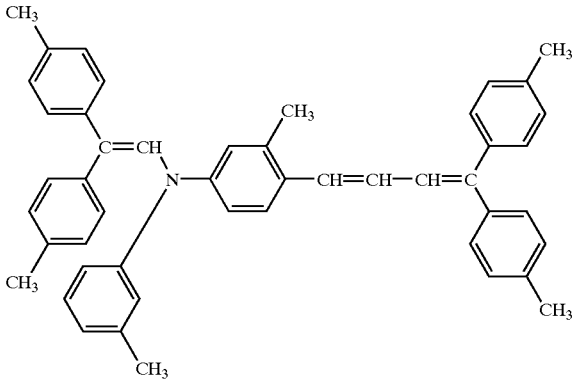
-continued
(109)
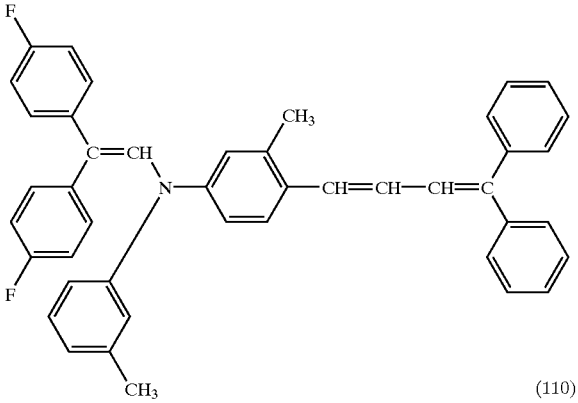
(110)
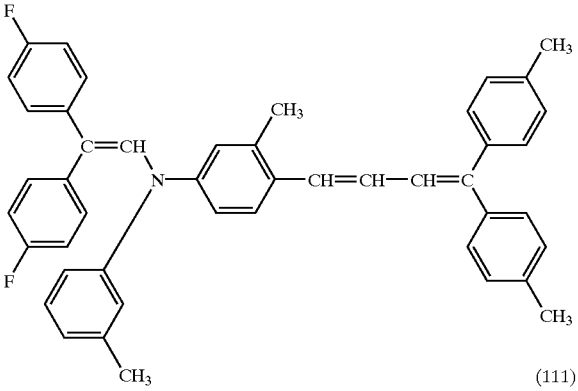
(111)
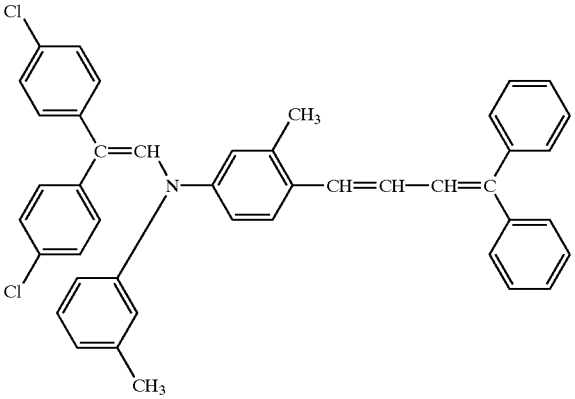
(112)
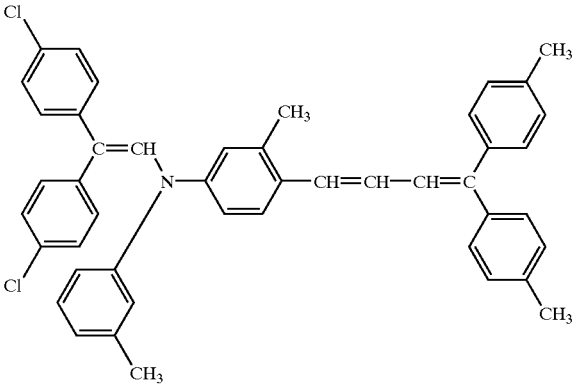

-continued (113)

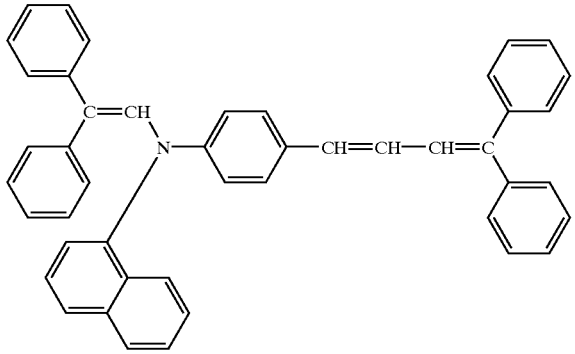

(114)

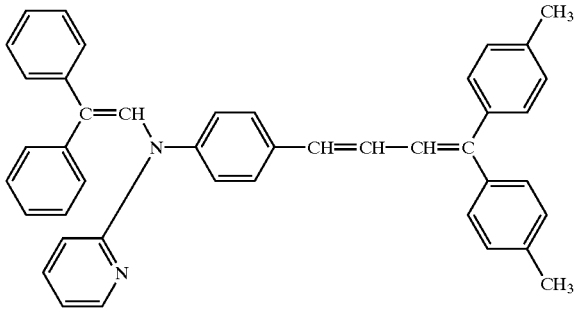

(115)

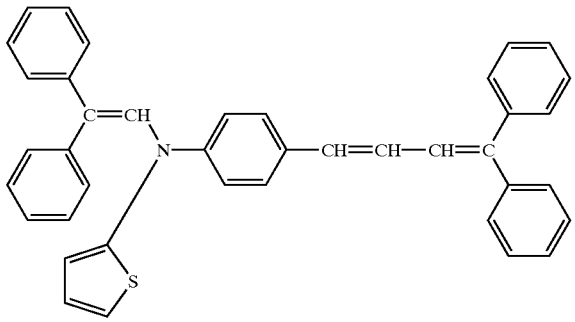

(116)

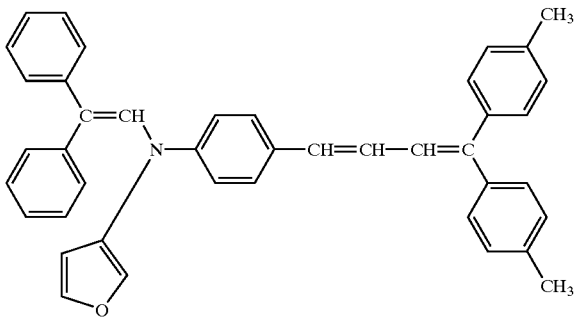

The electrophotographic photoreceptor of the present invention will be explained below.

The electrophotographic photoreceptor of the present invention comprises a photosensitive layer containing an organic photoconductive material of the above general formula (1) on an electrically conductive substrate.

The above photosensitive layer in the electrophotographic photoreceptor of the present invention is preferably a photosensitive layer that contains a charge-generating substance and a charge-transporting substance as components and contains, as the above charge-transporting substance, an organic photoconductive material of the above general formula (1) and which also contains at least one compound selected from hydroquinones, hindered phenols or tocopherols.

Specific examples of the above hydroquinones include hydroquinone, methylhydroquinone, 2,3-dimethylhydroquinone, 2,5-dimethylhydroquinone, trimethylhydroquinone, 2,5-diamylhydroquinone, tert-butylhydroquinone, 2,5-di-tert-butylhydroquinone, chlorohydroquinone, 2,5-dioctylhydroquinone, 2-tert-butyl-5-dimethylhydroquinone, methoxyhydroquinone, 2-methyl-5-chlorohydroquinone, 2-methyl-5-chlorohydroquinone, 1,4-naphthalenediol and 5,10-anthracenediol.

Specific examples of the hindered phenols include 3,5-di-tert-butyl-4-hydroxytoluene, 2,2-methylenebis(6-tert-butyl-4-methylphenol), 4,4-butylidenebis(6-tert-butyl-3-methylphenol), 4,4-thiobis(6-tert-butyl-3-methylphenol), 2,2-thiodiethylenebis[3-(3,5-di-tert-butyl-4-hydroxyphenyl) propionate], 1,6-hexanediolbis[3-(3,5-di-tert-butyl-4-hydroxyphenyl)propionate], pentaerythrityltetrakis[3-(3,5-di-tert-butyl-4-hydroxyphenyl)propionate] and 3,5-di-tert-butyl-4-hydroxyanisol. Further, as commercially available products, Sumilizer BHT, Sumilizer BBM-S, etc., sold by Sumitomo Chemical Industries K.K. are also included.

Specific examples of the tocopherols include α-tocopherol, β-tocopherol, γ-tocopherol and 67 -tocopherol. Further, various derivatives such as tocopherol acetate, tocopherol succinate and calcium salt of tocopherol succinate may be also used.

Further, two or more compounds of the above hydroquinones, hindered phenols and tocopherols may be used in combination for further producing remarkable effects.

The photosensitive layer in the present invention is preferably a photosensitive layer that contains a charge-generating substance, a charge-transporting substance and a binder and contains, as the above charge-transporting substance, an organic photoconductive material comprising a compound of the above general formula (1) and also contains, as the above binder, a polycarbonate copolymer having a structural unit of the general formula (2), (2)

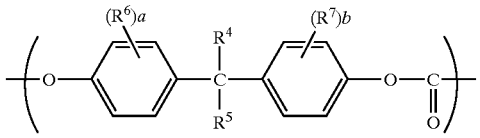

wherein each of $R^4$ and $R^5$ is a hydrogen atom, alkyl or aryl, each of $R^6$ and $R^7$ is a hydrogen atom, a halogen atom, alkyl or aryl, each of a and b is 1 or 2, and $R^4$ and $R^5$ may bond to each other and form a hydrocarbon ring having 5 to 8 carbon atoms, and a structural unit of the general formula (3), (3)

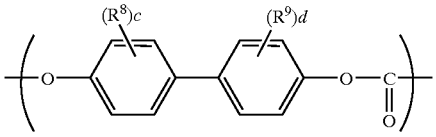

wherein each of $R^8$ and $R^9$ is a hydrogen atom, a halogen atom, alkyl or aryl and each of c and d is 1 or 2.

Specific examples of the alkyl and the aryl represented by $R^4$ and $R^5$ and the halogen atom, the alkyl and the aryl represented by $R^8$ and $R^7$ in the above general formula (2) include those examples given in the explanation of the above general formula (1). Further, when a plurality of $R^6$s are on a benzene ring, each of such $R^6$s may be the same as, or different from, other or every other one, and when a plurality of $R^7$ s are present, each of $R^7$s may be the same as, or different from, other or every other one.

In the above general formula (3), specific examples of the halogen atom, the alkyl and the aryl represented by $R^8$ and $R^9$ include those examples given in the explanation of the above general formula (1). Further, when a plurality of $R^8$s are on a benzene ring, each of such $R^8$s may be the same as, or different from, other or every other one, and when a plurality of $R^9$s are present, each of $R^9$s may be the same as, or different from, other or every other one.

Specific examples of the structural unit of the above general formula (2) include the following structures, while the structural unit shall not be limited thereto.

(M1-1)

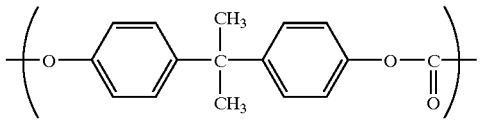

(M1-2)

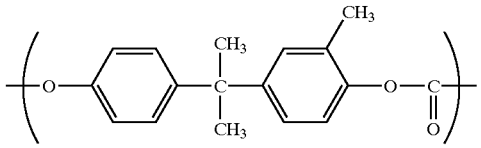

(M1-3)

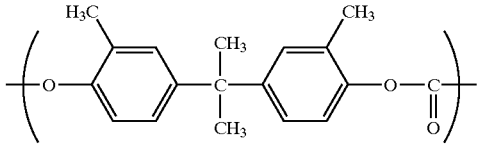

(M1-4)

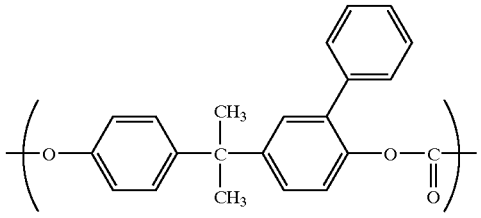

-continued (M1-5)

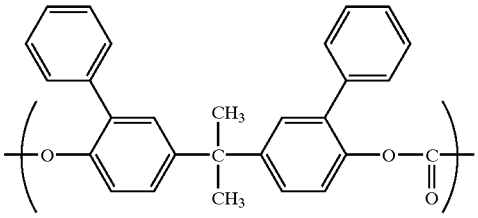

(M1-6)

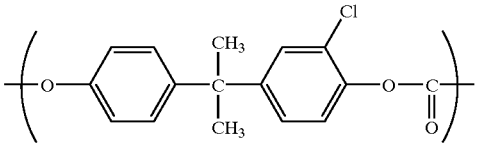

(M1-7)

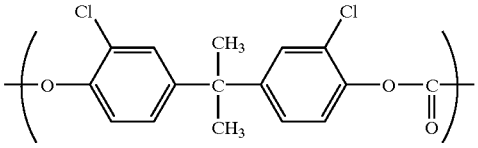

(M1-8)

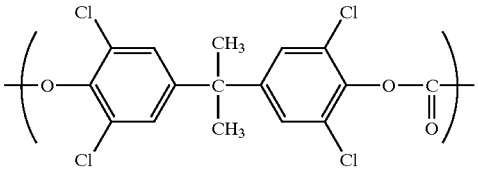

(M1-9)

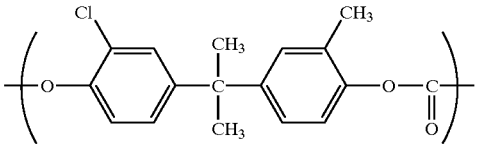

(M1-10)

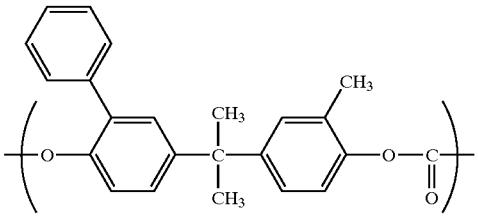

(M1-11)

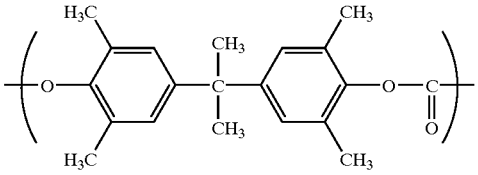

(M1-12)

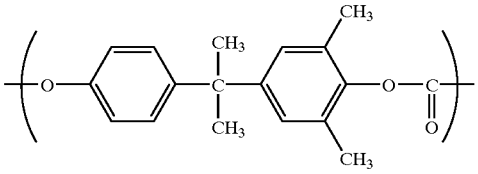

-continued
(M1-13)
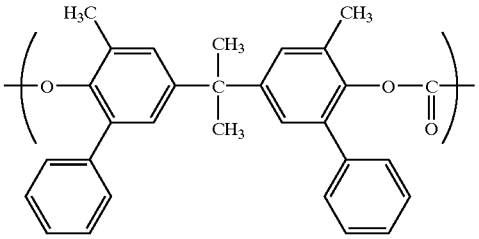
(M1-14)
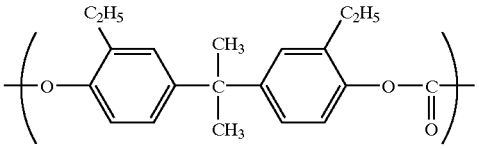
(M1-15)
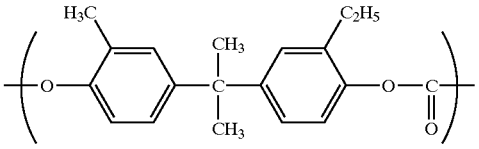
(M1-16)
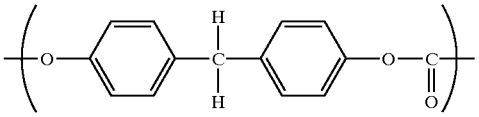
(M1-17)
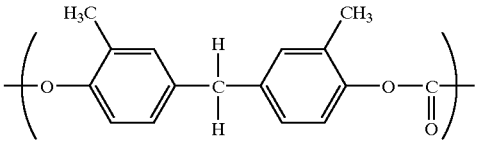
(M1-18)
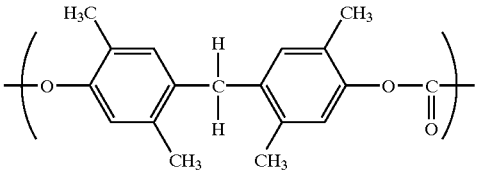
(M1-19)
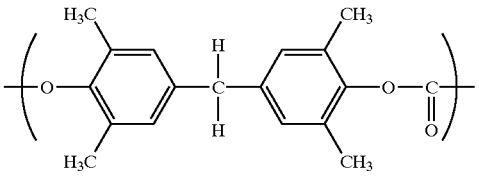
(M1-20)
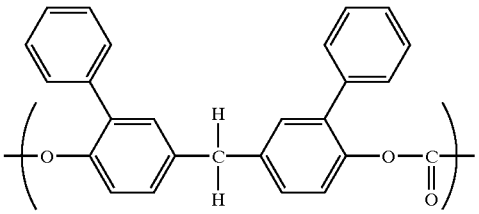
-continued
(M1-21)
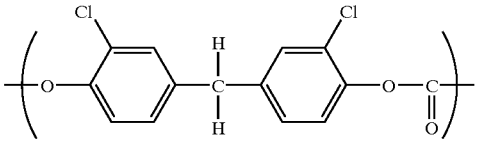
(M1-22)
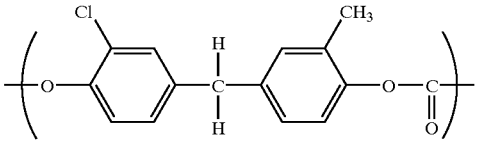
(M1-23)
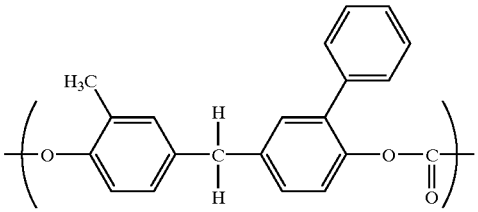
(M1-24)
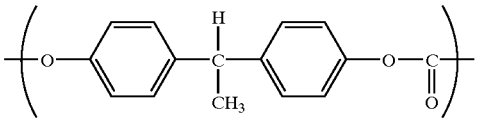
(M1-25)
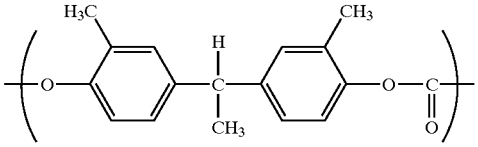
(M1-26)
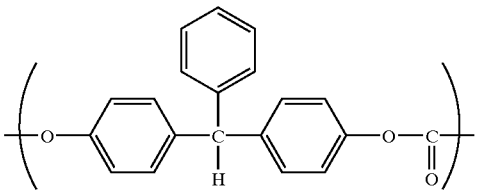
(M1-27)
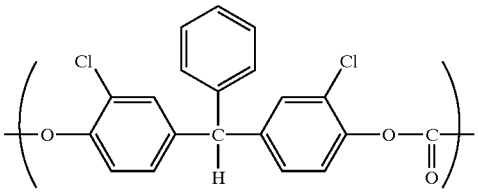
(M1-28)
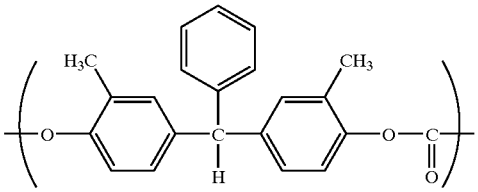

-continued (M1-29)

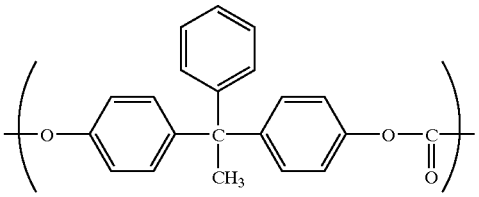

(M1-30)

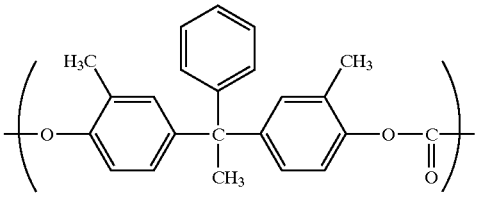

(M1-31)

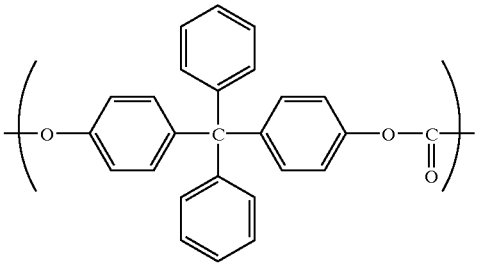

Specific examples of the structural unit of the above general formula (3) include the following structures, while the structural unit shall not be limited thereto.

(M2-1)

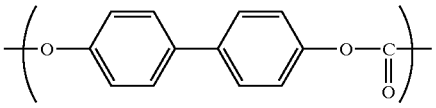

(M2-2)

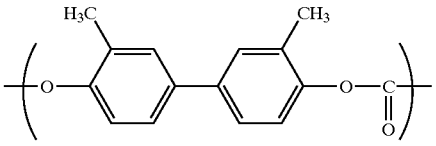

(M2-3)

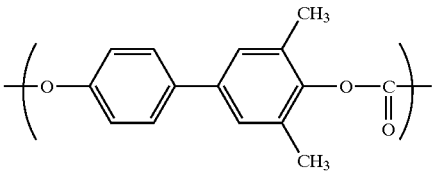

(M2-4)

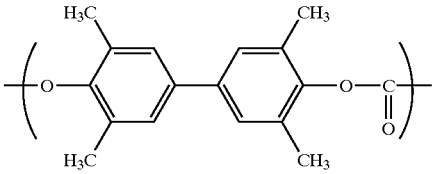

-continued (M2-5)

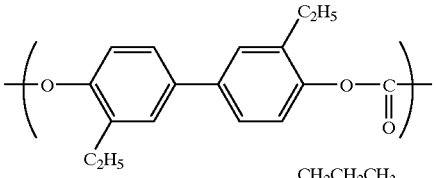

(M2-6)

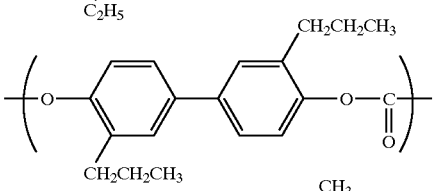

(M2-7)

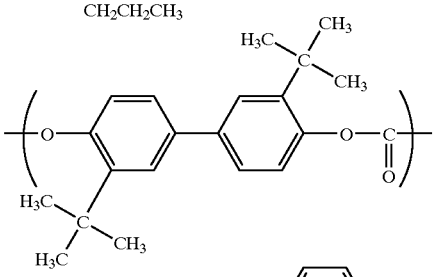

(M2-8)

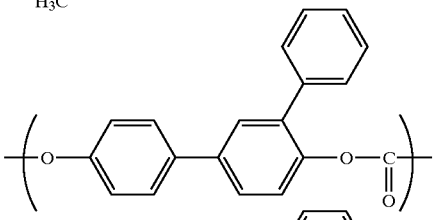

(M2-9)

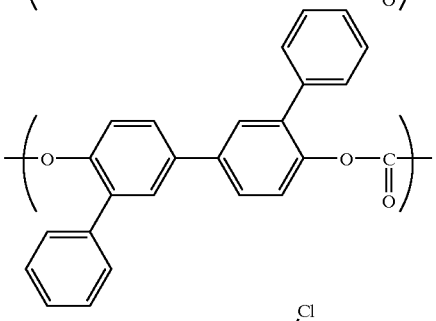

(M2-10)

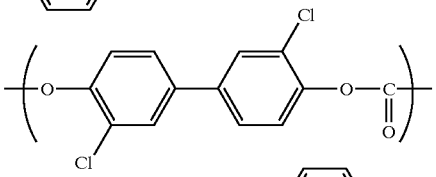

(M2-11)

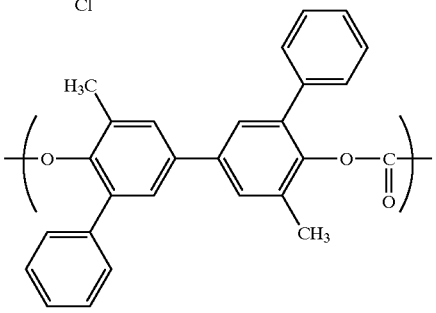

Specific examples of the copolymer containing the structural units of the above general formulas (2) and (3) are shown as binder examples in the following Tables 1 and 2, while the above copolymer shall not be limited thereto. In Tables 1 and 2, "Structural Unit M1" shows specific examples of structural units of the general formula (2), and "Structural Unit M2" shows specific examples of structural units of the general formula (3). "M1/M2" shows a molar ratio of the structural unit M1 and the structural unit M2 contained in a binder example. The structural unit M1/structural unit M2 molar ratio (M1/M2) is preferably in the range of from 99/1 to 40/60, more preferably in the range of from 95/5 to 60/40. Further, the molecular weight of the copolymer is preferably in the range of from 5,000 to 200,000 as a weight average molecular weight, more preferably in the range of from 10,000 to 100,000 as a weight average molecular weight. Each of binder examples shown below may be a block copolymer or a random copolymer partly containing a block copolymer portion.

TABLE 1

| Binder example | Structural unit M1 | Structural Unit M2 | M1/M2 |
|---|---|---|---|
| CP-1 | M1-1 | M2-1 | 90/10 |
| CP-2 | M1-1 | M2-1 | 85/15 |
| CP-3 | M1-1 | M2-1 | 80/20 |
| CP-4 | M1-1 | M2-1 | 60/40 |
| CP-5 | M1-1 | M2-2 | 85/15 |
| CP-6 | M1-1 | M2-4 | 90/10 |
| CP-7 | M1-1 | M2-4 | 70/30 |
| CP-8 | M1-1 | M2-7 | 85/15 |
| CP-9 | M1-1 | M2-10 | 80/20 |
| CP-10 | M1-3 | M2-4 | 80/20 |
| CP-11 | M1-3 | M2-9 | 85/15 |
| CP-12 | M1-5 | M2-1 | 90/10 |
| CP-13 | M1-5 | M2-7 | 60/40 |
| CP-14 | M1-7 | M2-1 | 60/40 |
| CP-15 | M1-7 | M2-5 | 80/20 |
| CP-16 | M1-7 | M2-7 | 85/15 |
| CP-17 | M1-7 | M2-9 | 70/30 |
| CP-18 | M1-8 | M2-1 | 90/10 |
| CP-19 | M1-8 | M2-9 | 80/20 |
| CP-20 | M1-8 | M2-11 | 85/15 |
| CP-21 | M1-11 | M2-1 | 70/30 |
| CP-22 | M1-11 | M2-1 | 60/40 |
| CP-23 | M1-11 | M2-4 | 85/15 |
| CP-24 | M1-11 | M2-10 | 60/40 |
| CP-25 | M1-12 | M2-1 | 70/30 |
| CP-26 | M1-13 | M2-5 | 80/20 |

TABLE 2

| Binder example | Structural unit M1 | Structural Unit M2 | M1/M2 |
|---|---|---|---|
| CP-27 | M1-14 | M2-1 | 80/20 |
| CP-28 | M1-14 | M2-3 | 70/30 |
| CP-29 | M1-14 | M2-7 | 75/25 |
| CP-30 | M1-15 | M2-1 | 90/10 |
| CP-31 | M1-15 | M2-1 | 60/40 |
| CP-32 | M1-15 | M2-6 | 90/10 |
| CP-33 | M1-16 | M2-1 | 80/20 |
| CP-34 | M1-16 | M2-4 | 70/30 |
| CP-35 | M1-16 | M2-7 | 60/40 |
| CP-36 | M1-18 | M2-1 | 75/25 |
| CP-37 | M1-18 | M2-9 | 85/15 |
| CP-38 | M1-19 | M2-4 | 80/20 |
| CP-39 | M1-19 | M2-6 | 75/25 |
| CP-40 | M1-21 | M2-2 | 90/10 |
| CP-41 | M1-21 | M2-4 | 70/30 |
| CP-42 | M1-25 | M2-7 | 80/20 |
| CP-43 | M1-25 | M2-11 | 90/10 |
| CP-44 | M1-26 | M2-1 | 90/10 |
| CP-45 | M1-26 | M2-1 | 80/20 |
| CP-46 | M1-26 | M2-1 | 50/50 |
| CP-47 | M1-26 | M2-4 | 85/15 |
| CP-48 | M1-26 | M2-10 | 90/10 |
| CP-49 | M1-29 | M2-1 | 85/15 |

TABLE 2-continued

| Binder example | Structural unit M1 | Structural Unit M2 | M1/M2 |
|---|---|---|---|
| CP-50 | M1-29 | M2-4 | 70/30 |
| CP-51 | M1-29 | M2-5 | 60/40 |
| CP-52 | M1-30 | M2-1 | 85/15 |

The above photosensitive layer preferably includes a photosensitive layer that contains a charge-generating substance, a charge-transporting substance and a binder as components and contains, as the above charge-transporting substance, an organic photoconductive material comprising a compound of the general formula (1) and also contains, as the above binder, a polycarbonate copolymer having a structural unit of the general formula (4), (4)

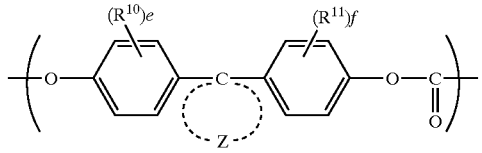

wherein each of $R^{10}$ and $R^{11}$ is a hydrogen atom, a halogen atom or alkyl, Z is a divalent organic group forming a hydrocarbon ring or a heterocycle by bonding to a carbon atom, and each of e and f is an integer of 1 to 4.

In the above general formula (4), specific examples of the halogen atom and alkyl represented by $R^{10}$ and $R^{11}$ includes those examples given in the explanation of the above general formula (1). Further, when a plurality of $R^{10}$s are on a benzene ring, each of such $R^{10}$s may be the same as, or different from, other or every other one, and when a plurality of $R^{11}$s are present, each of $R^{11}$s may be the same as, or different from, other or every other one.

Specific examples of the structural unit of the above general formula (4) include the following structures, while the structural unit shall not be limited thereto.

(M3-1)

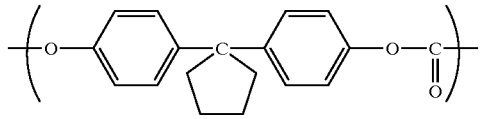

(M3-2)

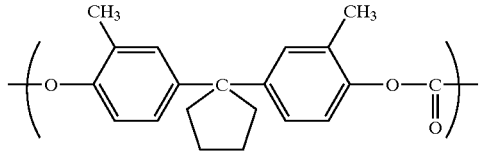

(M3-3)

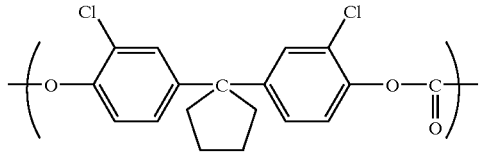

-continued (M3-4)

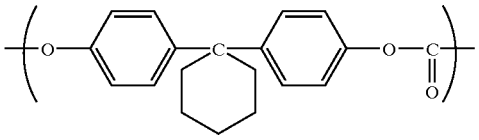

(M3-5)

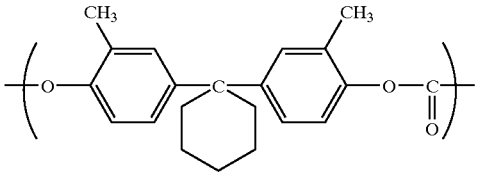

(M3-6)

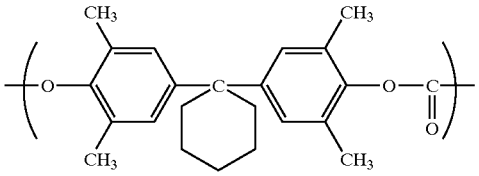

(M3-7)

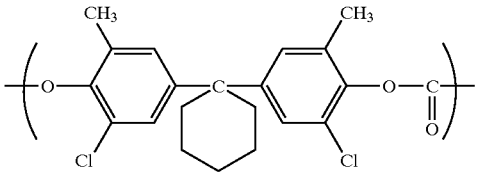

(M3-8)

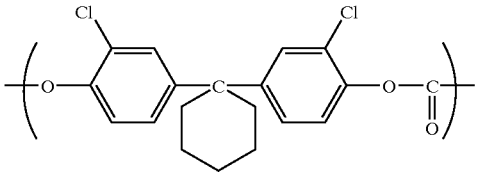

(M3-9)

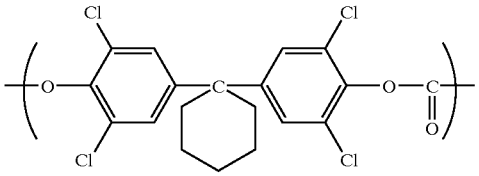

(M3-10)

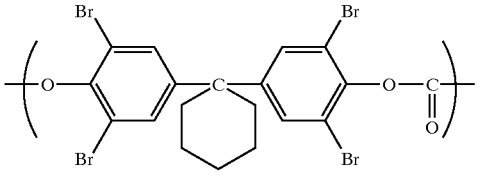

(M3-11)

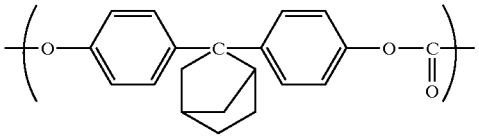

-continued (M3-12)

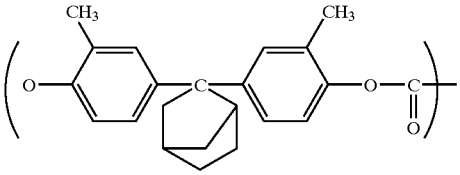

(M3-13)

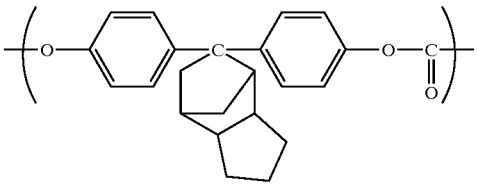

(M3-14)

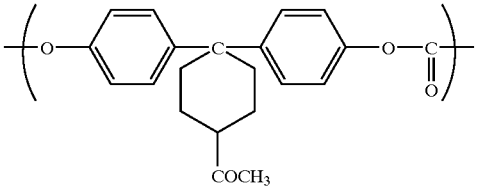

Specific examples of the polymer containing the structural unit of the above general formula (4) are shown as binder examples in the following Table 3, while the above polymer shall not be limited thereto. In Table 3, "Structural Unit M3" shows specific examples of structural units of the general formula (4) Further, the binder shall not be limited to a binder containing the structural unit of the above general formula (4) alone, and a binder containing such structural unit and other structural unit may be also used.

TABLE 3

| Binder example | Structural Unit M3 |
|---|---|
| CP-53 | M3-1 |
| CP-54 | M3-2 |
| CP-55 | M3-4 |
| CP-56 | M3-5 |
| CP-57 | M3-6 |
| CP-58 | M3-8 |
| CP-59 | M3-11 |
| CP-60 | M3-14 |

Further, the above photosensitive layer is preferably a photosensitive layer that contains a charge-generating substance and a charge-transporting substance as components and contains, as the above charge-transporting substance, an organic photoconductive material comprising a compound of the above general formula (1) and also contains at least one selected from compounds of the general formulae (5) to (8), (5)

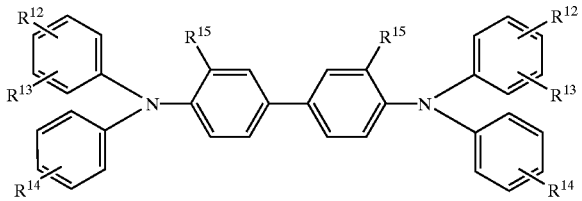

wherein $R^{12}$ is alkyl, alkoxyl, aralkyl, phenyl or a halogen atom, $R^{13}$ is a hydrogen atom, a halogen atom, alkyl, alkoxyl, aralkyl or phenyl, $R^{14}$ is a hydrogen atom, a halogen atom, alkyl, alkoxyl or aralkyl, and $R^{15}$ is a hydrogen atom, methyl or methoxy, (6)

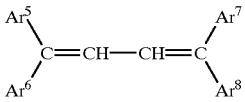

wherein each of $Ar^5$ to $Ar^8$ is phenyl, p-di-lower alkylaminophenyl, p-diphenylaminophenyl or p-dibenzylaminophenyl, provided that the number of amino-substituted phenyl group(s) is 1 or 2, (7)

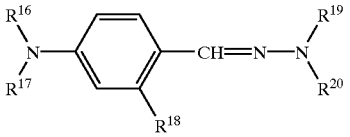

wherein each of $R^{16}$ and $R^{17}$ is lower alkyl, phenyl or benzyl, $R^{18}$ is a hydrogen atom, lower alkyl or alkoxyl, and each of $R^{19}$ and $R^{20}$ is lower alkyl, phenyl, benzyl or naphthyl, and

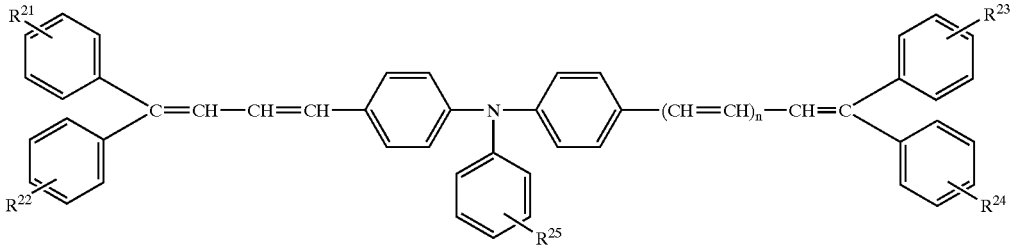

wherein each $R^{21}$ and $R^{25}$ is a hydrogen atom, a halogen atom, lower alkyl, alkoxyl or aryl, and n is 0 or 1.

In the above general formula (5), specific examples of the halogen atom, the alkyl and the alkoxyl represented by $R^{12}$, $R^{13}$ and $R^{14}$ and the halogen atom, the alkyl and the alkoxyl represented by $R^{14}$ include those examples given in the explanation of the above general formula (1). Specific examples of the aralkyl represented by $R^{12}$, $R^{13}$ and $R^{14}$ include benzyl and 2-ethylphenyl.

Specific examples of the compound of the above general formula (5) are shown below, while the compound shall not be limited thereto.

(5-1)

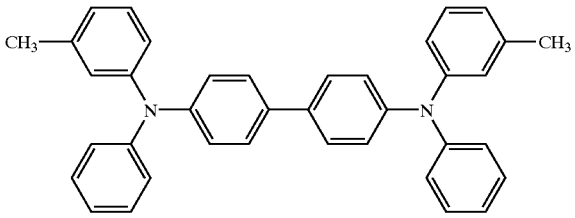

(5-2)

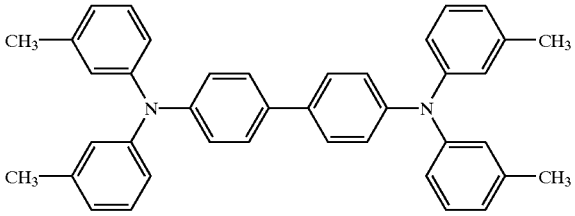

(5-3)

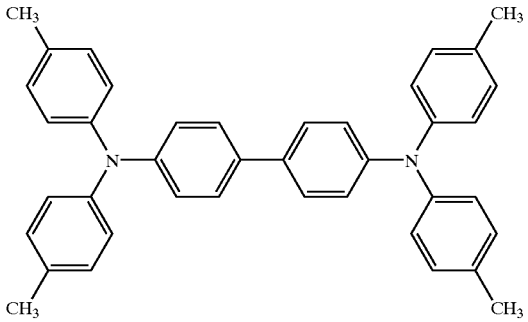

-continued (5-4)

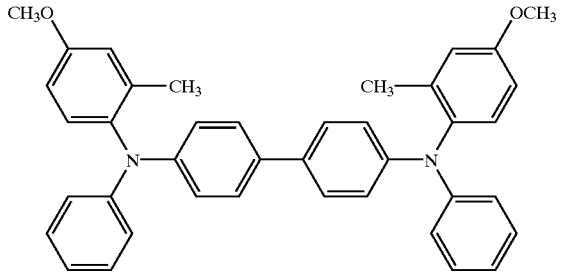

(5-5)

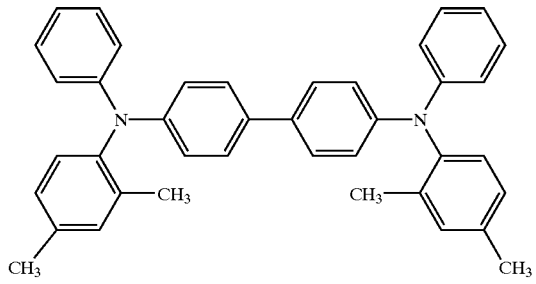

(5-6)

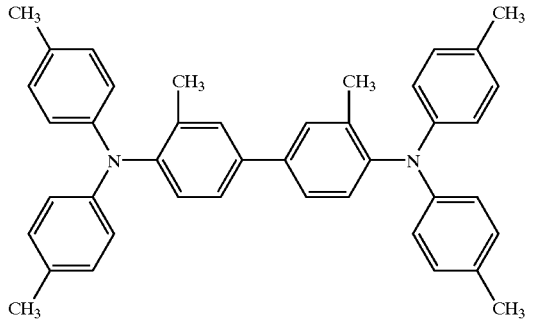

(5-7)

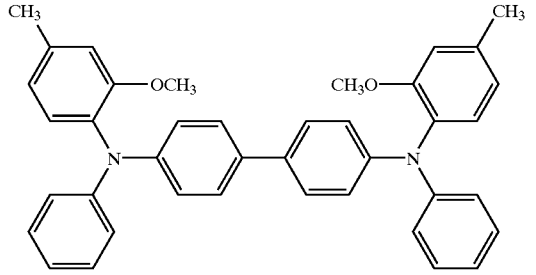

(5-8)

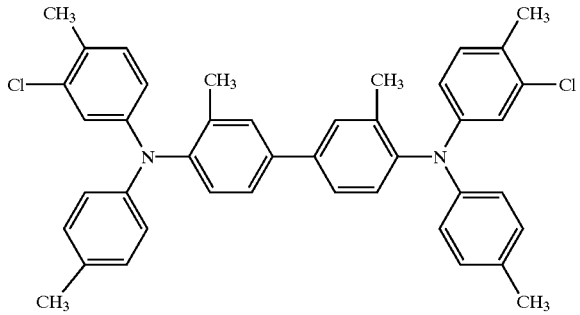

In the above general formula (6), specific examples of the lower alkyl in the p-di-lower alkylaminophenyl represented by $Ar^5$ to $Ar^8$ include linear or branched alkyls having 1 to 5 carbon atoms such as methyl, ethyl, propyl, and the like.

Specific examples of the compound of the above general formula (6) are shown below, while the compound shall not be limited thereto.

(6-1)

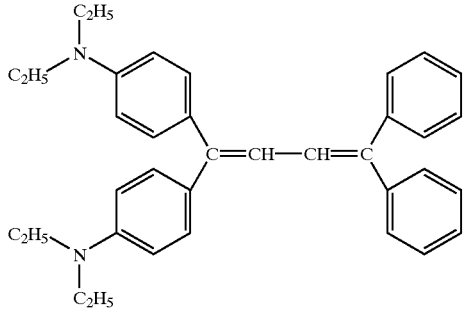

(6-2)

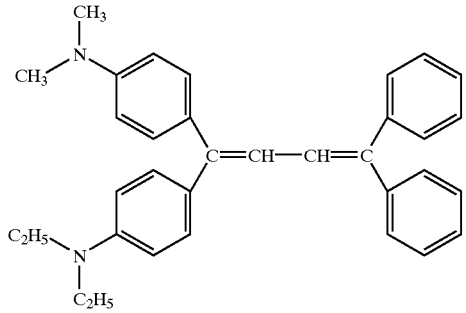

(6-3)

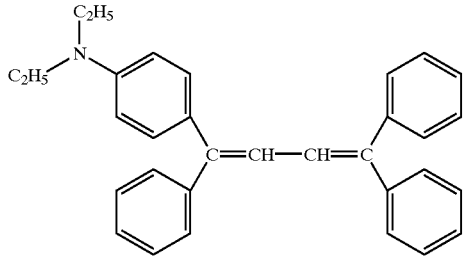

(6-4)

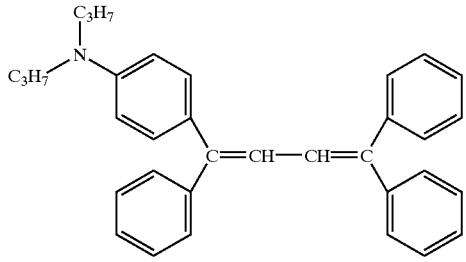

(6-5)

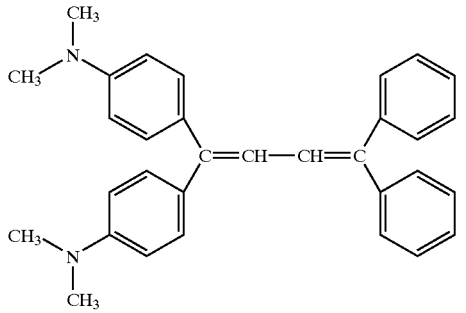

-continued (6-6)

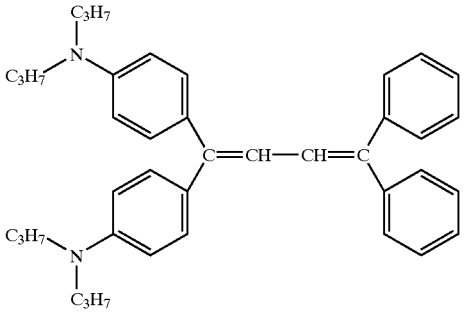

(6-7)

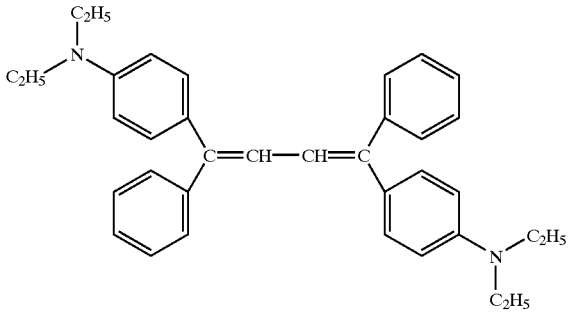

(6-8)

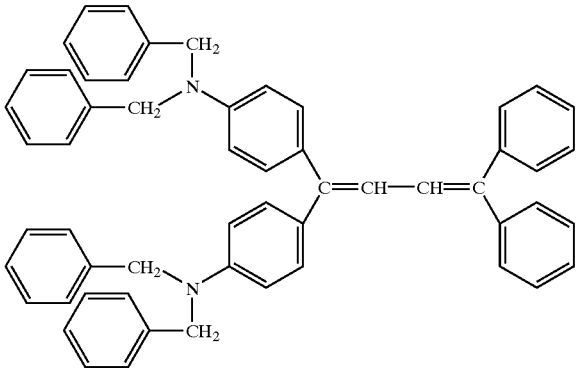

(6-9)

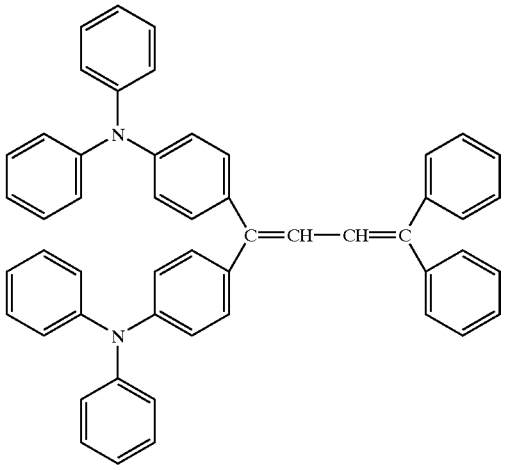

-continued (6-10)

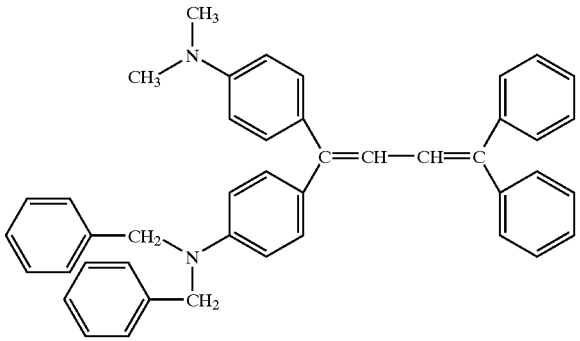

In the above general formula (7), specific examples of the lower alkyl represented by $R^{16}$, $R^{17}$, $R^{18}$, $R^{19}$ and $R^{20}$ include linear or branched alkyls having 1 to 5 carbon atoms such as methyl, ethyl, propyl and the like. Specific examples of the alkoxyl represented by R is include those examples given in the explanation of the above general formula (1).

Specific examples of the compound of the above general formula (7) are shown below, while the compound shall not be limited thereto.

(7-1)

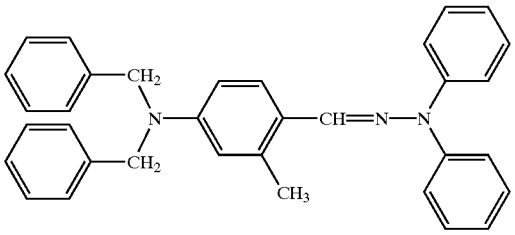

(7-2)

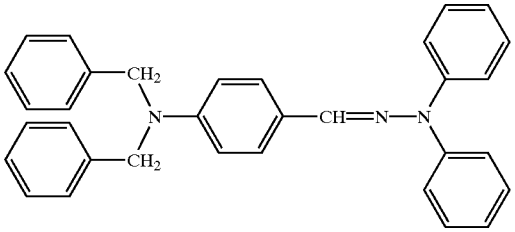

(7-3)

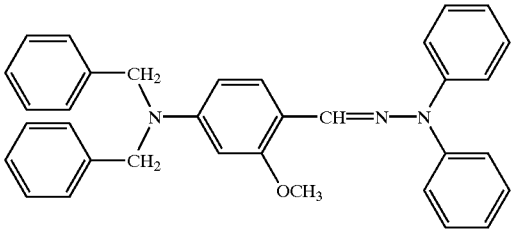

-continued (7-4)

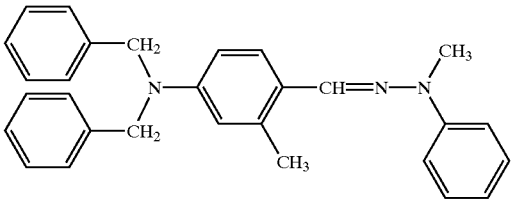

(7-5)

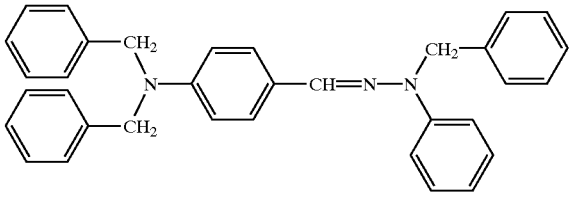

(7-6)

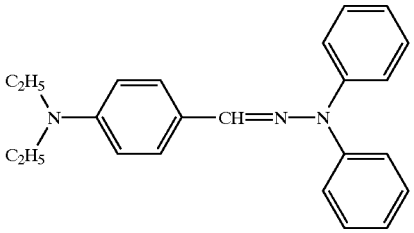

-continued (7-7)

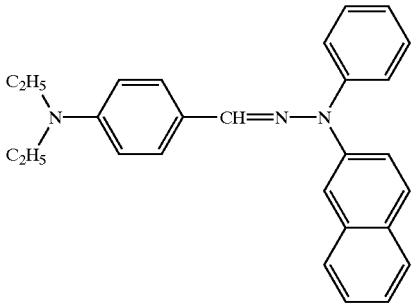

(7-8)

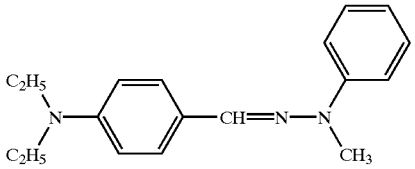

(7-9)

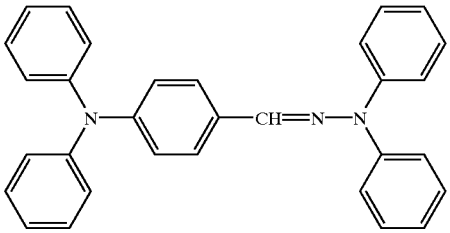

In the above general formula (8), specific examples of the halogen atom, the alkoxyl and the aryl represented by $R^{21}$ to $R^{25}$ include those examples given in the explanation of the above general formula (1), and specific examples of the lower alkyl represented by $R^{21}$ to $R^{21}$ include linear or branched alkyl groups having 1 to 5 carbon atoms such as methyl, ethyl, propyl and the like.

Specific examples of the compound of the above general formula (8) are shown below, while the compound shall not be limited thereto.

(8-1)

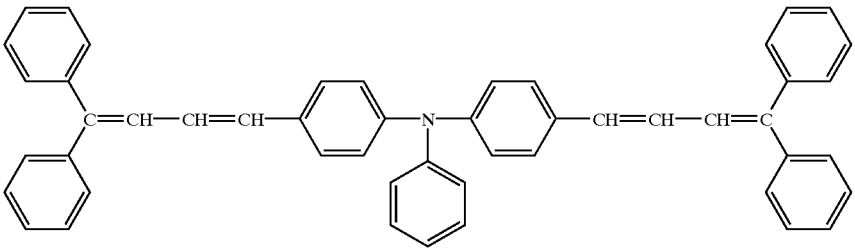

-continued
(8-2)
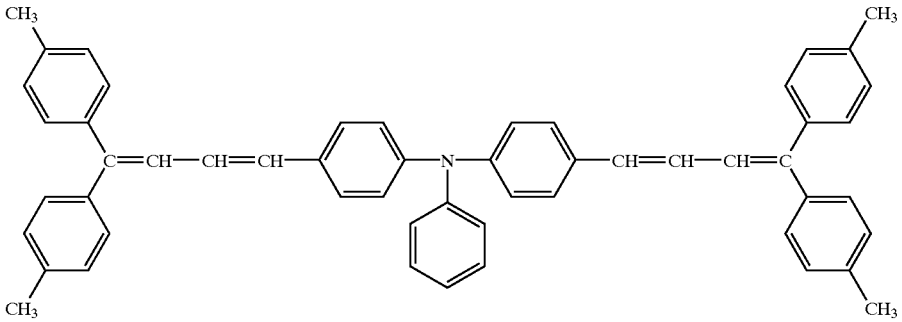
(8-3)
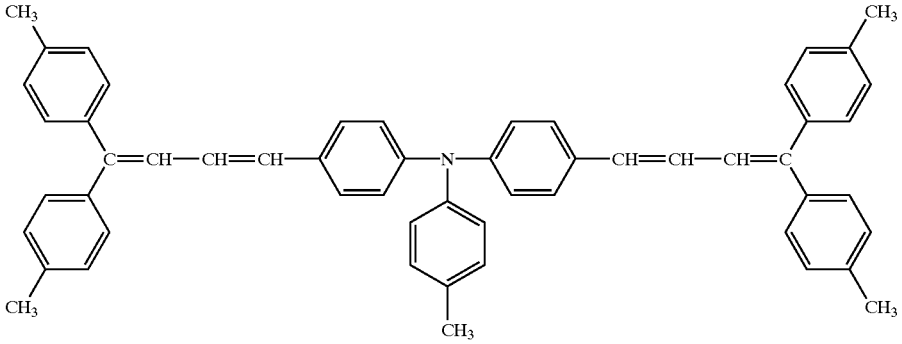
(8-4)
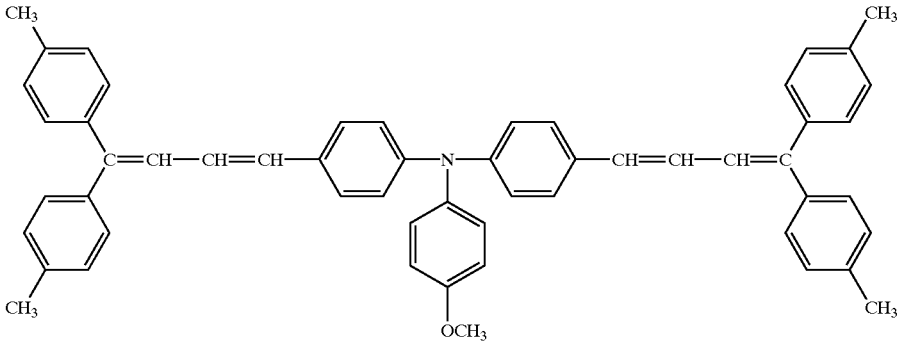
(8-5)
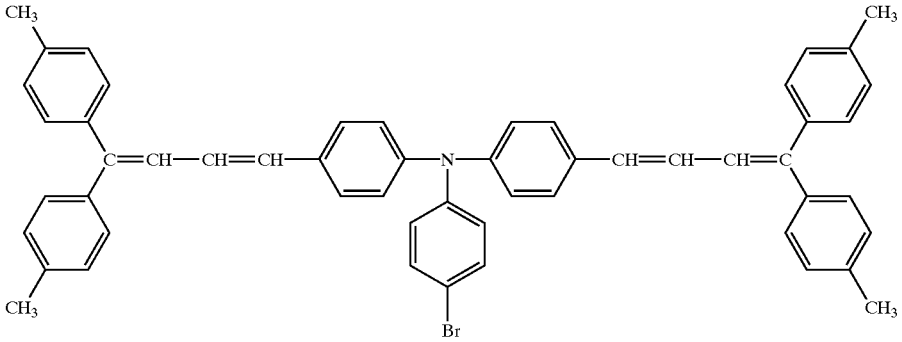
(8-6)
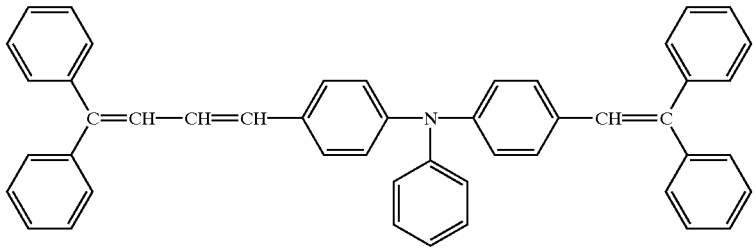

-continued (8-7)

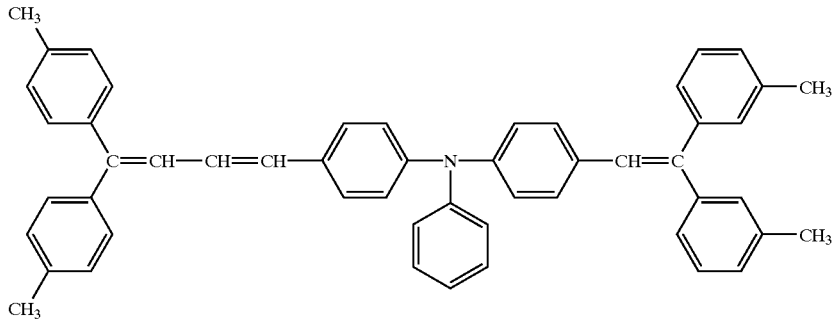

In the electrophotographic photoreceptor of the present invention, the photosensitive layer contains a charge-generating substance and a charge-transporting substance as components as described above and contains, as the charge-transporting substance, one or more organic photoconductive materials selected from organic photoconductive materials of the above general formula (1). The charge-generating substance includes an inorganic charge-generating substance and an organic charge-generating substance. Examples of the former include selenium, a selenium-tellurium alloy, a selenium-arsenic alloy, cadmium sulfide, zinc oxide and amorphous silicon. Examples of the organic charge-generating substance include phthalocyanines, an azo pigment, triphenylmethane dyes such as Methyl Violet, Brilliant Blue and Crystal Violet, thiazine dyes such as Methylene Blue, quinone dyes such as quinizarin, a cyanine dye, an acridine dye, a pyrylium dye, a thiapyrylium dye, a squarylium dye, a perinone pigment, an anthraquinone pigment and a perylene pigment. These charge-generating substances may be used alone or in combination of two or more substances. Of these charge-generating substances, phthalocyanines are preferred.

Concerning the phthalocyanines, many compounds that are for use as general dyestuffs or pigments for electrophotography are known. In the present invention, any such compounds can be used. Specific examples thereof include those described in JP-A-51-108847, JP-A-51-117637, JP-A-56-69644, JP-A-57-211149, JP-A-58-158649, JP-A-58-182639, JP-A-58-215667, JP-A-59-44053, JP-A-59-44054, JP-A-59-128544, JP-A-59-133550, JP-A-59-133551, JP-A-59-174846, JP-A-60-2061, JP-A-60-19154, JP-A-61-203461, JP-A-61-217050, JP-A-62-275272, JP-A-62-296150, JP-A-63-17457, JP-A-63-286857, JP-A-63-95460, JP-A-1-144057, JP-A-64-38753, JP-A-1-204968, JP-A-1-221459, JP-A-1-247469, JP-A-1-268763, JP-A-1-312551, JP-A-2-233769, JP-A-2-289657, JP-A-3-227372, JP-A-4-277562, JP-A-4-360150, JP-A-5-45914, JP-A-5-66594, JP-A-5-93366, JP-A-7-53892, JP-A-2000-129156, and JP-A-2000-313819. Of these, metal-free phthalocyanines and phthalocyanines containing a titanium atom, a copper atom, an aluminum atom, a gallium atom, a germanium atom, an indium atom, a magnesium atom, a tin atom, a vanadium atom, a zinc atom, a cobalt atom or nickel atom as a central atom are preferred.

Specific examples of the metal-free phthalocyanine include metal-free phthalocyanine that exhibits main peaks at Bragg angles (2θ±0.2°; Bragg angles hereinafter show angles to X ray of CuKα1.541 Å in X-ray diffraction spectrum) of 7.6°, 9.2°, 16.8°, 17.4°, 20.4° and 20.9° (τ type metal-free phthalocyanine), metal-free phthalocyanine that exhibits main peaks at Bragg angles of 7.5°, 9.1°, 16.8°, 17.3°, 20.3°, 20.8°, 21.4° and 27.4° (τ' type metal-free phthalocyanine), metal-free phthalocyanine that exhibits main peaks at Bragg angles of 7.5°, 9.1°, 16.7°, 17.3° and 22.3 (X type metal-free phthalocyanine), metal-free phthalocyanine that exhibits main peaks at Bragg angles of 7.6°, 9.2°, 16.8°, 17.4° and 28.5 or of 7.6°, 9.2°, 16.8°, 17.4°, 21.5° and 27.5 (η type metal-free phthalocyanine), metal-free phthalocyanine that exhibits main peaks at Bragg angles of 7.5°, 9.1°, 16.8°, 17.3°, 20.3°, 20.8°, 21.4° and 27.4° or of 7.5°, 9.1°, 16.8°, 17.3°, 20.3°, 20.8°, 21.4°, 22.1°, 27.4° and 28.5° (η' type metal-free phthalocyanine), metal-free phthalocyanine that exhibits main peaks at Bragg angles of 7.7°, 9.3°, 16.9°, 22.4° and 28.8°, metal-free phthalocyanine that exhibits a main peak at a Bragg angle of 6.7°, metal-free phthalocyanine that exhibits main peaks at Bragg angles of 6.7°, 8.7°, 15.1°, 17.7°, 23.8°, 26.1°, 27.4° and 30.0°, metal-free phthalocyanine that exhibits main peaks at Bragg angles of 6.7°, 7.2°, 13.4°, 14.5°, 15.2°, 16.0°, 20.2°, 21.7°, 24.0°, 24.8°, 26.6° and 27.3°, metal-free phthalocyanine that exhibits main peaks at Bragg angles of 6.6°, 13.4°, 14.5°, 20.2°, 24.8°, 26.6° and 27.2°, metal-free phthalocyanine that exhibits main peaks at Bragg angles of 6.7°, 7.3°, 13.5°, 14.9°, 15.9°, 16.7°, 24.7° and 26.1°, metal-free phthalocyanine that exhibits main peaks at Bragg angles of 7.4°, 9.0°, 16.5°, 17.2°, 22.1°, 23.8°, 27.0° and 28.4°, metal free phthalocyanine that exhibits a shoulder at a Bragg angle of 13.5° with 15.2° as a center and metal free phthalocyanine that exhibits a shoulder at a Bragg angle of 24.8° with 26.8° as a center.

Specific examples of the phthalocyanines having a titanium atom as a central metal include titanyloxyphthalocyanine that exhibits main peaks at Bragg angles (2θ±0.2°) of 7.5°, 12.3°, 16.3°, 25.3° and 28.7° (α type titanyloxyphthalocyanine), titanyloxyphthalocyanine that exhibits main peaks at Bragg angles of 9.3°, 10.6°, 13.2°, 15.1°, 15.7°, 16.1°, 20.8°, 23.3°, 26.3° and 27.1° (β type titanyloxyphthalocyanine), titanyloxyphthalocyanine that exhibits main peaks at Bragg angles of 7.0°, 15.6°, 23.4° and 25.5° (C type titanyloxyphthalocyanine), titanyloxyphthalocyanine that exhibits main peaks at Bragg angles of 6.9°, 15.5° and 23.4° (m type titanyloxyphthalocyanine), titanyloxyphthalocyanine that exhibits main peaks at Bragg angles of 9.5°, 9.7°, 11.7°, 15.0°, 23.5°, 24.1° and 27.3° (Y type titanyloxyphthalocyanine), titanyloxyphthalocyanine that exhibits main peaks at Bragg angles of 7.3°, 17.7°, 24.0°, 27.2° and 28.6° (γ type titanyloxyphthalocyanine), titanyloxyphthalocyanine that exhibits main peaks at Bragg angles of 9.0°, 14.2°, 23.9° and 27.1° (I type titanyloxyphthalocyanine), titanyloxyphthalocyanine that exhibits main peaks at Bragg angles of 7.4°, 11.0°, 17.9°, 20.1°, 26.5° and 29.0° (E type titanyloxyphthalocyanine), titanyloxyphthalocyanine that exhibits main peaks at Bragg angles of 7.4°, 10.1°, 12.4°, 24.1°, 25.2° and 28.5° (ω type titanyloxyphthalocyanine), titanyloxyphthalocyanine that exhibits main peaks at Bragg angles of 7.5°, 22.4°, 24.4°, 25.4°, 26.2°, 27.2° and 28.6°, titanyloxyphthalocyanine that exhibits main peaks at Bragg angles of 9.2°, 13.1°, 20.7°, 26.2° and 27.1°, titanyloxyphthalocyanine that exhibits main peaks at Bragg angles of 7.3°, 22.9° and 27.4°, titanyloxyphthalocyanine that exhibits main peaks at Bragg angles of 7.6°, 10.5°, 12.5°, 15.6°, 16.4°, 17.7°, 26.3°, 28.9°, 30.5° and 32.0°, titanyloxyphthalocyanine that exhibits a main peak at a Bragg angle of 27.3°, titanyloxyphthalocyanine that exhibits main peaks at Bragg angles of 7.4°, 11.0°, 17.9°, 20.1°, 26.4° and 29.0°, titanyloxyphthalocyanine that exhibits main peaks at Bragg angles of 6.8°, 9.7° and 15.4°, titanyloxyphthalocyanine that exhibits main peaks at Bragg angles of 9.2°, 11.6°, 13.0°, 24.1°, 26.2° and 27.2°, titanyloxyphthalocyanine that exhibits main peaks at Bragg angles of 9.1°, 12.2°, 16.3° and 26.9°, titanyloxyphthalocyanine that exhibits main peaks at Bragg angles of 7.4°, 9.2°, 10.4°, 11.6°, 13.0°, 14.3°, 15.0°, 15.5°, 23.4°, 24.1°, 26.2° and 27.2°, titanyloxyphthalocyanine that exhibits main peaks at Bragg angles of 4.8°, 9.6° and 26.2°, titanyloxyphthalocyanine that exhibits main peaks at Bragg angles of 6.5°, 14.5° and 23.8°, titanyloxyphthalocyanine that exhibits main peaks at Bragg angles of 7.0°, 9.1°, 14.1°, 18.1° and 26.2°, titanyloxyphthalocyanine that exhibits main peaks at Bragg angles of 6.8°, 14.9°, 24.8° and 26.2°, titanyloxyphthalocyanine that exhibits main peaks at Bragg angles of 7.5° and 27.3°, titanyloxyphthalocyanine that exhibits main peaks at Bragg angles of 7.3°, 19.4°, 21.5° and 23.8°, titanyloxyphthalocyanine that exhibits main peaks at Bragg angles of 10.5°, 12.6°, 15.0 and 26.6°, titanyloxyphthalocyanine that exhibits main peaks at Bragg angles of 8.5°, 13.6°, 17.1°, 18.0°, 23.9° and 27.4°, titanyloxyphthalocyanine that exhibits main peaks at Bragg angles of 8.9°, 11.4° and 27.2°, titanyloxyphthalocyanine that exhibits main peaks at Bragg angles of 6.8°, 26.1° and 27.1°, titanyloxyphthalocyanine that exhibits a main peak at a Bragg angles of 26.2°, titanyloxyphthalocyanine that exhibits main peaks at Bragg angles of 7.3°, 15.2° and 26.2°, titanyloxyphthalocyanine that exhibits main peaks at Bragg angles of 13.1°, 20.6°, 26.1° and 27.0°, titanyloxyphthalocyanine that exhibits main peaks at Bragg angles of 6.7°, 7.4°, 10.2°, 12.6°, 15.2°, 16.0°, 17.1°, 18.2°, 22.4°, 23.2°, 24.2°, 25.2° and 28.5°, titanyloxyphthalocyanine that exhibits main peaks at Bragg angles of 6.8° and 27.3°, titanyloxyphthalocyanine that exhibits main peaks at Bragg angles of 9.5°, 24.1° and 27.2°, titanyloxyphthalocyanine that exhibits main peaks at Bragg angles of 7.2°, 14.2°, 24.0° and 27.2°, titanyloxyphthalocyanine that exhibits main peaks at Bragg angles of 21.6° and 28.0°, titanyloxyphthalocyanine that exhibits main peaks at Bragg angles of 9.6° and 27.2°, titanyloxyphthalocyanine that exhibits main peaks at Bragg angles of 7.5°, 22.5° and 28.6°, titanyloxyphthalocyanine that exhibits a main peak at a Bragg angle of 8.4°, titanyloxyphthalocyanine that exhibits main peaks at Bragg angles of 7.6°, 10.3°, 12.7°, 16.3°, 22.7°, 24.3°, 22.5° and 28.6°, titanyloxyphthalocyanine that exhibits main peaks at Bragg angles of 6.8°, 7.4°, 15.0°, 24.7°, 26.2° and 27.2°, and an amorphous titanyloxyphthalocyanine that exhibits no clear peak.

Specific examples of the phthalocyanines having an aluminum atom as a central metal include chloroaluminum phthalocyanine that exhibits main peaks at Bragg angles (2θ±0.2°) of 6.7°, 11.2°, 16.7° and 25.6°, chloroaluminum phthalocyanine that exhibits a main peak at a Bragg angle of 7.0°, chloroaluminum phthalocyanine that exhibits a main peak at a Bragg angle of 25.5°, and chloroaluminum phthalocyanine that exhibits main peaks at Bragg angles of 6.5°, 11.1°, 13.7°, 17.0°, 22.0°, 23.0°, 24.1° and 25.7°.

Specific examples of the phthalocyanines having an indium atom as a central metal include bromoindium phthalocyanine that exhibits main peaks at Bragg angles (2θ±0.2°) of 7.4°, 16.7°, 25.3°, 27.5° and 28.4° and chloroindium phthalocyanine that exhibits main peaks at Bragg angles of 7.4°, 16.7° and 27.80.

Specific examples of the phthalocyanines having a vanadium atom as a central metal include vanadyloxyphthalocyanine that exhibits main peaks at Bragg angles (2θ±0.2°) of 9.3°, 10.7°, 13.1°, 15.1°, 15.7°, 16.1°, 20.7°, 23.3°, 26.2° and 27.1°, vanadyloxyphthalocyanine that exhibits main peaks at Bragg angles of 7.5°, 24.2°, 27.2° and 28.6°, vanadyloxyphthalocyanine that exhibits main peaks at Bragg angles of 14.3°, 18.0°, 24.1° and 27.3°, vanadyloxyphthalocyanine that exhibits main peaks at Bragg angles of 7.4°, 10.3°, 12.6°, 16.3°, 17.8°, 18.5°, 22.4°, 24.2°, 25.4°, 27.2° and 28.6°, and an amorphous vanadyloxyphthalocyanine that exhibits no clear peak.

Specific examples of the phthalocyanines having a gallium atom as a central metal include chlorogallium phthalocyanine that exhibits main peaks at Bragg angles (2θ±0.2°) of 7.4°, 16.6°, 25.5° and 28.3°, chlorogallium phthalocyanine that exhibits main peaks at Bragg angles of 6.7°, 15.2°, 20.5° and 27.0°, chlorogallium phthalocyanine that exhibits main peaks at Bragg angles of 6.7°, 13.7°, 16.3°, 20.9° and 26.3°, chlorogallium phthalocyanine that exhibits main peaks at Bragg angles of 7.5°, 9.5°, 11.0°, 13.5°, 19.1°, 20.3°, 21.8°, 25.8°, 27.1° and 33.0°, chlorogallium phthalocyanine that exhibits main peaks at Bragg angles of 11.0°, 13.5° and 27.1°, chlorogallium phthalocyanine that exhibits main peaks at Bragg angles of 6.8°, 17.3°, 23.6° and 26.9°, chlorogallium phthalocyanine that exhibits main peaks at Bragg angles of 8.7–9.2°, 17.6°, 27.4° and 28.8°, and chlorogallium phthalocyanine that exhibits a main peak at a Bragg angle of 27.1° and other peaks having an intensity of 10% or less based on the intensity of the main peak at 27.1°.

Specific examples of the phthalocyanines having a gallium atom as a central metal include hydroxygallium phthalocyanine that exhibits main peaks at Bragg angles (2θ±0.2°) of 7.5°, 9.9°, 12.5°, 16.3°, 18.6°, 25.1° and 28.3°, hydroxygallium phthalocyanine that exhibits main peaks at Bragg angles of 7.7°, 16.5°, 25.1° and 26.6°, hydroxygallium phthalocyanine that exhibits main peaks at Bragg angles of 7.9°, 16.5°, 24.4° and 27.6°, hydroxygallium phthalocyanine that exhibits main peaks at Bragg angles of 7.0°, 7.5°, 10.5°, 11.7°, 12.7°, 17.3°, 18.1°, 24.5°, 26.2° and 27.1°, hydroxygallium phthalocyanine that exhibits main peaks at Bragg angles of 6.8°, 12.8°, 15.8° and 26.0°, and hydroxygallium phthalocyanine that exhibits main peaks at Bragg angles of 7.4°, 9.9°, 25.0°, 26.2° and 28.20.

Specific examples of the phthalocyanines having a copper atom as a central metal include copper phthalocyanine that exhibits main peaks at Bragg angles (2θ±0.2°) of 7.0°, 9.2°, 12.5°, 16.8°, 18.6°, 21.3°, 23.8°, 26.2°, 28.0° and 30.5° (β type phthalocyanine), copper phthalocyanine that exhibits main peaks at Bragg angles of 7.6°, 9.1°, 14.2°, 17.4°, 20.4°, 21.2°, 23.0°, 26.5°, 27.2° and 29.50 (ϵ type phthalocyanine), copper phthalocyanine that exhibits main peaks at Bragg angles of 7.0°, 9.8°, 15.8°, 24.9°, 26.7° and 27.30 (α type phthalocyanine), and copper phthalocyanine that exhibits main peaks at Bragg angles of 7.0°, 7.7° and 9.2°.

Specific examples of the phthalocyanines having a germanium atom as a central metal include germanium phthalocyanine that exhibits main peaks at Bragg angles (2θ±0.2°) of 9.0°, 11.2°, 17.1°, 18.1°, 20.9°, 22.7°, 25.8° and 29.3°.

The X type metal-free phthalocyanine that exhibits main peaks at Bragg angles (2θ±0.2°) of 7.5°, 9.1°, 16.7°, 17.3° and 22.3° can be produced, for example, by a method described in U.S. Pat. No. 3,357,989, JP-A-60-243089, JP-A-61-115085 or JP-A-62-47054. The ι type metal-free phthalocyanine that exhibits main peaks at Bragg angles (2θ±0.2°) of 7.6°, 9.2°, 16.8°, 17.4°, 20.4° and 20.9° can be produced, for example, by a method described in JP-A-58-182639.

The amorphous titanyloxyphthalocyanine that exhibits no clear peak in X-ray diffraction spectrum can be produced, for example, by a method described in JP-A-2000-313819. Further, the titanyloxyphthalocyanine that at least exhibits main peaks at Bragg angles (2θ±0.2°) of 9.5°, 9.7°, 11.7°, 15.0°, 23.5°, 24.1° and 27.3° can be produced by a method described in JP-A-7-271073. The titanyloxyphthalocyanine that exhibits main peaks at Bragg angles (2θ±0.2°) of 9.5°, 13.5°, 14.2°, 18.0°, 24.0° and 27.2° can be produced, for example, by a method described in JP-A-2000-129156. The titanyloxyphthalocyanine that exhibits main peaks at Bragg angles (2θ±0.2°) of 9.0°, 14.2°, 23.9° and 27.1° can be produced by a method described in JP-A-7-44065. Titanyloxyphthalocyanine that exhibits a maximum peak at Bragg angles (2θ±0.2°) of 27.3° and peaks at 7.4°, 9.7° and 24.2° can be produced, for example, by a method described in JP-A-2-8256.

Those phthalocyanines having a gallium atom, a germanium atom or an indium atom as a central metal in the present invention can be produced, for example, by methods described in JP-A-4-360150, JP-A-5-194523, JP-A-5-263007, JP-A-7-102183, JP-A-7-53892, JP-A-8-259836, JP-A-8-253701, JP-A-8-253702, JP-A-8-253703 or JP-A-8-253704.

A phthalocyanine composition that contains titanyloxyphthalocyanine and a metal-free phthalocyanine and exhibits main peaks at Bragg angles (2θ±0.2°) of 7.0°, 9.0°, 14.1°, 18.0°, 23.7° and 27.3° can be produced, for example, by a method described in JP-A-2000-313819.

Further, examples of the azo pigment include compounds described in JP-A-47-37543, JP-A-53-95033, JP-A-53-132347, JP-A-53-133445, JP-A-54-12742, JP-A-54-20736, JP-A-54-20737, JP-A-54-21728, JP-A-54-22834, JP-A-55-69148, JP-A-55-69654, JP-A-55-79449, JP-A-55-117151, JP-A-56-46237, JP-A-56-116039, JP-A-56-116040, JP-A-56-119134, JP-A-56-143437, JP-A-57-63537, JP-A-57-63538, JP-A-57-63541, JP-A-57-63542, JP-A-57-63549, JP-A-57-66438, JP-A-57-74746, JP-A-57-78542, JP-A-57-78543, JP-A-57-90056, JP-A-57-90057, JP-A-57-90632, JP-A-57-116345, JP-A-57-202349, JP-A-58-4151, JP-A-58-90644, JP-A-58-144358, JP-A-58-177955, JP-A-59-31962, JP-A-59-33253, JP-A-59-71059, JP-A-59-72448, JP-A-59-78356, JP-A-59-136351, JP-A-59-201060, JP-A-60-15642, JP-A-60-140351, JP-A-60-179746, JP-A-61-11754, JP-A-61-90164, JP-A-61-90165, JP-A-61-90166, JP-A-61-112154, JP-A-61-281245, JP-A-61-51063, JP-A-62-267363, JP-A-63-68844, JP-A-63-89866, JP-A-63-139355, JP-A-63-142063, JP-A-63-183450, JP-A-63-282743, JP-A-64-21455, JP-A-64-78259, JP-A-1-200267, JP-A-1-202757, JP-A-1-319754, JP-A-2-72372, JP-A-2-254467, JP-A-3-278063, JP-A-4-96068, JP-A-4-96069, JP-A-4-147265, JP-A-5-142841, JP-A-5-303226, JP-A-6-324504, JP-A-7-168379, JP-A-9-297414 and JP-A-9-297416.

Coupler components for the azo pigment have diversified structures. Examples thereof include compounds described in JP-A-54-17735, JP-A-54-79632, JP-A-57-178055, JP-A-59-197043, JP-A-60-130746, JP-A-60-153050, JP-A-60-103048, JP-A-60-189759, JP-A-63-131146, JP-A-63-155052, JP-A-2-110569, JP-A-4-149448, JP-A-6-27705 and JP-A-6-348047.

Electrophotographic photoreceptors having various forms are known, and any one of such can be employed in the present invention. For example, one electrophotographic photoreceptor has a form in which a photosensitive layer made of a charge-generating substance, a charge-transporting substance and a binder resin is formed on an electrically conductive substrate. There is also known a multilayer type photoreceptor having a form in which a charge-generating layer made of a charge-generating substance and a binder resin and a charge-transporting layer made of a charge-transporting substance and a binder resin are formed on an electrically conductive substrate. In the multilayer type photoreceptor, any one of the charge-generating layer and the charge-transporting layer may constitute an upper layer. Further, an undercoat layer may be formed between the electrically conductive substrate and the photosensitive layer as required, an overcoat layer may be formed on the photoreceptor surface as required, and when the photoreceptor is a multilayer type photoreceptor, an intermediate layer may be formed between the charge-generating layer and the charge-transporting layer as required. The support on which the photosensitive layer is to be formed from the compound of the present invention can be selected from a drum made of a metal, a metal plate, paper treated to impart it with electric conductivity, and substrates made of a plastic film in the form of a sheet, a drum or a belt.

The film-forming binder resin for forming a photosensitive layer on the substrate can be selected from various polymer compounds depending upon fields of use. Specific examples of the binder resin include a polyvinyl chloride resin, a polystyrene resin, a polyvinyl acetal resin, a butyral resin, a polysulfone resin, a polycarbonate resin, a vinyl acetate-crotonic acid copolymer resin, a polyester resin, a polyphenylene oxide resin, a polyarylate resin, an alkyd resin, an acrylic resin, a methacrylic resin and a phenoxy resin. Of these, a polystyrene resin, a polyvinyl acetal resin, a butyral resin, a polycarbonate resin, a polyester resin and a polyaryrate resin are excellent in potential properties of a photoreceptor. These resins which are homopolymers or copolymers may be used alone, or used in combination. Of these binder resins, a polycarbonate copolymer or homopolymer given as an example of the binder above is particularly preferred. The amount of the binder resin on the basis of the organic photoconductive material is preferably 20 to 1,000% by weight, more preferably 50 to 500% by weight.

In the multilayer type photoreceptor, the content of the above resin in the charge-generating layer is preferably 10 to 500% by weight, more preferably 50 to 150% by weight based on the charge-generating substance. When the content of the resin is too high, the charge generation efficiency decreases. When the content of the resin is too low, there is caused a problem on film formability. When the content of the above resin in the charge-transporting layer is preferably 20 to 1,000% by weight, more preferably 50 to 500% by weight based on the charge-transporting substance. When the content of the resin is too high, the sensitivity decreases. When the content of the resin is too low, the photosensitive layer may be poor in properties in repeated use or may suffer a loss of the coated film.

Some of these resins are poor in mechanical strength such as tensile strength, flexural strength and compression strength. For improving such resins in these properties, a substance to give plasticity may be added. Specifically, the substance to give plasticity includes phthalic ester (e.g., DOP, DBP), phosphoric ester (e.g., TCP, TOP), sebacic ester, adipic ester, nitrile rubber and chlorinated hydrocarbon. Since these substances have an adverse effect on electrophotographic properties when added in an amount more than necessary, the amount ratio thereof based on the binder resin is preferably 20% by weight or less.

As additives to the photoreceptor, an anti-oxidant, a curl preventer and a leveling agent for improving coatability may be added as required.

The compound of the general formula (1) may be used further in combination with other charge-transporting substance. The charge-transporting substance includes a hole-transporting substance and an electron-transporting substance. Examples of the former include oxadiazoles disclosed in JP-B-34-5466, triphenylmethane disclosed in JP-B-45-555, pyrazolines disclosed in JP-B-52-4188, hydrazones disclosed in JP-B-52-42380 and oxadiazoles disclosed in JP-A-56-123544. Examples of the electron-transporting substance include chloranil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 1,3,7-trinitrodibenzothiophene, and 1,3,7-trinitrobenzothiophene-5,5-dioxide. These charge-transporting substances may be used alone or in combination of two or more substances.

As a sensitizer for forming a charge transfer complex with the organic photoconductive material of the present invention to further increase a sensitivity-increasing effect, some electron-attracting compound may be added. Examples of the above electron-attracting compound include quinones such as 2,3-dichloro-1,4-naphthoquinone, 1-nitroanthraquinone, 1-chloro-5-nitroanthraquinone, 2-chloroanthraquinone and phenanthrenequinone, aldehydes such as 4-nitrobenzaldehyde, ketones such as 9-benzoylanthracene, indandione, 3,5-dinitrobenzophenone and 3,3,5,5-tetranitrobenzophenone, acid anhydrides such as phthalic acid anhydride and 4-chlorophthalic acid anhydride, cyano compounds such as terephthalalmalononitrile, 9-anthrylmethylidenemalonitrile, 4-nitrobenzalmalonitrile and 4-(p-nitrobenzoyloxy) benzalmalonitrile, and phthalides such as 3-benzalphthalide, 3-(α-cyano-p-nitrobenzal)phthalide and 3-(α-cyano-p-nitrobenzal)-4,5,6,7-tetrachlorophthalide.

The organic photoconductive material of the present invention is dissolved or dispersed in a proper solvent together with the above various additives as required depending upon the form of the photoreceptor, the solution or dispersion is applied to the above electrically conductive substrate, and the applied solution or dispersion is dried, whereby a photoreceptor can be produced.

The above solvent includes halogenated hydrocarbons such as chloroform, dichloroethane, dichloromethane, trichloroethane, trichloroethylene, chlorobenzene and dichlorobenzene, aromatic hydrocarbons such as benzene, toluene and xylene, ether solvents such as dioxane, 1,3-dioxolane, tetrahydrofuran, methyl cellosolve, ethyl cellosolve and ethylene glycol dimethyl ether, ketone solvents such as methyl ethyl ketone, methyl isobutyl ketone, methyl isopropyl ketone and cyclohexanone, ester solvents such as ethyl acetate, methyl formate and methyl cellosolve acetate, aprotic polar solvents such as N,N-dimethylformamide, N,N-dimethylacetamide, acetonitrile, N-metylpyrrolidone and dimethyl sulfoxide, and alcohol solvents. These solvents may be used alone or in combination of two or more solvents.

The organic photoconductive material of the present invention is suitably used as a charge-transporting substance in the photosensitive layer of an electrophotographic photoreceptor. It can be also used in a sensor material, an electrostatic recording device, an optical switching element, and various display devices such as an EL device, an electronic paper, and the like.

The electrophotographic photoreceptor using the above organic photoconductive material in a photosensitive layer, provided by the present invention, exhibits a high charge potential and high sensitivity and shows little or almost no change in various properties in repeated use, so that it can exhibit stable performances.

The present invention will be explained in detail with reference to Examples hereinafter, while the present invention shall not be limited by these Examples.

Preparation Example 1

Preparation of Example Compound (38)

(a) Synthesis of N-hexyldiphenylamine (117)

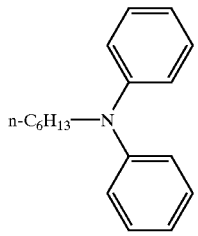

253.8 Grams of diphenylamine, 297.0 g of 1-bromohexane and 1,500 ml of toluene were mixed, and 150 g of sodiumamide was added little by little with stirring. After completion of the addition, the mixture was refluxed under heat on an oil bath at 120° C. with stirring for 10 hours. Then, the reaction mixture was poured into 2,000 ml of water little by little, and the mixture was stirred at room temperature for 1.0 hours. During the stirring, heat generation was observed. The mixture was transferred into a separation funnel, and an organic layer was recovered. The recovered liquid was washed consecutively with water and saturated sodium chloride aqueous solution and then dried over anhydrous sodium sulfate. The resultant oily substance was distilled under reduced pressure, to give 337 g of N-hexyldiphenylamine (117) having a boiling point of 173–175° C. (0.4 Torr). The yield thereof was 88.6%.

$^{1}$H-NMR ($CDCl_3$) δ 0.87 ppm (m, 3H), δ 1.28 ppm (m, 6H), δ 1.65 ppm (m, 2H), δ 3.67 ppm (t, 2H), δ 6.89~6.99 ppm (m, 6H), δ 7.20~7.27 ppm (m, 4H)

$_{13}$C-NMR ($CDCl_3$) δ 14.9 ppm, δ 23.5 ppm, δ 27.6 ppm, δ 28.3 ppm, δ 32.5 ppm, δ 53.2 ppm, δ 121.7 ppm, δ 121.9 ppm, δ 130.0 ppm, δ 148.9 ppm (b) Synthesis of Intermediate Aldehyde Compound (118)

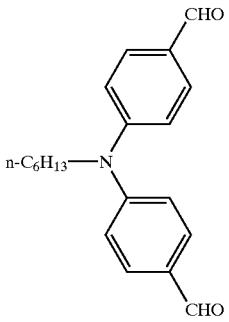

20.2 Grams of phosphorus oxychloride was dropwise added to 14.5 g of N,N-dimethylformamide with cooling with ice and stirring while the internal temperature was maintained at 15° C. or lower. Further, the above solution was stirred at room temperature for 30 minutes, then, 7.6 g of the above-obtained N-hexyldiphenylamine (117) was added, and the mixture was stirred under heat at an internal temperature of 90° C. for 8 hours. After allowed to cool, the reaction mixture was poured into 100 ml of ice water to hydrolyze the mixture. In this case, heat generation was observed. The mixture was further stirred under heat at an internal temperature of approximately 50° C. for 1 hour, to complete the hydrolysis. After the reaction mixture was allowed to cool, an organic component was extracted with toluene, washed consecutively with water, diluted baking soda aqueous solution and saturated sodium chloride aqueous solution, and dried over anhydrous sodium sulfate. After the drying was completed, sodium sulfate was removed by filtering, a small amount of hydroquinone was added, and the mixture was concentrated under reduced pressure, to give 9.0 g of an oily intermediate aldehyde (118).

(c) Synthesis of Example Compound (38)

22.6 Grams of a phosphonic ester compound (119) of the formula below synthesized according to a method described in JP-A-8-295655, Compound (119)

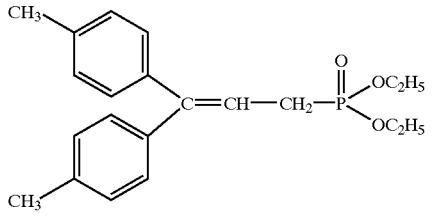

and 9.0 g of the above-obtained intermediate aldehyde compound (118) were dissolved in 90 ml of dioxolane. With stirring and cooling with ice, 8.1 g of potassium-t-butoxide was added little by little. After completion of the addition, the mixture was stirred at the same temperature for 30 minutes to complete the reaction. The reaction mixture was diluted with 270 ml of water, and a precipitated crystal was recovered by filtering and consecutively washed on a funnel with water and methanol. The crystal was purified by silica gel column chromatography using a mixture of toluene and heptane as a mobile phase, to give 17.2 g of an example compound (38). The yield from the two steps from the preparation of (117) to the preparation of (38) was 79.8%. Melting point; 154.4–155.4° C.

$^{1}$H-NMR ($CDCl_3$) δ 0.86 ppm (m, 3H), δ 1.25 ppm (m, 6H), δ 1.61 ppm (m, 2H), δ 2.34 ppm (s, 6H), δ 2.41 ppm (s, 6H), δ 3.64 ppm (m, 2H), δ 6.56~6.73 ppm (m, 2H), δ 6.74~6.95 ppm (m, 8H), δ 7.00~7.30 ppm (m, 20H) $^{13}$C-NMR ($CDCl_3$) δ 14.0 ppm, δ 21.1 ppm, δ 21.3 ppm, δ 22.6 ppm, δ 26.7 ppm, δ 27.4 ppm, δ 31.6 ppm, δ 52.2 ppm, δ 120.7 ppm, δ 125.3 ppm, δ 137.3 ppm, δ 127.4 ppm, δ 127.7 ppm, δ 128.8 ppm, δ 130.6 ppm, δ 130.7 ppm, δ 132.8 ppm, δ 136.9 ppm, δ 137.0 ppm, δ 137.1 ppm, δ 139.9 ppm, δ 141.8 ppm, δ 146.9 ppm

Preparation Example 2

Preparation of Example Compound (78)

(a) Synthesis of Intermediate Aldehyde Compound (120)

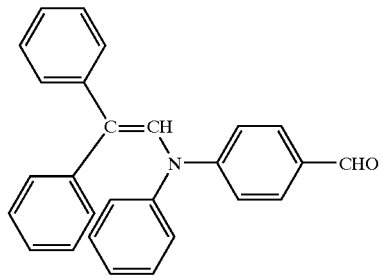

To 139.4 ml of N,N-dimethylformamide was dropwise added 84 ml of phosphorus oxychloride with stirring and cooling with ice while the internal temperature was maintained at 15° C. or lower. Further, the resultant solution was stirred at room temperature for 30 minutes. Then, a suspension of 104.2 g of an enamine compound (121) of the formula below synthesized according to a method described in JP-A-11-43458, Compound (121)

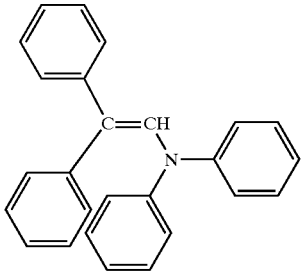

and 150 mol of N,N-dimethylformamide was added, and the mixture was stirred under heat at an internal temperature of approximately 80° C. for 1.5 hours. After allowed to cool, the reaction mixture was poured into a mixture of 700 g of ice with 700 ml of methanol to hydrolyze the reaction mixture. In this case, heat generation was observed, and a crystal precipitated. Further, the reaction mixture was stirred under heat at an internal temperature of 50° C. for 30 minutes for hydrolysis. After the reaction mixture was allowed to cool, a crystal was well pulverized and recovered by filtering and washed on a funnel with a 50 wt. % hydrous methanol. After the crystal was dried under reduced pressure, and then the crystal was re-crystallized from a solvent mixture of ethyl acetate and 2-propanol, to give 80.4 g of an intermediate aldehyde compound (120). The yield thereof was 71.4%. Melting point; 149.0–150.3° C.

$^1$H-NMR (DMS O-$d_6$) δ 6.85 ppm (m, 3H), δ 7.05 ppm (m, 8H), δ 7.18 ppm (t, 2H), δ 7.30 ppm (m, 5H), δ 7.68 ppm (d, 2H), δ 9.75 ppm (s, 1H)

(b) Synthesis of Example Compound (78)

3.01 Grams of the above-described phosphonic ester compound (119) and 3.00 g of the above-obtained intermediate aldehyde compound (120) were dissolved in 20 ml of 1,3-dioxolane. With stirring and cooling with ice, 1.35 g of potassium-t-butoxide was added little by little. After completion of the addition, the mixture was stirred at the same temperature for 30 minutes, to complete the reaction. The reaction mixture was diluted with 45 ml of water, and an organic component was extracted with toluene. The extracted liquid was dried and then concentrated under reduced pressure to give an oil crude product. The crude product was purified by silica gel column chromatography using a solvent mixture of toluene and heptane as a mobile layer, to give 4.26 g of an example compound (78). The yield thereof was 91.8%. Melting point; 164.1–166.5° C.

$^1$H-NMR ($CDCl_3$) δ 2.33 ppm (s, 3H), δ 2.40 ppm (s, 3H), δ 6.5~7.3 ppm (m, 31H) $^{13}$C-NMR($CDCl_3$)δ 21.12 ppm, δ 21.28 ppm, δ 121.81 ppm, δ 122.81 ppm, δ 122.91 ppm, δ 125.78 ppm, δ 126.42 ppm, δ 126.69 ppm, δ 126.83 ppm, δ 127.43 ppm, δ 127.48 ppm, δ 127.57 ppm, δ 128.13 ppm, δ 128.71 ppm, δ 128.80 ppm, δ 128.87 ppm, δ 129.90 ppm, δ 130.53 ppm, δ 130.74 ppm, δ 130.94 ppm, δ 132.06 ppm, δ 132.75 ppm, δ 137.01 ppm, δ 137.08 ppm, δ 138.74 ppm, δ 139.83 ppm, δ 141.82 ppm, δ 142.12 ppm, δ 145.02 ppm, δ 145.33 ppm Structural formulae of azo pigments used in the following Examples are shown below.

(122)

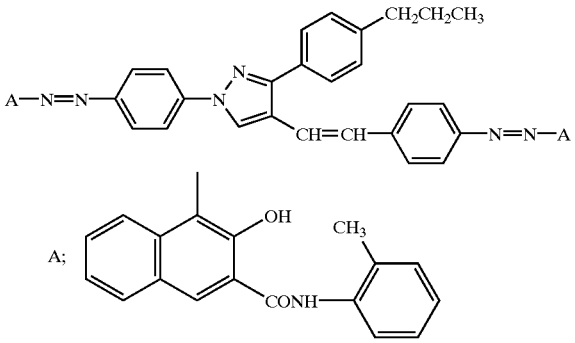

(123)

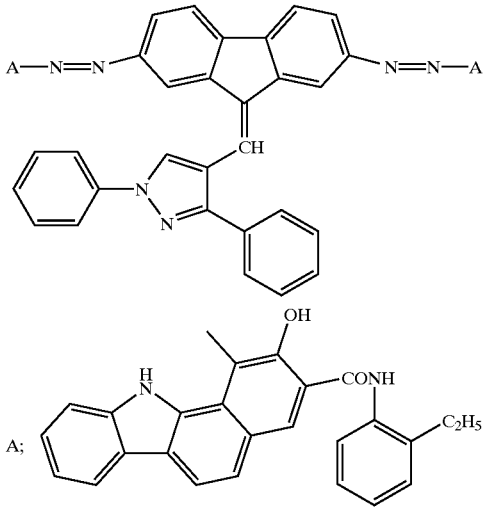

(124)

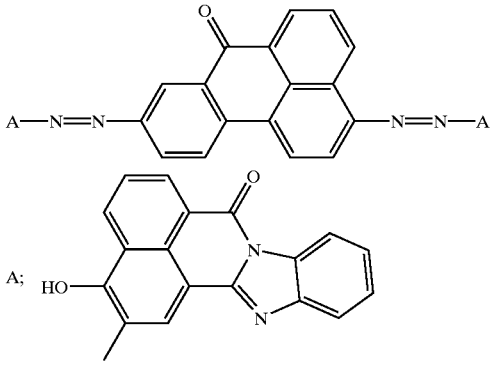

(125)

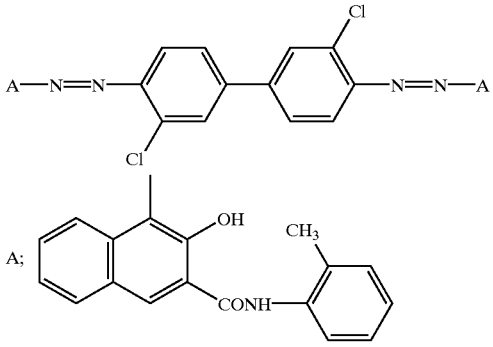

-continued (126)

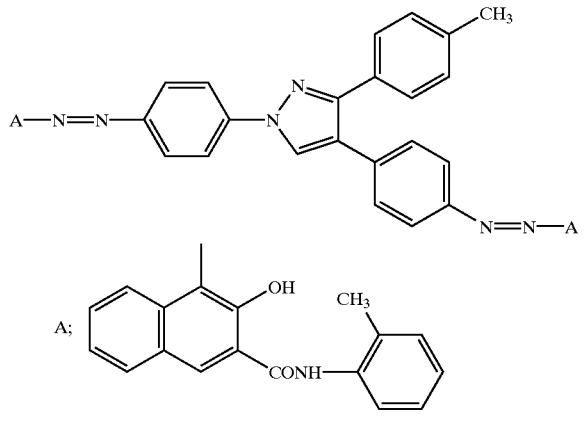

(127)

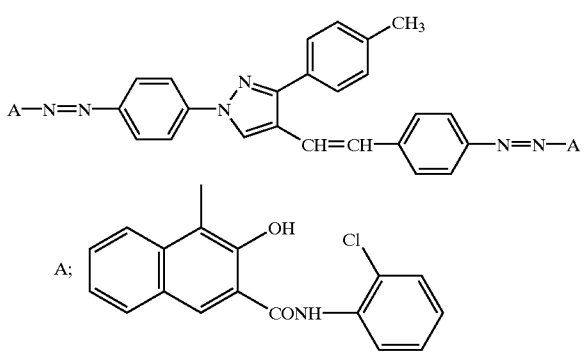

Example 1

1 Part by weight of an azo pigment (122) and 1 part by weight of a polyester resin (Vylon 200, supplied by Toyobo Co., Ltd.) were mixed with 100 parts by weight of tetrahydrofuran, and the mixture was dispersed in a paint conditioner together with glass beads for 2 hours. The thus-obtained dispersion was applied to an aluminum-deposited polyester film with an applicator, and the applied dispersion was dried to form a charge-generating layer having a thickness of approximately 0.2 $\mu$m. Then, the example compound (38) was mixed with a polyarylate resin (U-Polymer, supplied by Unitika Ltd.) in a weight ratio of 1:1, and a solution of 10% by weight of the mixture in dichloroethane as a solvent was prepared. The solution was applied onto the above charge-generating layer with an applicator to form a charge-transporting layer having a thickness of approximately 20 $\mu$m.

The thus-obtained multilayer type photoreceptor was evaluated for electrophotographic properties with an electrostatic recording tester (Electrostatic paper analyzer EPA-8200, supplied by Kawaguchi Electric Mfg. Co., Ltd.).

Measurement conditions: Applied voltage −5 kV,

Static No. 3 (turning speed mode of turn table: 10 m/minute).

As a result, the photoreceptor showed a charge potential (Vo) of −860 V and a half exposure (E ½) of 1.2 lux·second, or values of high sensitivity.

Further, the photoreceptor was evaluated for properties in repeated use in which charge-discharge (discharge light: exposure to white light of 400 lux×1 second) was one cycle, with the same machine. When a change in charge potential in repeated use of 5,000 cycles was measured, the photoreceptor showed a charge potential (Vo) of −860 V in a first cycle and a charge potential (Vo) of −850 V in a 5,000th cycle, so that the photoreceptor was free of a decrease in potential in repeated use and showed a stable property. Further, the photoreceptor showed a half exposure (E ½) of 1.2 lux·second in the first cycle and a half exposure (E ½) of 1.2 lux·second in the 5,000th cycle, so that the photoreceptor showed an excellent property.

Examples 2–18

Photoreceptors were produced in the same manner as in Example 1 except that the azo pigment (122) and the example compound (38) in Example 1 were replaced with azo pigments and example compounds shown in Table 4. The photoreceptors were evaluated in the same manner as in Example 1. Table 4 shows the results.

TABLE 4

| | Azo | Example | First cycle | | 5000th cycle | |
|---|---|---|---|---|---|---|
| Ex. | pigment | Compound | Vo (v) | E½* | Vo (v) | E½* |
| 2 | (122) | (24) | −830 | 1.2 | −815 | 1.1 |
| 3 | (122) | (29) | −805 | 1.3 | −795 | 1.3 |
| 4 | (126) | (31) | −820 | 1.2 | −810 | 1.2 |
| 5 | (126) | (34) | −795 | 1.2 | −780 | 1.2 |
| 6 | (123) | (40) | −820 | 1.3 | −805 | 1.3 |
| 7 | (124) | (42) | −845 | 1.3 | −830 | 1.2 |
| 8 | (125) | (54) | −825 | 1.3 | −815 | 1.3 |
| 9 | (127) | (56) | −830 | 1.4 | −825 | 1.3 |
| 10 | (122) | (70) | −825 | 1.3 | −815 | 1.3 |
| 11 | (122) | (78) | −850 | 1.2 | −845 | 1.2 |
| 12 | (126) | (85) | −805 | 1.3 | −795 | 1.3 |
| 13 | (123) | (86) | −820 | 1.2 | −810 | 1.2 |
| 14 | (124) | (89) | −795 | 1.2 | −780 | 1.2 |
| 15 | (122) | (95) | −810 | 1.3 | −805 | 1.2 |
| 16 | (124) | (96) | −840 | 1.3 | −830 | 1.2 |
| 17 | (125) | (114) | −825 | 1.2 | −820 | 1.2 |
| 18 | (127) | (115) | −835 | 1.4 | −825 | 1.4 |

Notes:
Ex. = Example,
*(lux.second)

Examples 19–36

Photoreceptors were produced in the same manner as in Example 1 except that the azo pigment (122) in Example 1 was replaced with a crystalline titanyloxyphthalocyanine that exhibited peaks at Bragg angles (2θ±0.2°) of 9.5°, 13.5°, 14.2°, 18.0°, 24.0° and 27.2° described in JP-A-2000-129156 and that the example compound (38) in Example 1 was replaced in example compounds shown in Table 5. The photoreceptors were evaluated in the same manner as in Example 1. Table 5 shows the results.

TABLE 5

| | Example | First cycle | | 5000th cycle | |
|---|---|---|---|---|---|
| Ex. | compound | Vo (v) | E½* | Vo (v) | E½* |
| 19 | (38) | −780 | 1.0 | −770 | 1.0 |
| 20 | (24) | −800 | 1.0 | −785 | 0.9 |
| 21 | (29) | −810 | 0.9 | −795 | 0.9 |
| 22 | (31) | −785 | 1.0 | −775 | 0.9 |
| 23 | (34) | −815 | 0.9 | −805 | 0.8 |
| 24 | (40) | −800 | 1.0 | −790 | 1.0 |
| 25 | (42) | −800 | 0.9 | −800 | 0.8 |
| 26 | (54) | −815 | 1.0 | −800 | 1.0 |
| 27 | (56) | −820 | 1.1 | −815 | 1.0 |

TABLE 5-continued

| Ex. | Example compound | First cycle Vo (v) | First cycle E½* | 5000th cycle Vo (v) | 5000th cycle E½* |
|---|---|---|---|---|---|
| 28 | (68) | −815 | 1.0 | −800 | 1.0 |
| 29 | (70) | −780 | 1.0 | −770 | 1.0 |
| 30 | (78) | −800 | 1.0 | −785 | 0.9 |
| 31 | (83) | −810 | 0.9 | −795 | 0.9 |
| 32 | (85) | −785 | 1.0 | −775 | 0.9 |
| 33 | (86) | −815 | 0.9 | −805 | 0.8 |
| 34 | (89) | −800 | 1.0 | −790 | 1.0 |
| 35 | (90) | −800 | 0.9 | −800 | 0.8 |
| 36 | (108) | −820 | 1.1 | −815 | 1.0 |

Notes:
Ex. = Example,
*(lux.second)

Example 37

1 Part by weight of an azo pigment (122) and 40 parts by weight of tetrahydrofuran were dispersed in a paint conditioner together with glass beads for 4 hours. To the thus-obtained dispersion were added 2.5 parts by weight of an example compound (38), 10 parts by weight of a polycarbonate resin (PCZ-200, supplied by Mitsubishi Gas Chemical Co., Inc.) and 60 parts by weight of tetrahydrofuran, and the mixture was further dispersed in the paint conditioner for 30 minutes. The thus-obtained dispersion was applied to an aluminum-deposited polyester film, to form a photoreceptor having a thickness of approximately 15 $\mu$m.

The above photoreceptor was evaluated for electrophotographic properties in the same manner as in Example 1 except that the applied voltage was changed to +5 kV. As a result, the photoreceptor showed a charge potential (Vo) of +400 V and a half exposure (E ½) of 1.3 lux·second in a first cycle and showed a charge potential (Vo) of +390 V and a half exposure (E ½) of 1.2 lux·second after a 5,000th cycle, so that the photoreceptor exhibited high sensitivity and little change in properties.

Examples 38–54

Photoreceptors were produced in the same manner as in Example 37 except that the azo pigment (122) and the example compound (38) in Example 37 were replaced with azo pigments and example compounds shown in Table 6. The photoreceptors were evaluated in the same manner as in Example 37. Table 6 shows the results.

TABLE 6

| Ex. | Azo pigment | Example compound | First cycle Vo (v) | First cycle E½* | 5000th cycle Vo (v) | 5000th cycle E½* |
|---|---|---|---|---|---|---|
| 38 | (122) | (24) | 420 | 1.3 | 410 | 1.3 |
| 39 | (122) | (29) | 405 | 1.3 | 395 | 1.2 |
| 40 | (126) | (31) | 400 | 1.3 | 395 | 1.3 |
| 41 | (126) | (34) | 430 | 1.2 | 415 | 1.2 |
| 42 | (123) | (40) | 430 | 1.4 | 425 | 1.3 |
| 43 | (124) | (42) | 435 | 1.3 | 420 | 1.2 |
| 44 | (125) | (54) | 425 | 1.3 | 410 | 1.3 |
| 45 | (127) | (56) | 420 | 1.4 | 415 | 1.4 |
| 46 | (122) | (78) | 420 | 1.3 | 410 | 1.3 |
| 47 | (122) | (68) | 435 | 1.3 | 420 | 1.2 |
| 48 | (122) | (70) | 425 | 1.3 | 410 | 1.3 |
| 49 | (126) | (83) | 430 | 1.4 | 425 | 1.3 |
| 50 | (126) | (85) | 420 | 1.3 | 410 | 1.3 |
| 51 | (123) | (86) | 405 | 1.3 | 395 | 1.2 |

TABLE 6-continued

| Ex. | Azo pigment | Example compound | First cycle Vo (v) | First cycle E½* | 5000th cycle Vo (v) | 5000th cycle E½* |
|---|---|---|---|---|---|---|
| 52 | (124) | (89) | 400 | 1.3 | 395 | 1.3 |
| 53 | (125) | (90) | 430 | 1.2 | 415 | 1.2 |
| 54 | (127) | (108) | 420 | 1.4 | 415 | 1.4 |

Notes:
Ex. = Example,
*(lux.second)

Example 55

1.0 Gram of a polyvinyl butyral resin (BM-1, supplied by Sekisui Chemical Co., Ltd.) was dissolved in 100 g of 1,3-dioxolane, and 1.5 g of titanyloxyphthalocyanine (T-22S, supplied by Sanyo Color Works, Ltd.) as a charge-generating substance was added. The mixture was dispersed in a paint conditioner together with a low-alkali glass beads having a diameter of 1 mm for 4 hours. The thus-obtained dispersion was applied to a metal aluminum thin sheet (JIS Standard #1050), and the applied dispersion was dried to form a charge-generating layer having a thickness of approximately 0.2 $\mu$m. Then, 10 g of an example compound (38), 10 g of polycarbonate (Panlite K-1300, supplied by Teijin Chemical Ltd.) and 0.2 g of tert-butylhydroquinone were dissolved in 200 g of tetrahydrofuran, the resultant solution was applied onto the above charge-generating layer with an applicator, and the applied solution was dried to form a charge-transporting layer having a thickness of approximately 20 $\mu$m.

The thus-prepared multiplayer type photoreceptor was evaluated for electrophotographic properties in the same manner as in Example 1 except that the applied voltage was changed to −6 kV. As a result, the photoreceptor showed a charge potential (Vo) of −790 V, a residual potential (Vr) of −8 V and a half exposure (E ½) of 0.8 lux·second, or it showed high sensitivity values.

Further, the photoreceptor was evaluated for properties in repeated use in which charge-discharge (discharge light: exposure to white light of 400 lux×1 second) was one cycle, with the same machine. When a change in charge potential in repeated use of 5,000 cycles was measured, the photoreceptor showed a charge potential (Vo) of −790 V and a residual potential (Vr) of −8 V in a first cycle and a charge potential (Vo) of −785 V and a residual potential (Vr) of −12 V in a 5,000th cycle, so that the photoreceptor was free of a decrease in potential in repeated use and showed stable properties. Further, the photoreceptor showed a half exposure (E ½) of 0.8 lux·second in the first cycle and a half exposure (E ½) of 0.8 lux·second in the 5,000th cycle, or the photoreceptor showed no change and an excellent property.

Example 56–82

Photoreceptors were produced in the same manner as in Example 55 except that the example compound (38) and the tert-butyl hydroquinone in Example 55 were replaced with example compounds and additives shown in Table 7. The photoreceptors were evaluated in the same manner as in Example 55. Table 8 shows the results.

TABLE 7

| Ex. | Example compound | Additive |
|---|---|---|
| 56, 84 | (31) | Tert-butyl hydroquinone |
| 57, 85 | (85) | Tert-butyl hydroquinone |
| 58, 86 | (96) | Tert-butyl hydroquinone |
| 59, 87 | (38) | Methyl hydroquinone |
| 60, 88 | (31) | Methyl hydroquinone |
| 61, 89 | (85) | Methyl hydroquinone |
| 62, 90 | (96) | Methyl hydroquinone |
| 63, 91 | (38) | 2,5-di-tert-butyl hydroquinone |
| 64, 92 | (31) | 2,5-di-tert-butyl hydroquinone |
| 65, 93 | (85) | 2,5-di-tert-butyl hydroquinone |
| 66, 94 | (96) | 2,5-di-tert-butyl hydroquinone |
| 67, 95 | (38) | 3,5-di-tert-butyl-4-hydroxytoluene |
| 68, 96 | (31) | 3,5-di-tert-butyl-4-hydroxytoluene |
| 69, 97 | (85) | 3,5-di-tert-butyl-4-hydroxytoluene |
| 70, 98 | (96) | 3,5-di-tert-butyl-4-hydroxytoluene |
| 71, 99 | (38) | 2,2'-methylenebis(6-tert-butyl-4-methylphenol) |
| 72, 100 | (31) | 2,2'-methylenebis(6-tert-butyl-4-methylphenol) |
| 73, 101 | (85) | 2,2'-methylenebis(6-tert-butyl-4-methylphenol) |
| 74, 102 | (96) | 2,2'-methylenebis(6-tert-butyl-4-methylphenol) |
| 75, 103 | (38) | α-Tocopherol |
| 76, 104 | (31) | α-Tocopherol |
| 77, 105 | (85) | α-Tocopherol |
| 78, 106 | (96) | α-Tocopherol |
| 79, 107 | (38) | γ-Tocopherol |
| 80, 108 | (31) | γ-Tocopherol |
| 81, 109 | (85) | γ-Tocopherol |
| 82, 110 | (96) | γ-Tocopherol |

Note:
Ex. = Example

TABLE 8

| | First cycle | | | 5000th cycle | | |
|---|---|---|---|---|---|---|
| Ex. | Vo (v) | Vr (v) | E½* | Vo (v) | Vr (v) | E½* |
| 56 | −795 | −11 | 0.8 | −790 | −15 | 0.8 |
| 57 | −795 | −12 | 0.8 | −790 | −14 | 0.8 |
| 58 | −790 | −15 | 0.8 | −780 | −20 | 0.9 |
| 59 | −790 | −15 | 0.8 | −780 | −21 | 0.8 |
| 60 | −795 | −14 | 0.9 | −785 | −22 | 0.9 |
| 61 | −785 | −12 | 0.8 | −775 | −20 | 0.8 |
| 62 | −780 | −13 | 0.9 | −770 | −21 | 0.8 |
| 63 | −795 | −17 | 0.8 | −775 | −23 | 0.8 |
| 64 | −785 | −14 | 0.8 | −770 | −22 | 0.8 |
| 65 | −770 | −10 | 0.8 | −765 | −12 | 0.9 |
| 66 | −790 | −10 | 0.8 | −780 | −16 | 0.8 |
| 67 | −790 | −10 | 0.8 | −785 | −17 | 0.8 |
| 68 | −790 | −12 | 0.8 | −780 | −16 | 0.8 |
| 69 | −805 | −20 | 0.9 | −790 | −25 | 0.9 |
| 70 | −800 | −20 | 0.8 | −785 | −28 | 0.8 |
| 71 | −795 | −19 | 0.9 | −775 | −28 | 0.9 |
| 72 | −790 | −22 | 0.9 | −770 | −27 | 0.9 |
| 73 | −795 | −10 | 0.8 | −790 | −14 | 0.8 |
| 74 | −780 | −15 | 0.9 | −770 | −20 | 0.9 |
| 75 | −805 | −6 | 0.8 | −800 | −9 | 0.8 |
| 76 | −810 | −9 | 0.8 | −800 | −14 | 0.8 |
| 77 | −800 | −15 | 0.9 | −795 | −20 | 0.9 |
| 78 | −795 | −19 | 0.9 | −775 | −28 | 0.9 |
| 79 | −785 | −14 | 0.9 | −770 | −21 | 0.9 |
| 80 | −790 | −15 | 0.9 | −770 | −23 | 0.9 |
| 81 | −800 | −20 | 0.8 | −785 | −23 | 0.9 |
| 82 | −810 | −9 | 0.8 | −800 | −14 | 0.8 |

Notes:
Ex. = Example,
*(lux.second)

Example 83

1 Gram of a metal-free phthalocyanine (TPA-891, supplied by Toyo Ink Mfg. Co., Ltd.) and 40 g of tetrahydrofuran were dispersed in a paint conditioner together with low-alkali glass beads having a diameter of 1 mm for 4 hours. To the thus-obtained dispersion were added 2.5 g of an example compound (38), 10 g of a polycarbonate resin (PCZ-200, supplied by Mitsubishi Gas Chemical Co., Inc.), 0.05 g of tert-butyl hydroquinone and 60 g of tetrahydrofuran, and the mixture was further dispersed in the paint conditioner for 30 minutes. Then, the resultant dispersion was applied onto an aluminum-deposited polyester with an applicator, and the applied dispersion was dried to form a photoreceptor having a thickness of approximately 15 μm.

The above photoreceptor was evaluated for electrophotographic properties in the same manner as in Example 37. As a result, the photoreceptor showed a charge potential (Vo) of +395 V, a residual potential (Vr) of +8 V and a half exposure (E½) of 1.3 lux·second in a first cycle and showed a charge potential (Vo) of +390 V, a residual potential (Vr) of +11 V and a half exposure (E½) of 1.3 lux·second in a 5,000th cycle, or the photoreceptor had high sensitivity and exhibited excellent properties.

Examples 84–110

Photoreceptors were produced in the same manner as in Example 83 except that the example compound (38) and the tert-butyl hydroquinone in Example 83 were replaced with example compounds and additives shown in Table 9. The photoreceptors were evaluated in the same manner as in Example 83. Table 9 shows the results.

TABLE 9

| | First cycle | | | 5000th cycle | | |
|---|---|---|---|---|---|---|
| Example | Vo (v) | Vr (v) | E½* | Vo (v) | Vr (v) | E½* |
| 84 | +400 | +9 | 1.4 | +390 | +13 | 1.4 |
| 85 | +395 | +12 | 1.3 | +380 | +16 | 1.3 |
| 86 | +405 | +15 | 1.3 | +395 | +20 | 1.3 |
| 87 | +410 | +14 | 1.3 | +395 | +19 | 1.3 |
| 88 | +395 | +15 | 1.3 | +380 | +22 | 1.3 |
| 89 | +390 | +14 | 1.3 | +385 | +20 | 1.4 |
| 90 | +400 | +17 | 1.4 | +395 | +25 | 1.4 |
| 91 | +400 | +18 | 1.4 | +385 | +26 | 1.4 |
| 92 | +405 | +20 | 1.3 | +385 | +27 | 1.3 |
| 93 | +400 | +8 | 1.4 | +385 | +11 | 1.3 |
| 94 | +395 | +12 | 1.4 | +385 | +18 | 1.4 |
| 95 | +390 | +10 | 1.3 | +385 | +16 | 1.3 |
| 96 | +390 | +9 | 1.3 | +375 | +14 | 1.3 |
| 97 | +405 | +11 | 1.3 | +385 | +17 | 1.3 |
| 98 | +410 | +8 | 1.3 | +405 | +8 | 1.3 |
| 99 | +400 | +14 | 1.4 | +390 | +17 | 1.4 |
| 100 | +395 | +12 | 1.3 | +380 | +18 | 1.3 |
| 101 | +385 | +13 | 1.4 | +370 | +22 | 1.4 |
| 102 | +385 | +16 | 1.4 | +370 | +24 | 1.4 |
| 103 | +410 | +5 | 1.3 | +405 | +8 | 1.3 |
| 104 | +400 | +7 | 1.3 | +390 | +10 | 1.3 |
| 105 | +400 | +14 | 1.4 | +390 | +17 | 1.4 |
| 106 | +395 | +12 | 1.3 | +380 | +18 | 1.3 |
| 107 | +380 | +13 | 1.4 | +360 | +22 | 1.4 |
| 108 | +385 | +16 | 1.4 | +370 | +24 | 1.4 |
| 109 | +400 | +11 | 1.2 | +390 | +10 | 1.3 |
| 110 | +395 | +9 | 1.3 | +390 | +13 | 1.3 |

Note:
*(lux.second)

Example 111

10 Grams of an example compound (38) and 10 g of an example binder (CP-2) were dissolved in 200 g of tetrahydrofuran. The resultant solution was applied, with an applicator, onto a charge-generating layer prepared in the same manner as in Example 55, and the applied solution was dried to form a charge-transporting layer having a thickness of approximately 20 μm.

The thus-prepared photoreceptor was evaluated for properties in the same manner as in Example 55. As a result, the photoreceptor showed a charge potential (Vo) of −800 V, a residual potential (Vr) of −5 V and a half exposure (E½) of 0.8 lux·second, or the photoreceptor exhibited high sensitivity values.

Further, the photoreceptor was evaluated for properties in repeated use in which charge-discharge (discharge light: exposure to white light of 400 lux×1 second) was one cycle, with the same machine. When a change in charge potential in repeated use of 5,000 cycles was measured, the photoreceptor showed a charge potential (Vo) of −800 V and a residual potential (Vr) of −5 V in a first cycle and a charge potential (Vo) of −790 V and a residual potential (Vr) of −6 V in a 5,000th cycle, so that the photoreceptor showed almost no change in potential in repeated use and showed stable properties. Further, the photoreceptor showed a half exposure (E ½) of 0.8 lux·second in the first cycle and a half exposure (E ½) of 0.8 lux·second in the 5,000th cycle, so that the photoreceptor showed no change and an excellent property.

Examples 112–131

Photoreceptors were produced in the same manner as in Example 111 except that the example compound (38) and the example binder (CP-2) in Example 111 were replaced with example compounds and example binders shown in Table 10. The photoreceptors were evaluated in the same manner as in Example 111. Table 11 shows the results.

TABLE 10

| Example | Example compound | Example binder |
|---|---|---|
| 112, 133 | (78) | (CP-2) |
| 113, 134 | (18) | (CP-2) |
| 114, 135 | (38) | (CP-4) |
| 115, 136 | (85) | (CP-4) |
| 116, 137 | (96) | (CP-4) |
| 117, 138 | (38) | (CP-6) |
| 118, 139 | (54) | (CP-6) |
| 119, 140 | (70) | (CP-6) |
| 120, 141 | (38) | (CP-1) |
| 121, 142 | (18) | (CP-1) |
| 122, 143 | (78) | (CP-1) |
| 123, 144 | (38) | (CP-21) |
| 124, 145 | (85) | (CP-21) |
| 125, 146 | (70) | (CP-21) |
| 126, 147 | (38) | (CP-55) |
| 127, 148 | (18) | (CP-55) |
| 128, 149 | (96) | (CP-55) |
| 129, 150 | (38) | (CP-56) |
| 130, 151 | (54) | (CP-56) |
| 131, 152 | (31) | (CP-56) |

TABLE 11

| | First cycle | | | 5000th cycle | | |
|---|---|---|---|---|---|---|
| Example | Vo (v) | Vr (v) | E½* | Vo (v) | Vr (v) | E½* |
| 112 | −790 | −6 | 0.8 | −785 | −8 | 0.8 |
| 113 | −790 | −15 | 0.9 | −770 | −21 | 0.9 |
| 114 | −790 | −11 | 0.9 | −770 | −15 | 0.9 |
| 115 | −795 | −14 | 0.9 | −780 | −20 | 0.9 |
| 116 | −800 | −5 | 0.9 | −785 | −8 | 0.8 |
| 117 | −795 | −10 | 0.9 | −775 | −17 | 0.9 |
| 118 | −790 | −11 | 0.9 | −770 | −17 | 0.9 |
| 119 | −785 | −14 | 1.0 | −765 | −25 | 1.0 |
| 120 | −795 | −10 | 0.9 | −775 | −17 | 0.9 |
| 121 | −790 | −11 | 0.9 | −770 | −17 | 0.9 |
| 122 | −795 | −10 | 0.9 | −775 | −17 | 0.9 |
| 123 | −790 | −7 | 0.8 | −785 | −10 | 0.8 |
| 124 | −800 | −14 | 0.9 | −785 | −20 | 0.9 |

TABLE 11-continued

| | First cycle | | | 5000th cycle | | |
|---|---|---|---|---|---|---|
| Example | Vo (v) | Vr (v) | E½* | Vo (v) | Vr (v) | E½* |
| 125 | −790 | −15 | 1.0 | −775 | −20 | 1.0 |
| 126 | −795 | −13 | 0.9 | −775 | −16 | 0.9 |
| 127 | −795 | −13 | 0.9 | −775 | −16 | 0.9 |
| 128 | −800 | −10 | 0.9 | −790 | −15 | 0.9 |
| 129 | −795 | −13 | 0.9 | −775 | −18 | 0.9 |
| 130 | −800 | −14 | 0.9 | −785 | −20 | 0.9 |
| 131 | −805 | −11 | 0.9 | −780 | −15 | 0.9 |

Note:
*(lux.second)

Example 132

A photoreceptor was prepared in the same manner as in Example 83 except that the polycarbonate resin in Example 83 was replaced with an example binder (CP-2) and that the tert-butyl hydroquinone was not added.

The above photoreceptor was evaluated for electrophotographic properties in the same manner as in Example 37. As a result, the photoreceptor showed a charge potential (Vo) of +405 V, a residual potential (Vr) of +6 V and a half exposure (E½) of 1.3 lux·second in a first cycle and showed a charge potential (Vo) of +400 V, a residual potential (Vr) of +8 V and a half exposure (E½) of 1.3 lux·second after a 5,000th cycle, or the photoreceptor showed high sensitivity and little change and exhibited excellent properties.

Examples 133–152

Photoreceptors were produced in the same manner as in Example 132 except that the example compound (38) and the example binder (CP-2) in Example 132 were replaced with example compounds and example binders shown in Table 10. The photoreceptors were evaluated in the same manner as in Example 132. Table 12 shows the results.

TABLE 12

| | First cycle | | | 5000th cycle | | |
|---|---|---|---|---|---|---|
| Example | Vo (v) | Vr (v) | E½* | Vo (v) | Vr (v) | E½* |
| 133 | +390 | +5 | 1.3 | +385 | +9 | 1.3 |
| 134 | +380 | +10 | 1.5 | +360 | +18 | 1.5 |
| 135 | +370 | +14 | 1.4 | +355 | +19 | 1.4 |
| 136 | +380 | +13 | 1.4 | +360 | +17 | 1.4 |
| 137 | +380 | +10 | 1.5 | +370 | +20 | 1.5 |
| 138 | +390 | +10 | 1.4 | +380 | +15 | 1.4 |
| 139 | +395 | +13 | 1.3 | +385 | +16 | 1.3 |
| 140 | +370 | +14 | 1.4 | +355 | +19 | 1.4 |
| 141 | +385 | +14 | 1.4 | +365 | +19 | 1.4 |
| 142 | +375 | +12 | 1.3 | +360 | +19 | 1.3 |
| 143 | +390 | +10 | 1.3 | +370 | +15 | 1.3 |
| 144 | +395 | +12 | 1.4 | +375 | +15 | 1.4 |
| 145 | +390 | +13 | 1.3 | +380 | +17 | 1.3 |
| 146 | +385 | +15 | 1.4 | +375 | +23 | 1.4 |
| 147 | +375 | +14 | 1.4 | +355 | +20 | 1.4 |
| 148 | +390 | +13 | 1.3 | +380 | +17 | 1.3 |
| 149 | +400 | +15 | 1.3 | +395 | +25 | 1.2 |
| 150 | +385 | +15 | 1.4 | +375 | +23 | 1.4 |
| 151 | +385 | +7 | 1.3 | +380 | +9 | 1.3 |
| 152 | +380 | +9 | 1.3 | +365 | +13 | 1.3 |

Note:
*(lux.second)

Example 153

5 Grams of an example compound (38), 5 g of a compound (5-3), 10 g of polycarbonate (Panlite K-1300, supplied by Teijin Chemical Ltd.) and 0.2 g of tert-butyl hydroquinone were dissolved in 200 g of tetrahydrofuran, and the resultant solution was applied, with an applicator, onto a charge-generating layer formed in the same manner as in Example 55. The applied solution was dried to form a charge-transporting layer having a thickness of approximately 20 μm, whereby a multilayer type photoreceptor was prepared.

The thus-prepared photoreceptor was evaluated for properties in the same manner as in Example 55. As a result, the photoreceptor showed a charge potential (Vo) of −800 V, a residual potential (Vr) of −3 V and a half exposure E½) of 0.6 lux·second, or the photoreceptor exhibited high sensitivity values.

Further, the photoreceptor was evaluated for properties in repeated use in which charge-discharge (discharge light: exposure to white light of 400 lux×1 second) was one cycle, with the same machine. When a change in charge potential in repeated use of 5,000 cycles was measured, the photoreceptor showed a charge potential (Vo) of −800 V and a residual potential (Vr) of −3 V in a first cycle and a charge potential (Vo) of −790 V and a residual potential (Vr) of −5 V in a 5,000th cycle, or the photoreceptor was free of a change in potential in repeated use and showed stable properties. Further, the photoreceptor showed a half exposure (E ½) of 0.6 lux·second in the first cycle and a half exposure (E ½) of 0.6 lux·second in the 5,000th cycle, or the photoreceptor showed no change and an excellent property.

Examples 154–173

Photoreceptors were produced in the same manner as in Example 153 except that the example compound (38) and the compound (5-3) in Example 153 were replaced with example compounds and compounds shown in Table 13. The photoreceptors were evaluated in the same manner as in Example 153. Table 14 shows the results.

TABLE 13

| Example | Example compound | Compound |
|---|---|---|
| 154, 175 | (18) | (5-3) |
| 155, 176 | (85) | (5-3) |
| 156, 177 | (36) | (5-4) |
| 157, 178 | (78) | (5-4) |
| 158, 179 | (70) | (5-4) |
| 159, 180 | (38) | (6-1) |
| 160, 181 | (96) | (6-1) |
| 161, 182 | (31) | (6-1) |
| 162, 183 | (38) | (6-10) |
| 163, 184 | (54) | (6-10) |
| 164, 185 | (18) | (6-10) |
| 165, 186 | (38) | (7-1) |
| 166, 187 | (85) | (7-1) |
| 167, 188 | (96) | (7-1) |
| 168, 189 | (38) | (7-2) |
| 169, 190 | (70) | (7-2) |
| 170, 191 | (54) | (7-2) |
| 171, 192 | (38) | (8-3) |
| 172, 193 | (31) | (8-3) |
| 173, 194 | (78) | (8-3) |

TABLE 14

| | First cycle | | | 5000th cycle | | |
|---|---|---|---|---|---|---|
| Example | Vo (v) | Vr (v) | E½* | Vo (v) | Vr (v) | E½* |
| 154 | −790 | −4 | 0.6 | −780 | −8 | 0.6 |
| 155 | −800 | −7 | 0.6 | −790 | −11 | 0.6 |
| 156 | −790 | −9 | 0.8 | −785 | −13 | 0.8 |

TABLE 14-continued

| | First cycle | | | 5000th cycle | | |
|---|---|---|---|---|---|---|
| Example | Vo (v) | Vr (v) | E½* | Vo (v) | Vr (v) | E½* |
| 157 | −800 | −10 | 0.9 | −795 | −20 | 0.9 |
| 158 | −810 | −15 | 0.9 | −800 | −19 | 0.8 |
| 159 | −790 | −11 | 0.9 | −775 | −17 | 0.9 |
| 160 | −780 | −10 | 0.8 | −775 | −20 | 0.9 |
| 161 | −795 | −12 | 0.8 | −785 | −18 | 0.8 |
| 162 | −785 | −13 | 0.8 | −770 | −17 | 0.8 |
| 163 | −790 | −9 | 0.8 | −785 | −13 | 0.8 |
| 164 | −800 | −14 | 0.9 | −790 | −20 | 0.9 |
| 165 | −795 | −12 | 1.0 | −780 | −18 | 1.0 |
| 166 | −805 | −13 | 1.0 | −785 | −20 | 1.0 |
| 167 | −780 | −15 | 1.0 | −770 | −15 | 1.0 |
| 168 | −795 | −14 | 1.0 | −780 | −19 | 1.0 |
| 169 | −790 | −10 | 0.9 | −785 | −15 | 1.0 |
| 170 | −795 | −14 | 1.0 | −775 | −19 | 1.0 |
| 171 | −805 | −15 | 1.0 | −790 | −22 | 1.0 |
| 172 | −795 | −11 | 0.9 | −785 | −15 | 0.9 |
| 173 | −795 | −10 | 1.0 | −780 | −15 | 1.0 |

Note:
*(lux.second)

Example 174

1 Gram of a metal-free phthalocyanine (TPA-891, supplied by Toyo Ink Mfg. Co., Ltd.) and 40 g of tetrahydrofuran were dispersed in a paint conditioner together with low-alkali glass beads having a diameter of 1 mm for 4 hours. To the thus-obtained dispersion were added 1.5 g of an example compound (38), 1.0 g of a compound (5-3), 10 g of a polycarbonate resin (PCZ-200, supplied by Mitsubishi Gas Chemical Co., Inc.) and 60 g of tetrahydrofuran, and the mixture was further dispersed in the paint conditioner for 30 minutes. Then, the resultant dispersion was applied onto an aluminum-deposited polyester film with an applicator, and the applied dispersion was dried to form a photoreceptor having a thickness of approximately 15 μm.

The above photoreceptor was evaluated for electrophotographic properties in the same manner as in Example 37. As a result, the photoreceptor showed a charge potential (Vo) of +420 V, a residual potential (Vr) of +5 V and a half exposure (E½) of 1.2 lux·second in a first cycle and showed a charge potential (Vo) of +415 V, a residual potential (Vr) of +7 V and a half exposure E½) of 1.1 lux·second in a 5,000th cycle, or the photoreceptor showed high sensitivity and almost no changes and exhibited excellent properties.

Examples 175–194

Photoreceptors were produced in the same manner as in Example 174 except that the example compound (38) and the compound (5-3) in Example 174 were replaced with example compounds and compounds shown in Table 13. The photoreceptors were evaluated in the same manner as in Example 174. Table 15 shows the results.

TABLE 15

| | First cycle | | | 5000th cycle | | |
|---|---|---|---|---|---|---|
| Example | Vo (v) | Vr (v) | E½* | Vo (v) | Vr (v) | E½* |
| 175 | +380 | +15 | 1.3 | +370 | +19 | 1.3 |
| 176 | +390 | +15 | 1.3 | +375 | +20 | 1.3 |
| 177 | +385 | +16 | 1.3 | +365 | +22 | 1.3 |
| 178 | +400 | +17 | 1.3 | +385 | +19 | 1.3 |
| 179 | +395 | +14 | 1.4 | +385 | +21 | 1.4 |

TABLE 15-continued

| Example | First cycle Vo (v) | First cycle Vr (v) | First cycle E½* | 5000th cycle Vo (v) | 5000th cycle Vr (v) | 5000th cycle E½* |
|---|---|---|---|---|---|---|
| 180 | +395 | +9 | 1.2 | +385 | +11 | 1.2 |
| 181 | +395 | +11 | 1.3 | +385 | +16 | 1.3 |
| 182 | +385 | +12 | 1.3 | +370 | +15 | 1.3 |
| 183 | +380 | +13 | 1.3 | +375 | +17 | 1.3 |
| 184 | +380 | +15 | 1.3 | +370 | +19 | 1.3 |
| 185 | +405 | +15 | 1.4 | +390 | +19 | 1.4 |
| 186 | +400 | +12 | 1.4 | +390 | +17 | 1.4 |
| 187 | +395 | +13 | 1.4 | +385 | +20 | 1.4 |
| 188 | +405 | +15 | 1.4 | +390 | +19 | 1.4 |
| 189 | +385 | +16 | 1.4 | +375 | +20 | 1.4 |
| 190 | +380 | +11 | 1.5 | +375 | +10 | 1.5 |
| 191 | +380 | +15 | 1.5 | +365 | +21 | 1.5 |
| 192 | +385 | +15 | 1.5 | +370 | +22 | 1.5 |
| 193 | +390 | +10 | 1.3 | +380 | +16 | 1.3 |
| 194 | +385 | +10 | 1.4 | +375 | +10 | 1.4 |

Note:
*(lux.second)

Table 16 shows phthalocyanines used in Examples 195 to 212 to be described below.

TABLE 16

| Symbol | Phthalocyanines |
|---|---|
| Pc-1 | X type metal-free phthalocyanine that exhibits main peaks at 7.5°, 9.1°, 16.7°, 17.3° and 22.3°. |
| Pc-2 | τ type phthalocyanine that exhibits main peaks at 7.6°, 9.2°, 16.8°, 17.4°, 20.4° and 20.9°. |
| Pc-3 | Amorphous titanyloxyphthalocyanine |
| Pc-4 | Titanyloxyphthalocyanine that exhibits peaks at 9.5°, 9.7°, 11.7°, 15.0°, 23.5°, 24.1° and 27.3°. |
| Pc-5 | Titanyloxyphthalocyanine that exhibits peaks at 9.5°, 13.5°, 14.2°, 18.0°, 24.0° and 27.2°. |
| Pc-6 | Titanyloxyphthalocyanine that exhibits peaks at 9.0°, 14.2°, 23.9° and 27.1°. |
| Pc-7 | Titanyloxyphthalocyanine that exhibits a maximum peak at 27.3° and peaks at 7.4°, 9.7° and 24.2°. |
| Pc-8 | Hydroxygalliumphthalocyanine |
| Pc-9 | Hydroxyindiumphthalocyanine |
| Pc-10 | Diphenoxygermaniumphthalocyanine |
| Pc-11 | Phthalocyanine composition that exhibits main peaks at 7.0°, 9.0°, 14.1°, 18.0°, 23.7° and 27.3°. |

Example 195

A photoreceptor was prepared in the same manner as in Example 1 except that the azo pigment (122) was replaced with phthalocyanine (Pc-5). The photoreceptor was evaluated for electrophotographic properties. As a result, the photoreceptor showed a charge potential (Vo) of −870 V and a half exposure (E½) of 1.0 lux·second or exhibited high sensitivity values.

Further, the above photoreceptor was evaluated for a change in charge potential in repeated use of 5,000 cycles in the same manner as in Example 1. The photoreceptor showed a charge potential (Vo) of −870 V in a first cycle and a charge potential of −865 V in a 5,000th cycle or exhibited no decrease in potential and stable properties. Further, the photoreceptor showed a half exposure (E ½) of 1.0 lux·second in the first cycle and a half exposure (E ½) of 1.0 lux·second in the 5,000th cycle, or exhibited an excellent property.

Examples 196–212

Photoreceptors were prepared in the same manner as in Example 195 except that the phthalocyanine (Pc-5) and the example compound (38) in Example 195 were replaced with phthalocyanines and example compounds shown in Table 17. The photoreceptors were evaluated in the same manner as in Example 195. Table 17 shows the results.

TABLE 17

| Ex. | Phthalocyanine | Example compound | First cycle Vo (v) | First cycle E½* | 5000th cycle Vr (v) | 5000th cycle E½* |
|---|---|---|---|---|---|---|
| 196 | Pc-1 | (24) | −830 | 0.9 | −815 | 1.0 |
| 197 | Pc-3 | (29) | −800 | 1.0 | −795 | 1.0 |
| 198 | Pc-4 | (31) | −825 | 0.9 | −820 | 1.0 |
| 199 | Pc-5 | (34) | −795 | 0.9 | −780 | 0.9 |
| 200 | Pc-6 | (40) | −820 | 1.0 | −815 | 1.0 |
| 201 | Pc-7 | (42) | −845 | 1.0 | −835 | 1.0 |
| 202 | Pc-8 | (54) | −825 | 0.9 | −810 | 0.9 |
| 203 | Pc-11 | (56) | −830 | 1.2 | −820 | 1.1 |
| 204 | Pc-2 | (70) | −825 | 1.0 | −815 | 1.0 |
| 205 | Pc-3 | (78) | −850 | 1.0 | −845 | 1.0 |
| 206 | Pc-4 | (85) | −805 | 1.0 | −795 | 0.9 |
| 207 | Pc-5 | (86) | −825 | 0.9 | −815 | 0.9 |
| 208 | Pc-6 | (89) | −795 | 0.9 | −780 | 0.9 |
| 209 | Pc-7 | (95) | −810 | 0.9 | −805 | 1.0 |
| 210 | Pc-9 | (96) | −830 | 1.0 | −825 | 1.0 |
| 211 | Pc-10 | (114) | −825 | 0.9 | −820 | 0.9 |
| 212 | Pc-11 | (115) | −830 | 1.1 | −825 | 1.0 |

Note:
*(lux.second)

Structural formulae of comparative compounds used in the following Comparative Examples are shown below.

(128)

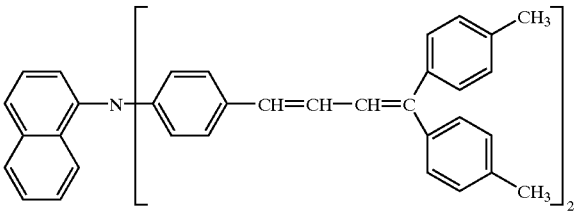

(129)

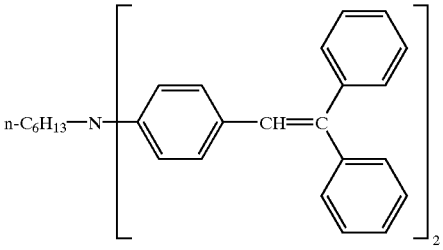

(130)

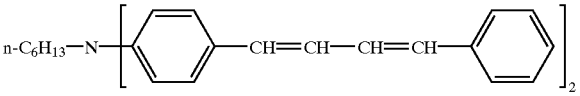

(131)

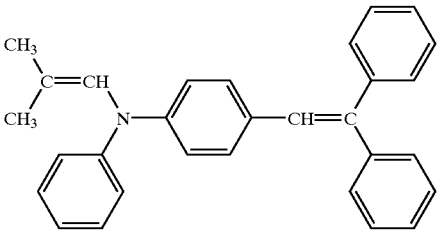

-continued (132)

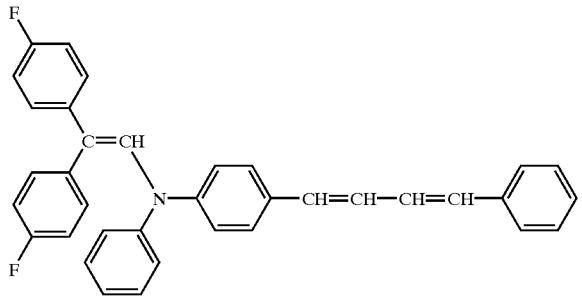

(133)

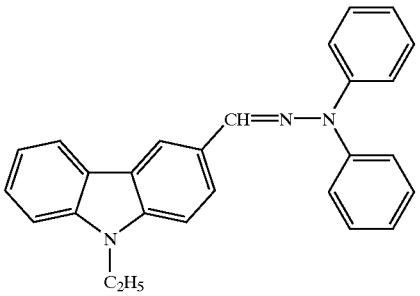

Comparative Example 1

A photoreceptor was prepared in the same manner as in Example 1 except that the example compound (38) was replaced with a comparative compound (130), and the photoreceptor was evaluated for the properties. As a result, the photoreceptor showed a charge potential (Vo) of −750 V and a half exposure (E ½) of 2.0 lux·second or relatively good results in a first cycle. However, in a 5,000th cycle, the photoreceptor showed a charge potential of −300 V and a half exposure (E ½) of 1.0 lux·second or showed a great decrease in potential and a great change in sensitivity in repeated use.

Comparative Example 2

A photoreceptor was prepared in the same manner as in Example 19 except that the example compound (38) was replaced with a comparative compound (128), and the photoreceptor was evaluated for the properties. As a result, the photoreceptor showed a charge potential (Vo) of −800 V and a half exposure (E ½) of 4.0 lux·second or low sensitivity in a first cycle. Further, in a 5,000th cycle, the photoreceptor showed a charge potential of −400 V and a half exposure (E ½) of 1.8 lux·second or showed a great decrease in potential and a great change in sensitivity in repeated use.

Comparative Example 3

A photoreceptor was prepared in the same manner as in Example 37 except that the example compound (38) was replaced with a comparative compound (133), and the photoreceptor was evaluated for the properties. As a result, the photoreceptor showed a charge potential (Vo) of +350 V and a half exposure (E ½) of 6.0 lux·second or insufficient sensitivity Comparative Example 4

A photoreceptor was prepared in the same manner as in Example 55 except that the example compound (38) was replaced with a comparative compound (129), and the photoreceptor was evaluated for the properties. As a result, the photoreceptor showed a charge potential (Vo) of −780 V, a residual potential (Vr) of −20 V and a half exposure (E ½) of 2.1 lux·second or relatively good results in a first cycle. However, in a 5,000th cycle, the photoreceptor showed a charge potential of −750 V, a residual potential (Vr) of −150 V and a half exposure (E ½) of 6.0 lux·second or showed a great change in potential and a great decrease in sensitivity in repeated use.

Comparative Example 5

A photoreceptor was prepared in the same manner as in Example 83 except that the example compound (38) was replaced with a comparative compound (128), and the photoreceptor was evaluated for the properties. As a result, the photoreceptor showed a charge potential (Vo) of +340 V, a residual potential (Vr) of +40 V and a half exposure (E ½) of 2.5 lux·second or relatively good results in a first cycle. However, in a 5,000th cycle, the photoreceptor showed a charge potential of +330 V and a residual potential (Vr) of +200 V or a great increase in residual potential.

Comparative Example 6

A photoreceptor was prepared in the same manner as in Example 111 except that the example compound (38) was replaced with a comparative compound (130), and the photoreceptor was evaluated for the properties. As a result, the photoreceptor showed a charge potential (Vo) of −800 V and a half exposure (E ½) of 2.2 lux·second or relatively good results in a first cycle. However, in a 5,000th cycle, the photoreceptor showed a charge potential of −420 V and a half exposure (E ½) of 1.0 lux·second or showed a great decrease in potential and a great change in sensitivity in repeated use.

Comparative Example 7

A photoreceptor was prepared in the same manner as in Example 132 except that the example compound (38) was replaced with a comparative compound (133), and the photoreceptor was evaluated for the properties. As a result, the photoreceptor showed a charge potential (Vo) of +375 V and a half exposure (E ½) of 7.1 lux·second or insufficient sensitivity.

Comparative Example 8

A photoreceptor was prepared in the same manner as in Example 153 except that the example compound (38) was replaced with a comparative compound (131), and the photoreceptor was evaluated for the properties. As a result, the photoreceptor showed a charge potential (Vo) of −800 V, a residual potential (Vr) of −30 V and a half Co exposure (E ½) of 2.3 lux·second or relatively good results in a first cycle. However, in a 5,000th cycle, the photoreceptor showed a charge potential of −780 V, a residual potential (Vr) of −250 V and a half exposure (E ½) of 5.0 lux·second or showed a great change in potential and a great decrease in sensitivity in repeated use.

Comparative Example 9

A photoreceptor was prepared in the same manner as in Example 174 except that the example compound (38) was replaced with a comparative compound (129), and the photoreceptor was evaluated for the properties. As a result, the photoreceptor showed a charge potential (Vo) of +370 V, a residual potential (Vr) of +40 V and a half exposure (E ½) of 2.5 lux·second or relatively good results in a first cycle. However, in a 5,000th cycle, the photoreceptor showed a charge potential of +350 V, a residual potential (Vr) of +155 V and a half exposure (E ½) of 8.0 lux·second or showed a great change in potential and a great decrease in sensitivity in repeated use.

Comparative Example 10

A photoreceptor was prepared in the same manner as in Example 195 except that the example compound (38) was replaced with a comparative compound (132), and the photoreceptor was evaluated for the properties. As a result, the photoreceptor showed a charge potential (Vo) of −760 V and a half exposure (E ½) of 5.5 lux·second or low sensitivity in a first cycle. In a 5,000th cycle, the photoreceptor showed a charge potential of −330 V and a half exposure (E ½) of 3.3 lux·second or showed a great decrease in potential.

What is claimed is:

1. An organic photoconductive material of the general formula (1), (1)

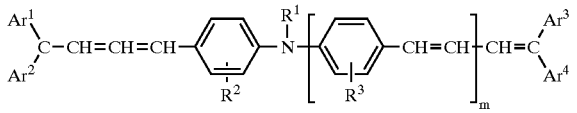

wherein $R^1$ is alkyl, aryl or a heterocyclic group, each of $R^2$ and $R^3$ is a hydrogen atom, a halogen atom or alkyl, each of $Ar^1$ to $Ar^4$ is aryl or a heterocyclic group and m is 1 when $R^1$ is alkyl or 0 when $R^1$ is aryl or a heterocyclic group.

2. An electrophotographic photoreceptor comprising an electrically conductive substrate and a photosensitive layer containing the organic photoconductive material recited in claim 1, the photosensitive layer being formed on an electrically conductive substrate.

3. The electrophotographic photoreceptor of claim 2, wherein the photosensitive layer contains a charge-generating substance and a charge-transporting substance and contains, as said charge-transporting substance, the organic photoconductive material recited in claim 1 and at least one component selected from hydroquinones, hindered phenols and tocopherols.

4. The electrophotographic photoreceptor of claim 2, wherein the photosensitive layer contains a charge-generating substance, a charge-transporting substance and a binder and contains, as the above charge-transporting substance, an organic photoconductive material recited in claim 1, and the photosensitive layer also contains, as said binder, a polycarbonate copolymer having a structural unit of the general formula (2), (2)

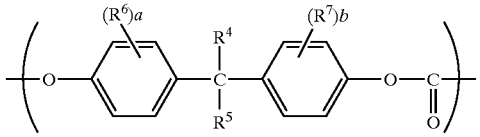

wherein each of $R^4$ and $R^5$ is a hydrogen atom, alkyl or aryl, each of $R^6$ and $R^7$ is a hydrogen atom, a halogen atom, alkyl or aryl, each of a and b is 1 or 2, and $R^4$ and $R^5$ may bond to each other and form a hydrocarbon ring having 5 to 8 carbon atoms, and a structural unit of the general formula (3), (3)

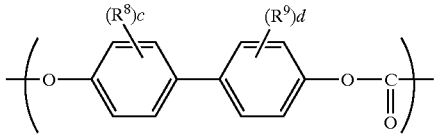

wherein each of $R^8$ and $R^9$ is a hydrogen atom, a halogen atom, alkyl or aryl and each of c and d is 1 or 2.

5. The electrophotographic photoreceptor of claim 2, wherein the photosensitive layer contains a charge-generating substance, a charge-transporting substance and a binder as components and contains, as said charge-transporting substance, the organic photoconductive material recited in claim 1 and the photosensitive layer also contains, as said binder, a polycarbonate copolymer having a structural unit of the general formula (4), (4)

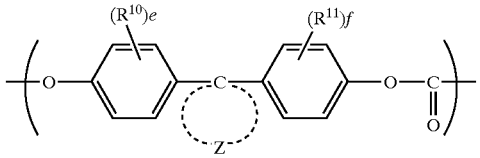

wherein each of $R^{10}$ and $R^{11}$ is a hydrogen atom, a halogen atom or alkyl, Z is a divalent organic group forming a hydrocarbon ring or a heterocycle by bonding to a carbon atom, and each of e and f is an integer of 1 to 4.

6. The electrophotographic photoreceptor of claim 1, wherein the photosensitive layer contains a charge-generating substance and a charge-transporting substance as components and contains, as said charge-transporting substance, the organic photoconductive material recited in claim 1 and the photosensitive layer also contains at least one selected from compounds of the general formulae (5) to (8), (5)

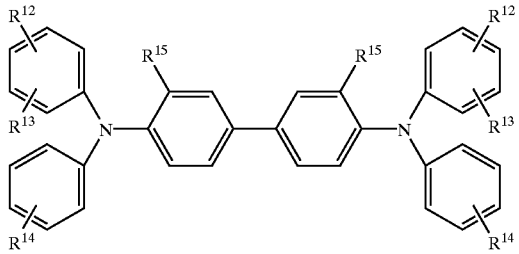

wherein $R^{12}$ is alkyl, alkoxyl, aralkyl, phenyl or a halogen atom, $R^{13}$ is a hydrogen atom, a halogen atom, alkyl, alkoxyl, aralkyl or phenyl, $R^{14}$ is a hydrogen atom, a halogen atom, alkyl, alkoxyl or aralkyl, and $R^{15}$ is a hydrogen atom, methyl or methoxy, (6)

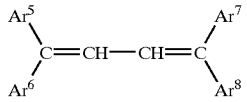

wherein each of $Ar^5$ to $Ar^8$ is phenyl, p-di-lower alkylaminophenyl, p-diphenylaminophenyl or p-dibenzylaminophenyl, provided that the number of amino-substituted phenyl group(s) is 1 or 2, (7)

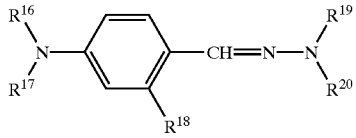

wherein each of $R^{16}$ and $R^{17}$ is lower alkyl, phenyl or benzyl, $R^{18}$ is a hydrogen atom, lower alkyl or alkoxyl, and each of $R^{19}$ and $R^{20}$ is lower alkyl, phenyl, benzyl or naphthyl, and (8)

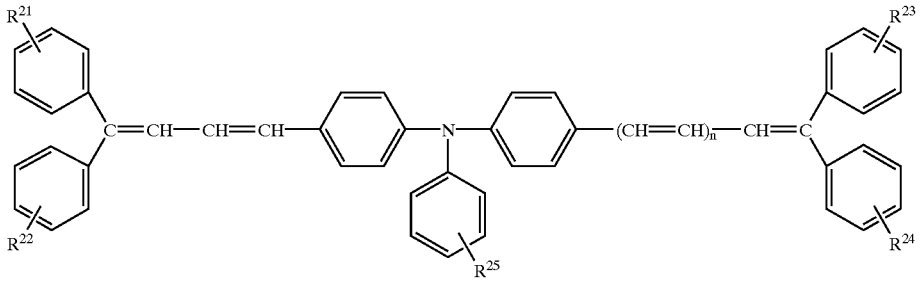

wherein each $R^{21}$ and $R^{25}$ is a hydrogen atom, a halogen atom, lower alkyl, alkoxyl or aryl, and n is 0 or 1.

7. The electrophotographic photoreceptor of claim 2, wherein the photosensitive layer contains a charge-generating substance and a charge-transporting substance and contains a phthalocyanine as said charge-generating substance and the organic photoconductive material recited in claim 1 as said charge-transporting substance.

8. The electrophotographic photoreceptor of claim 7, wherein the phthalocyanine is a metal-free phthalocyanine.

9. The electrophotographic photoreceptor of claim 7, wherein the phthalocyanine is an X type metal-free phthalocyanine that exhibits main peaks at Bragg angles (2θ±0.2°), to X ray of CuKα1.541 Å in X-ray diffraction spectrum, of 7.5°, 9.1°, 16.7°, 17.3° and 22.3°.

10. The electrophotographic photoreceptor of claim 7, wherein the phthalocyanine is a τ type metal-free phthalocyanine that exhibits main peaks at Bragg angles (2θ±0.2°), to X ray of CuKα1.541 Å in X-ray diffraction spectrum, of 7.6°, 9.2°, 16.8°, 17.4°, 20.4° and 20.9°.

11. The electrophotographic photoreceptor of claim 7, wherein the phthalocyanine is a phthalocyanine having a titanium atom as a central metal atom.

12. The electrophotographic photoreceptor of claim 7, wherein the phthalocyanine is an amorphous titanyloxyphthalocyanine that has a titanium atom as a central metal atom and exhibits no clear peak in X-ray diffraction spectrum.

13. The electrophotographic photoreceptor of claim 7, wherein the phthalocyanine is a titanyloxyphthalocyanine that has a titanium atom as a central metal atom and at least exhibits peaks at Bragg angles (2θ±0.2°), to X ray of CuKα1.541 Å in X-ray diffraction spectrum, of 9.5°, 9.7°, 11.7°, 15.0°, 23.5°, 24.1° and 27.3°.

14. The electrophotographic photoreceptor of claim 7, wherein the phthalocyanine is a titanyloxyphthalocyanine that has a titanium atom as a central metal atom and exhibits peaks at Bragg angles (2θ±0.2°), to X ray of CuKα1.541 Å in X-ray diffraction spectrum, of 9.5°, 13.5°, 14.2°, 18.0°, 24.0° and 27.2°.

15. The electrophotographic photoreceptor of claim 7, wherein the phthalocyanine is a titanyloxyphthalocyanine that has a titanium atom as a central metal atom and exhibits peaks at Bragg angles (2θ±0.2°), to X ray of CuKα1.541 Å in X-ray diffraction spectrum, of 9.0°, 14.2°, 23.9° and 27.1°.

16. The electrophotographic photoreceptor of claim 7, wherein the phthalocyanine is a titanyloxyphthalocyanine that has a titanium atom as a central metal atom and at least exhibits a maximum peak at Bragg angles (2θ±0.2°), to X ray of CuKα1.541 Å in X-ray diffraction spectrum, of 27.3° and peaks at 7.4°, 9.7° and 24.2°.

17. The electrophotographic photoreceptor of claim 7, wherein the phthalocyanine is a phthalocyanine having a gallium atom as a central metal atom.

18. The electrophotographic photoreceptor of claim 7, wherein the phthalocyanine is a phthalocyanine having a germanium atom as a central metal atom.

19. The electrophotographic photoreceptor of claim 7, wherein the phthalocyanine is a phthalocyanine having an indium atom as a central metal atom.

20. The electrophotographic photoreceptor of claim 7, wherein the phthalocyanine is a phthalocyanine composition that contains titanyloxyphthalocyanine and metal-free phthalocyanine and exhibits peaks at Bragg angles ($2\theta \pm 0.2°$), to X ray of CuK$\alpha$1.541 Å in X-ray diffraction spectrum, of 7.0°, 9.0°, 14.1°, 18.0°, 23.7° and 27.3°.

* * * * *